US005525431A

United States Patent [19]

Kanamaru et al.

[11] Patent Number: 5,525,431

[45] Date of Patent: Jun. 11, 1996

[54] ZINC-BASE GALVANIZED SHEET STEEL EXCELLENT IN PRESS-FORMABILITY, PHOSPHATABILITY, ETC. AND PROCESS FOR PRODUCING THE SAME

[75] Inventors: Tatsuya Kanamaru; Junichi Morita; Katsutoshi Arai; Shinichi Suzuki, all of Tokai, Japan

[73] Assignee: Nippon Steel Corporation, Japan

[21] Appl. No.: 108,937

[22] Filed: Aug. 19, 1993

Related U.S. Application Data

[63] Continuation of Ser. No. 741,527, Aug. 12, 1991.

[30] Foreign Application Priority Data

| | | | |
|---|---|---|---|
| Dec. 12, 1989 | [JP] | Japan | 1-320450 |
| Dec. 19, 1989 | [JP] | Japan | 1-328781 |
| Dec. 19, 1989 | [JP] | Japan | 1-328782 |
| Dec. 19, 1989 | [JP] | Japan | 1-328783 |
| Dec. 19, 1989 | [JP] | Japan | 1-328784 |
| Feb. 28, 1990 | [JP] | Japan | 2-048207 |
| Feb. 28, 1990 | [JP] | Japan | 2-048208 |
| Feb. 28, 1990 | [JP] | Japan | 2-048209 |
| Apr. 3, 1990 | [JP] | Japan | 2-088693 |
| Apr. 3, 1990 | [JP] | Japan | 2-088695 |
| Apr. 3, 1990 | [JP] | Japan | 2-088696 |
| Jul. 31, 1990 | [JP] | Japan | 2-202850 |
| Aug. 1, 1990 | [JP] | Japan | 2-204067 |
| Aug. 1, 1990 | [JP] | Japan | 2-204068 |
| Aug. 14, 1990 | [JP] | Japan | 2-215406 |

[51] Int. Cl.[6] ..... B32B 15/04; C23C 22/58; C25D 9/08

[52] U.S. Cl. ..... 428/623; 428/659; 428/632; 428/633; 428/658; 428/610; 148/263; 148/258; 148/262; 205/141; 205/155; 205/188

[58] Field of Search ..... 428/622, 623, 428/658, 659, 610, 632, 633; 148/263, 258, 262; 205/141, 155, 188

[56] References Cited

U.S. PATENT DOCUMENTS

| | | | |
|---|---|---|---|
| 2,417,133 | 3/1947 | Schweikher | 204/37 |
| 3,090,709 | 5/1963 | Henricks | 148/263 |
| 3,791,801 | 2/1974 | Ariga et al. | 428/659 |
| 4,108,690 | 8/1978 | Heller | 148/263 |
| 4,298,661 | 11/1981 | Ikeno et al. | 428/656 |
| 4,450,209 | 5/1984 | Hara et al. | 428/659 |

(List continued on next page.)

FOREIGN PATENT DOCUMENTS

| | | |
|---|---|---|
| 0034040A1 | 8/1981 | European Pat. Off. . |
| 0259657 | 3/1988 | European Pat. Off. . |
| 63-18688 | 3/1988 | Japan . |

OTHER PUBLICATIONS

*Chemical Abstracts,* vol. 106, No. 8, Feb. 1987, p. 510, abstract No. 7778w, Columbus, Ohio & JP–A–61–133,399 (Nippon Steel Corp.), Jun. 20, 1986.

Metals Handbook, 9th edition, vol. 5, 1982, pp. 434–456.

Metals Handbook, 8th edition, vol. 2, pp. 498–503; vol. 4, pp. 137–138, 1964.

Kubaschewski et al, "Oxidation of Metals and Alloys", 1962, pp. 1–3, 35–45.

Rompps Chemie–Lexikon, 8th edition, 1985, Patent Abstracts of Japan, JP–A–63 186 883.

*Primary Examiner*—Gary P. Straub
*Assistant Examiner*—N. M. Nguyen
*Attorney, Agent, or Firm*—Pollock, Vande Sande & Priddy

[57] ABSTRACT

A zinc-base galvanized sheet steel which comprises zinc-base plated sheet steel and, formed on the plating layer surface, an inorganic covering layer which contains at least one inorganic oxide in an amount of 1–500 mg/m$^2$ in terms of the weight of metallic elements exclusive of oxygen and optionally contains at least one oxoacid or inorganic oxide colloid in an amount of 1–500 mg/m$^2$ and further, as desired for improving weldability, a Zn oxide film formed between the inorganic covering layer and the zinc-base plating layer, and the process for producing said galvanized sheet steel.

16 Claims, 4 Drawing Sheets

U.S. PATENT DOCUMENTS

| | | | |
|---|---|---|---|
| 4,547,268 | 10/1985 | Bruno et al. | 205/142 |
| 4,659,631 | 4/1987 | Kurimoto et al. | 428/659 |
| 4,670,066 | 6/1987 | Schapira et al. | 148/259 |
| 4,708,744 | 11/1987 | Cabado | 148/248 |
| 4,861,441 | 8/1989 | Saito et al. | 428/623 |
| 4,904,542 | 2/1990 | Mroczkowski | 428/627 |
| 4,957,594 | 9/1990 | Yamazaki et al. | 428/659 |
| 5,178,952 | 1/1993 | Yamamoto et al. | 428/425.8 |

10μm

10μm

ZINC-BASE GALVANIZED SHEET STEEL EXCELLENT IN PRESS-FORMABILITY, PHOSPHATABILITY, ETC. AND PROCESS FOR PRODUCING THE SAME

This application is a continuation of Ser. No. 07/741,527 filed on Aug. 12, 1991.

TECHNICAL FIELD

The present invention relates to a zinc-base galvanized sheet steel excellent in weldability, press-formability, phosphatability, etc., and to a process for producing the same.

BACKGROUND ART

Several methods have been proposed for improving the weldability of zinc-base galvanized sheet steel. For example, it has been proposed, as disclosed in Japanese Patent Application Kokai (Laid-open) No. 55-110,783, to form a film of oxides such as $Al_2O_3$ on the surface of galvanized sheet steel, thereby, taking advantage of the high melting point and high electric resistance of the oxides, to improve weldability and at the same time to prevent the contact of the electrode tip with the plating metal, thus preventing the melt loss of the tip and prolonging the life thereof.

Further, it has been proposed, as disclosed in Japanese Patent Application Kokai (Laid-open) No. 59-104,463, to form an oxide film of a ZnO/Zn ratio of 0.1–0.70 on the surface of galvanized sheet steel by heat treatment, thereby to improve weldability in a similar manner to above.

However, even these methods hardly give a satisfactory result on an industrial scale, and the improvement of weldability in galvanized sheet steel is eagerly desired.

As to the methods for improving the press-formability of zinc-base galvanized sheet steel, it has been disclosed to form a hard film on zinc-base galvanized sheet steel thereby to prevent galling between the plating and the die and improve lubricity in press working by, for example, a method of applying an electrolytic chromate treatment to the galvanized sheet steel surface to form an oxide film of $Cr_2O_3$ as described in Japanese Patent Application Kokai (Laid-open) No. 62-185,883 and a method of applying an iron-zinc alloy plating as described in Japanese Patent Application Kokai (Laid-open) No. 62-192,597.

Further, it has been disclosed, as described in Japanese Patent Application Kokai (Laid-open) No. H-1-136,952, to coat or cover such organic substances as organic lubricating film, lubricating oil, etc. on the galvanized sheet steel surface to improve its press-formability.

However, galvanized sheet steel products obtained by these methods are unsatisfactory for use in the automotive industry in the following points.

Galvanized sheet steel is employed by users in the automotive industry through a process comprising, in outline, the step of washing the sheet steel with oil, the pressing step, the degreasing step, the phosphating step, and the painting step. In the case of electrolytic chromate-treated sheet steel, a phosphate film fails to be formed in the phosphating treatment. In the case of sheet steel coated with lubricating oil or lubricating film, a satisfactory lubricating property is not exhibited since the coated materials fall off in the washing step. Further, extra load is put on the degreasing step precedent to the phosphating treatment, resulting in a higher cost. In the case of zinc-base galvanized sheet steel to which iron-zinc alloy flash plating has been applied, on the other hand, the sheet is of a higher cost as compared with those obtained by electrolytic chromate treatment.

DISCLOSURE OF THE INVENTION

The present inventors have found out that by forming on the surface of the plating layer an inorganic covering layer consisting of specified amounts of oxides of inorganic compounds, etc., an adhesion preventing function is developed through which said covering layer sticks fast to the plating layer surface at the time of press working and the sticked covering layer deforms according as the plating layer deforms, and by providing, as desired, in the covering layer a film composed of specific oxoacids, etc., a rolling lubricating function is imparted between the die and the plating layer, whereby a zinc-base galvanized sheet steel excellent in press-formability and phosphatability can be obtained, and that, when good weldability is further required, by forming a covering layer composed of a specified amount of zinc oxide directly on the surface of the plating layer of zinc-base galvanized sheet steel and further forming an inorganic covering layer composed of oxides of inorganic compounds, etc. mentioned above or forming merely an inorganic covering layer composed mainly of Zn oxide and Mn oxide, a zinc-base galvanized sheet steel excellent in press-formability, phosphatability and weldability can be obtained. The present invention has been accomplished on the basis of the above findings.

Thus, the object of the present invention is to provide a zinc-base galvanized sheet steel excellent in press-formability and phosphatability which is of a low cost, can be phosphatized, and can be produced without imposing extra load on the steps of degreasing, etc. and also a process for producing the sheet steel.

The first aspect of the present invention relates to a zinc-base galvanized sheet steel excellent in press-formability and phosphatability which comprises zinc-base plated sheet steel and, formed on the plating layer surface, an inorganic covering layer which contains 1–500 mg/m$^2$ (in terms of weight of metals) of oxides such as metal oxides etc., has an adhesion preventing function through which the covering layer sticks fast to the plating layer surface at the time of press working and maintains covering in pursuance of its deformation and additionally, as desired, has also a rolling lubricating function between the die and the plating layer. The second aspect of the present invention relates to a process for producing said galvanized sheet steel.

The third aspect of the present invention relates to a zinc-base galvanized sheet steel excellent in press-formability, phosphatability and further in weldability which comprises a zinc-base galvanized sheet steel and an inorganic covering layer composed of mixed films of oxides of zinc and Mn formed on the plating layer surface or a covering layer composed of 30–3,000 mg/m$^2$ of zinc oxide formed between the plating layer surface and said inorganic covering layer. The fourth aspect of the present invention relates to a process for producing said galvanized sheet steel.

BEST MODE FOR CARRYING OUT THE INVENTION

Figure 1:
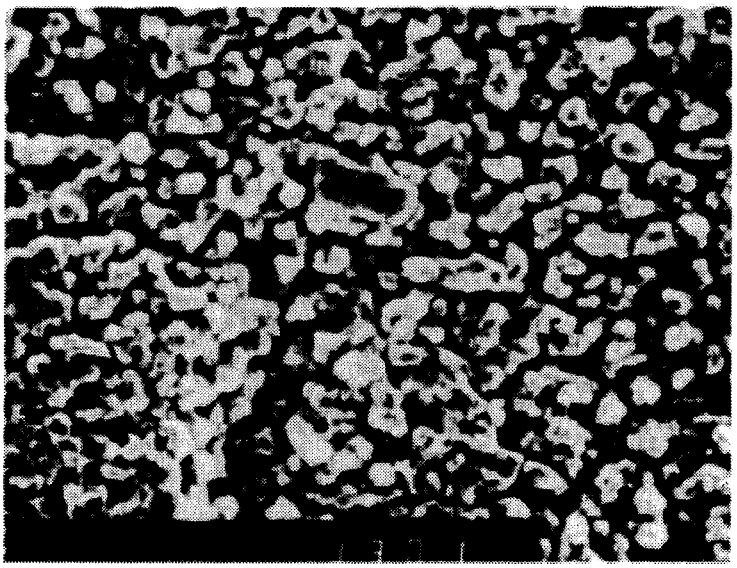
FIG. 1 is an electron photomicrograph showing the crystal structure of an amorphous oxide-base film formed on the surface of an electrogalvanized sheet steel.

The zinc-base galvanized sheet steel, the improvement of which is intended in the present invention, may be produced by various processes including, for example, hot dipping, electroplating, vapor deposition, metal spraying, etc. As to the compositions of the plating, they may be pure Zn, or they may be alloys which comprise Zn as the major component, for example, Zn and Fe, Zn and Ni, Zn and Al, Zn and Mn, Zn and Cr, Zn and Ti, Zn and Mg, etc., and may further comprise, to improve some properties such as corrosion resistance, one or more alloy elements selected from Fe, Ni, Co, Al, Pb, Sn, Sb, Cu, Ti, Si, B, P, N, S, O, etc. and impurity elements. Further, they may contain fine particles of ceramics such as $SiO_2$, $Al_2O_3$, etc., oxides such as $TiO_2$, $BaCrO_4$, etc. or organic polymers such as acrylic resins, etc., dispersed in the plating layer. The composition may be uniform in the thickness direction of the plating layer, or it may vary continuously or in layers. Further, in multi-layer plated steel sheets, the uppermost plating layer may be of pure Zn or it may be an alloy which comprises Zn as the major component, for example, Zn and Fe, Zn and Ni, Zn and Al, Zn and Mn, Zn and Cr, Zn and Ti, Zn and Mg, etc. and may further comprise, to improve some properties such as corrosion resistance, one or more alloy elements and impurity elements. Further, it may contain fine particles of ceramics such as $SiO_2$, $Al_2O_3$, etc., oxides such as $TiO_2$, $BaCrO_4$, etc., and organic polymers such as acrylic resins, etc., dispersed in the plating layer.

As specific examples of the galvanized sheet steel, there may be mentioned hot-dip galvanized sheet steel, vapor-deposition galvanized sheet steel, galvannealed sheet steel, zinc-aluminum, iron or the like alloy coated sheet steel, half-alloyed galvannealed sheet steel whose lower layer, in the cross-sectional direction of the plating layer, has been alloyed (generally called "half alloy"), differentially coated sheet steel with galvannealed layer on one side and galvanized layer on the other side, double layer coated sheet steel with zinc or zinc-rich, iron or nickel alloy electroplated, or vapor deposited upper layer on the hot-dip galvanized lower layer, electrogalvanized sheet steel, sheet steel electroplated with alloys of zinc, nickel, chrome, etc., further, single alloy layer or multi-alloy layer electroplated sheet steel, and sheet steel galvanized by vapor deposition of zinc or zinc-containing metals. Further, mention may be made of dispersion plated sheet steel having fine particles of ceramics such as $SiO_2$, $Al_2O_3$, etc., fine particles of oxides such as $TiO_2$, or organic polymers, dispersed in the zinc or zinc alloy plating layer.

The present invention intends to improve the press-formability, phosphatability and, as desired, also the weldability of such zinc-base galvanized sheet steel by coating, as described above, a plating metal adhesion preventing agent, a lubricant, etc. on the surface of the galvanized sheet steel.

Since the plating layer of zinc-base galvanized sheet steel is generally soft, the layer readily undergoes plastic deformation and fits itself to the surface roughness profile of the die, in press working, to increase the actual contact area with the die and increase the frictional force. Resultingly, the plating layer tends to be torn off and the resulting peeled off piece of the layer acts as a binder to cause the plating layer to be torned off in succession and be accumulated in the die, which may readily lead to the ultimate rupture of the material.

The surface of zinc-base galvanized sheet steel usually has a rust preventive oil applied thereto and, if desired, a press oil is applied thereto prior to press working. The function of the oil film is to form a fluid layer between the die and the plating surface, thereby to prevent the direct contact between metals. Although the above-mentioned phenomenon is reduced to a certain extent by such oil treatments, the oil film is apt to break off on the sliding face with the die and the above-mentioned problem is not overcome sufficiently.

Attempts have been made to enhance the oil film strength by using a high viscosity lubricating oil or a hot melt type solid lubricating oil, which are effective in reducing the frictional force in their own way. Such methods, however, are accompanied by such disadvantages that, in the steps of degreasing, phosphating treatment and painting subsequent to the press working, the degreasing is poorly effected, the degreasing liquid is contaminated to shorten its life, the phosphating treatment fails to form a film on the surface or the film formed by phosphating treatment is poor in corrosion preventive property.

Another known method is to apply flash plating of a hard metal, such as Fe-base alloy, onto the zinc-base plating surface. This method, by coating the soft zinc-base plating with a hard metal, functions to enhance the hardness as the composite system and thereby to decrease the actual contact area with the die. Accordingly, a thick surface layer plating of about 0.5 μm or more is necessary to exhibit a satisfactory effect, which results in a high cost.

According to the present invention, a novel film which acts through a working mechanism utterly different from those in the above-mentioned methods is formed on zinc-base galvanized sheet steel. Thus, on the surface of zinc-base plating, there are formed a film having an adhesion preventing function which is composed mainly of 1–500 $mg/m^2$ (in terms of the weight of metallic elements) of inorganic oxides and/or inorganic hydroxides and a film, which may be provided as described, having a rolling lubricating function which is composed mainly of 1–500 $mg/m^2$ (in terms of the weight of metallic elements) of oxoacids and/or inorganic oxide colloids. These films are of an amorphous structure constituted mainly of metal-oxygen bonds. When the film possesses both a structure having an adhesion preventing function and a structure having a rolling lubricating function, the two structures are present mingling with each other via oxygen bonds and cannot be separated as individual layer structures. They can only be discriminated as such functions at the time of press working.

In press working, the amorphous metal-oxygen bond structure deforms in pursuance of the newly developed surface of the deforming zinc plating layer and sticks fast to zinc via oxygen bonds, to prevent the adhesion of zinc to its die. On the other hand, part of the film is broken into the form of powders, which then exert the rolling lubricating function on the sliding face with the die. This is conceivably the reason why the film of the present invention exhibits a sticking lubricity in spite of being an extremely thin inorganic film.

Figure 3:
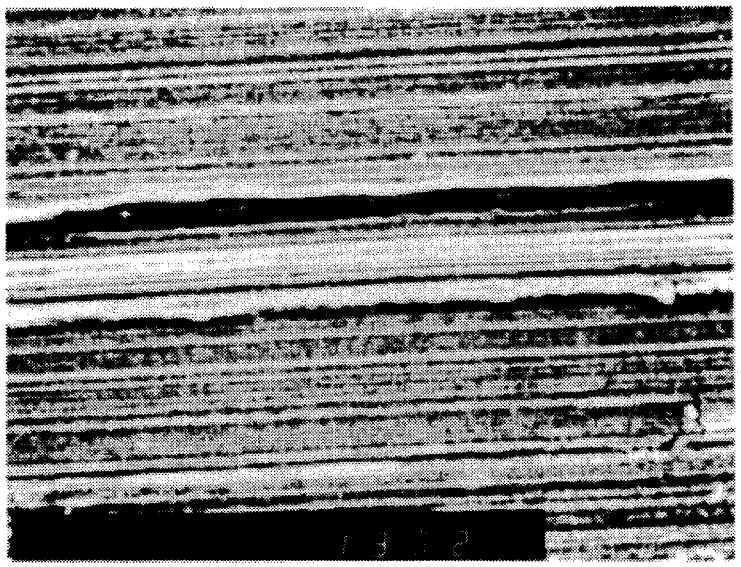
FIG. 3 is an electron photomicrograph showing the crystal structure of the surface of the sheet steel of FIG. 1 after subjected to a draw bead sliding test.
Figure 2:
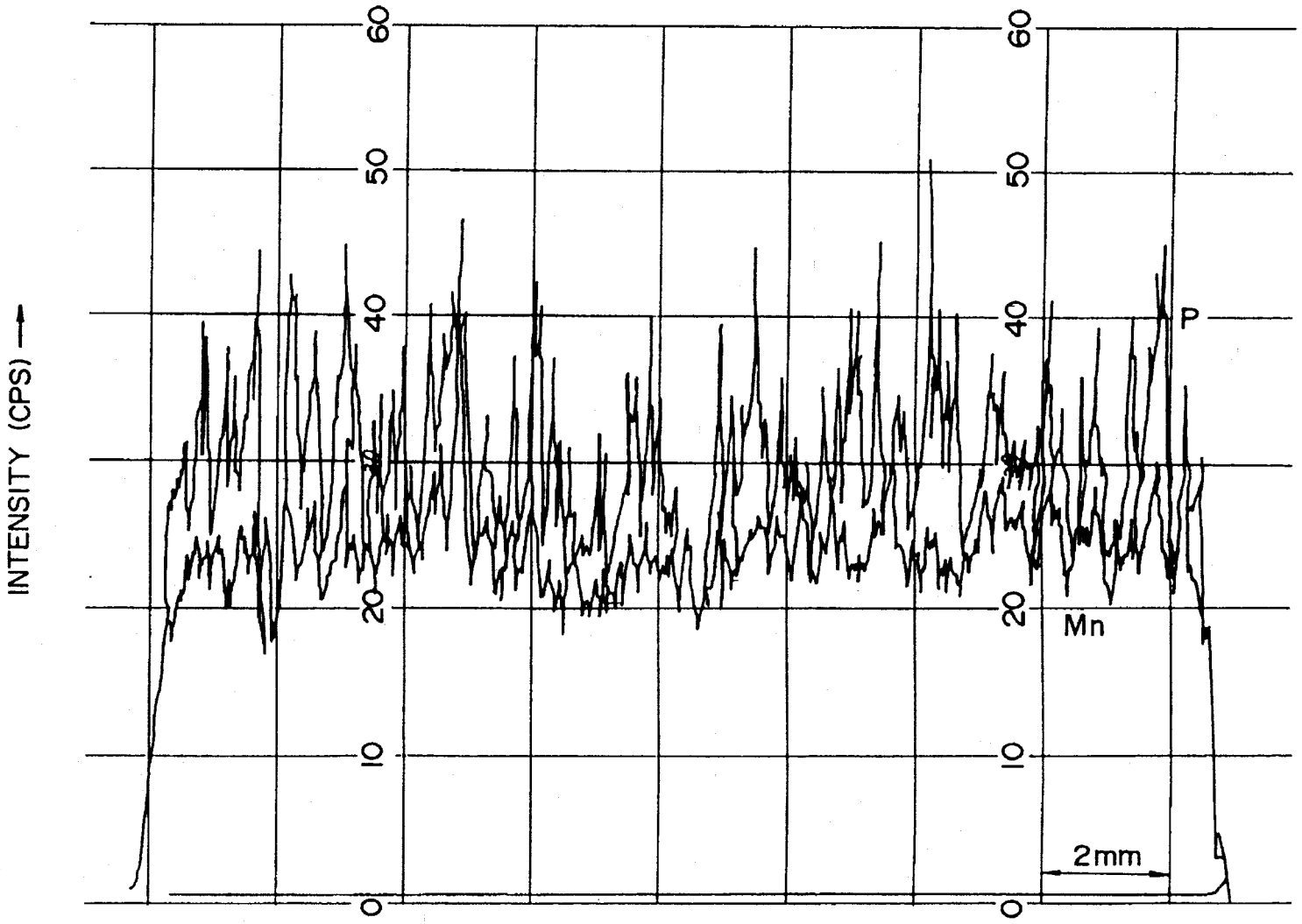
FIG. 2 is an electron probe microanalysis chart of the surface of an amorphous oxide-base film formed on the surface of an electrogalvanized sheet steel.
Figure 4:
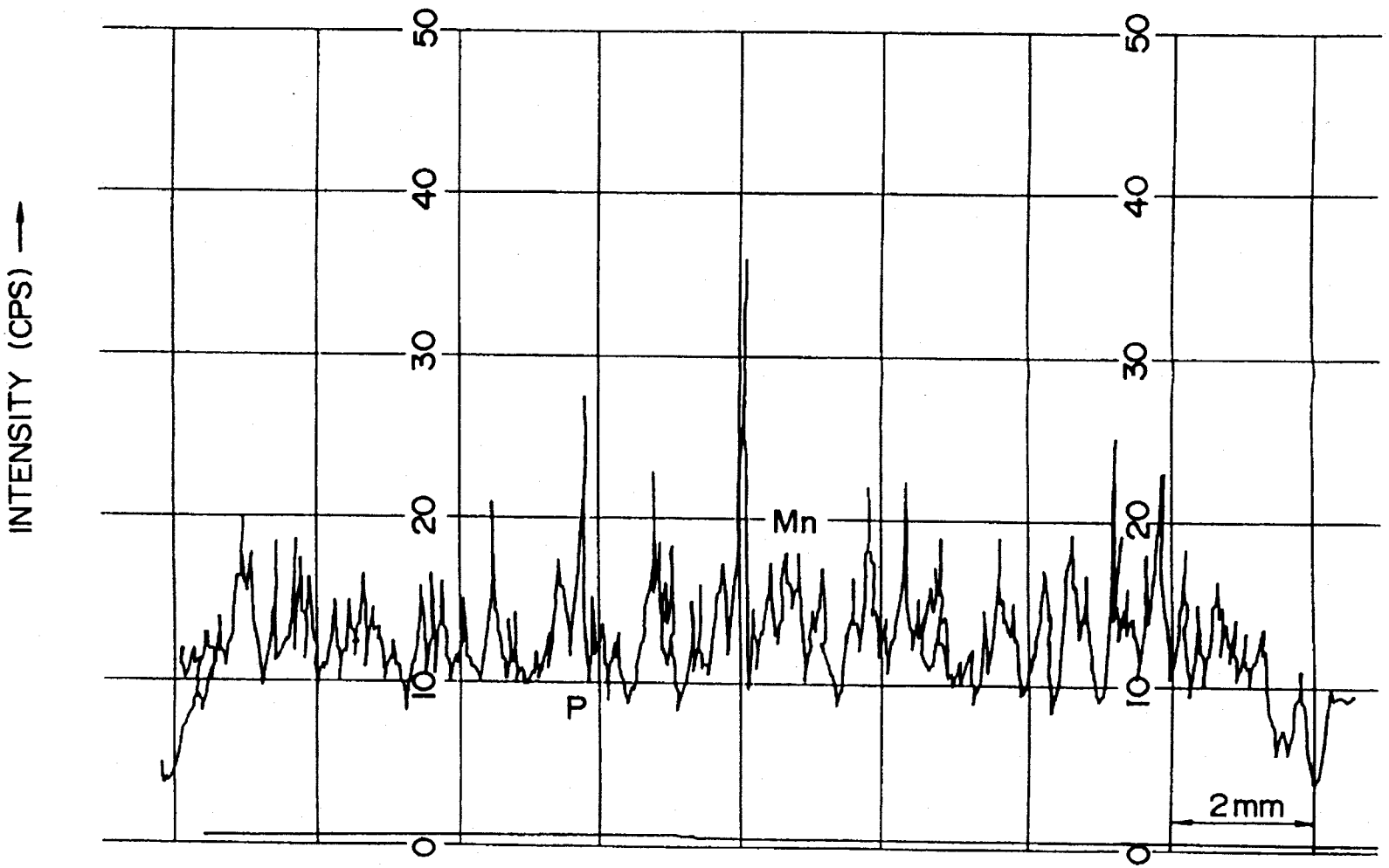
FIG. 4 is an electron probe microanalysis chart of the surface of the sheet steel shown in FIG. 3.

By way of illustration, an electron photo-micrograph of the surface of electrogalvanized sheet steel having an amorphous oxide-base film comprising 8 $mg/m^2$ of Mn and 5 $mg/m^2$ of P formed thereon is shown in FIG. 1. Only zinc plating crystals can be observed in the Figure and the thin surface film is not recognizable at all. When the surface is subjected to electron probe microanalysis, the presence of Mn and P can be confirmed as shown in FIG. 2. The surface condition of the sheet steel examined with an electron microscope after the sheet has been subjected to a draw bead sliding test is shown in FIG. 3. The zinc plating surface has been rubbed by the bead part of the die, leaving not a trace of original zinc crystals. Though the test conditions are such that the rupture of sheet would take place in an untreated electrogalvanized sheet steel, the galvanized sheet steel having the film of the present invention formed on the surface maintains a good lubricating condition, the friction coefficient being 0.17. FIG. 4 shows an electron probe microanalysis chart of the present sheet steel after subjected to a draw bead sliding test. Although the amounts of Mn and P present in the film are both lower than those before the sliding test, no rift is observed in the film and the film remains approximately uniformly. This conceivably shows that the film is reconstructed even when a new zinc surface develops as the result of sliding. With respect to the Mn/P ratio, it can be seen that P has decreased in a relatively larger extent as compared with the ratio before the sliding. It can be considered that P in the film was selectively broken into the form of powders and as such contributed to rolling lubrication.

It can be considered that in a film having an adhesion preventing function, the function comes mainly from an amorphous structure comprising mainly oxides and/or hydroxides of metals as Mn, Mo, Co, Ni, Ca, Cr, V, W, Ti, Al, Zn, etc., while, in a film having a rolling lubricating function, which may be formed as desired, the function comes mainly from a structure wherein colloids formed of oxoacids comprising P, B etc. and/or oxides of Si, Al, Ti etc., are bonded to the above-mentioned amorphous structure via oxygen bonds. However, in the film forming reaction, the constituents of the film are precipitated as a harmonious whole from an aqueous solution by making use of the pH increase at the interface, and hence the working functions cannot be discriminated strictly. Accordingly, it is more reasonable to consider that a part of the film carries the adhesion preventing function and another part carries the rolling lubricating function.

The constituents of the film mentioned above are all inorganic substances, so that no extra load is put on the degreasing liquid used after press working. Since the film constituents dissolve with decrease in pH at the time of phosphating treatment, the phosphate film can be formed in a normal manner.

The film formation can be performed with certainty by dipping zinc-base galvanized sheet steel in an acidic aqueous solution containing the continuents of film having an adhesion preventing function and the constituents of film having a rolling lubricating function, which may be provided as desired, or by subjecting the galvanized sheet steel to a cathode electrolytic treatment in the aqueous solution. In the dipping treatment, the pH of the interface increases when Zn goes into solution, and resultantly the film constituents precipitate as hydroxides or oxides. The dissolved Zn and other plating layer components also get mixed in the film. An oxidation-reduction reaction may also be used. The dissolution of Zn is an oxidation and, in correspondence thereto, metal ions of oxidized type precipitate as insoluble oxides of reduced type. Both anions of oxoacids, such as phosphoric acid etc., and oxide colloids can also be precipitated by pH increase at the interface. The cathode electrolytic treatment have the effect of promoting the pH increase at the interface. Attempts to control the interfacial reaction by regulation of water film thickness, as spraying treatment, coating treatment, etc. may also be used in the present invention.

Firstly, the first aspect of the present invention is described below.

As one embodiment of the first aspect of the present invention, mention may be made of a zinc-base galvanized sheet steel having an inorganic covering layer formed on the surface thereof, said covering layer being composed of 1–500 $mg/m^2$, in terms of the weight of metallic elements, of the oxides of at least one metallic element selected from the group consisting of Mn, Mo, Co, Ni, Ca and P.

Hereunder, description will be made with reference to Mn as the example.

In order to impart a press working lubricity to a plated sheet steel, it is effective to form a hard film on the surface of the plated sheet steel. Though the electrolytic chromate treatment and the iron-zinc alloy plating are effective in this respect, the former fails to form a phosphate film, whereas the latter requires a large amount of plating, resulting in increase in cost.

To solve such problems, it is necessary to provide a hard film, namely an oxide film, which dissolves in the phosphating liquid and can form a phosphate film and, at the same time, does not adversely affect the phosphating treatment even when the film components dissolve out into the phosphating liquid.

From such a viewpoint, the present inventors have found that the above-mentioned need can be met by forming Mn oxide film on the zinc-base galvanized sheet steel surface. The Mn oxide film, similarly to chromate film, is of a glass-like structure and, at the time of press forming, suppress the galling of plating with the die and enhances sliding property. Further, since it dissolve in the phosphating liquid, it permits formation of the phosphate film unlike the chromate film. Moreover, since Mn is one of the components of the phosphate film, no adverse effect results even when the Mn oxide film dissolves out into the phosphating liquid.

Though the structure of the Mn oxide film is not definitely clear, the present inventors estimate that it is an amorphous macromolecular structure composed mainly of a network formed of Mn—O bonds partly substituted with such groups as —OH, $CO_3$, $PO_4$, etc., and further with metals supplied from plating.

Since, the film is an oxide film it does not dissolve in the steps of washing with oil and oil removing, so that it neither undergoes lowering of the lubricating property due to these steps nor adversely affects other process steps.

The adhesive property and the film forming property of the present film can be effectively improved by addition of inorganic acids such as phosphoric acid, boric acid, sulfuric acid, nitric acid, hydrochloric acid, etc., and the salts thereof.

The present film may contain as impurities substances contained in the treating bath and the plating. Such impurities may be Zn, Al, Cr, Co, Ni, Pb, Sn, Cu, Ti, Si, B, N, S, P, Cl, K, Na, Mg, Ca, Ba, In, C, Fe, V, W, Mo, etc.

Now, description will be given of the range of the amount of the film of the present invention.

The amount of the present film must be at least 5 mg/m$^2$ in terms of Mn to attain a good press-formability, but when the film amount exceeds 500 mg/m$^2$ it cause insufficient film formation in the phosphating treatment. An appropriate film amount, therefore, is not less than 5 mg/m$^2$ and not more than 500 mg/m$^2$ in terms of Mn.

Exactly the same applies in the cases of Mo, Co, Ni and Ca as in the case of Mn. When the film is formed by using P oxides the film must contain 1 mg/m$^2$ or more (in terms of P) of P oxides, but when the film amount exceeds 500 mg/m$^2$ the film becomes crystalline, resulting in decreased lubricity and lowered press-formability and causing insufficient film formation in the phosphating treatment. An appropriate film amount, therefore, is not less than 1 mg/m$^2$ and not more than 500 mg/m$^2$, preferably not more than 200 mg/m$^2$.

By forming such films in such amounts, it is recognized that the lubricity is enhanced and the press-formability is improved.

Thus, the press-formability and the phosphatability are improved by forming a P oxide film on zinc-base galvanized sheet steel simultaneously.

Such oxide film may be prepared, for example, by dipping the galvanized sheet steel in an aqueous solution of pH 2-6 containing 5–60 g/l of sodium phosphate, by an electrolytic treatment in said aqueous solution with the galvanized sheet steel used as the cathode or the anode, or by spraying said aqueous solution onto the galvanized sheet steel.

The adhesive property, etc. of the oxide film can be favorably improved by adding to said aqueous solution 1–10 g/l of at least one etching agent, for example, sulfuric acid, nitric acid, perchloric acid, phosphoric acid, etc.

When an oxide film is thus formed on the galvanized sheet steel surface, part of the plating layer and of the alloy metals in the plating layer get mixed into the oxide film as other oxides.

In this case, boric acid may also be present together. The range of film amount for such a case is described below.

The amount of the oxide film must be at least 1 mg/m$^2$ in terms of P to attain a good press-formability, but when the film amount exceeds 500 mg/m$^2$ it causes insufficient film formation in the phosphating treatment. An appropriate film amount of P oxide, therefore, is not less than 1 mg/m$^2$ and not more than 500 mg/m$^2$, preferably 1–200 mg/m$^2$, in terms of P.

The film amount of boron oxide is preferably 1,000 mg/m$^2$ or less, more preferably 200 mg/m$^2$ or less, in terms of boron. When the amount exceeds 1,000 mg/m$^2$ it may deteriorate the phosphatability. The lower limit of the amount is not critical, as far as it exists.

When boric acid is incorporated into the above-mentioned oxide film, the film must be formed such that the total amount of boric acid and phosphoric acid is not more than 1,000 mg/m$^2$ in terms of P and boron. An amount exceeding 1,000 mg/m$^2$ is not preferable because it may deteriorate the phosphatability. The lower limit is 1 mg/m$^2$. Preferably, the total amount is 200 mg/m$^2$ or less.

The oxide film as mentioned above can be formed with certainty, for example, by dipping the above-mentioned zinc-base galvanized sheet steel in an aqueous solution of pH 2-6 containing 1–60 g/l of sodium phosphate, 1–60 g/l of sodium borate, and an etching aid agent such as sulfuric acid, by spraying the aqueous solution onto the sheet steel, or by an electrolytic treatment in the aqueous solution with the sheet steel used as the cathode or the anode.

When the oxide film is thus formed, part of the plating layer and of the alloy metals in the plating layer get mixed into the oxide film as other oxides.

Although the structure of the film formed of P oxide, or P oxide and boric acid, is not definitely clear, it can be estimated that it is an amorphous macromolecular structure composed mainly of a network formed of P—O bonds and B—O bonds partly substituted with such groups as —OH, $CO_3$, etc. and further with metals supplied from plating.

When Mn oxide is used, if necessary and desired, phosphoric acid and/or boric acid and, as occasion demands, further at least one oxide selected from the group consisting of Mo oxide, W oxide and V oxide may be used in addition to Mn oxide, in a total amount of 1,000 mg/m$^2$ or less (respectively in terms of the weight of metals) to form a film.

When phosphoric acid alone is used together, the amount thereof to be incorporated is not more than 1,000 mg/m$^2$ (exclusive of 0). At such amounts, the film property of Mn oxide is improved. An amount larger than 1000 mg/m$^2$ is unfavorable since it may deteriorate the phosphatability. The lower limit of the amount is not critical. The amount is preferably 200 mg/m$^2$ or less.

In the case of boric acid, too, the amount thereof to be incorporated is not more than 1,000 mg/m$^2$, preferably not more than 200 mg/m$^2$, in terms of boron An amount larger than 1,000 mg/m$^2$ is unfavorable since it may deteriorate the phosphatability. The lower limit of the amount is not critical.

When both boric acid and phosphoric acid are incorporated, the film is formed such that the total amount of boric acid and phosphoric acid is not more than 1,000 mg/m$^2$ (in terms of P and boron). An amount larger than 1000 mg/m$^2$ is unfavorable because it may deteriorate the phosphatability. The lower limit of the amount is not critical, but a preferable total amount is not more than 200 mg/m$^2$.

When phosphoric acid and at least one oxide selected from Mo oxide, W oxide and V oxide are used, the amount (when two or more thereof is used, the total amount; the same applies hereinafter) is preferably 1,000 mg/m$^2$ or less more preferably 200 mg/m$^2$ or less, in terms of P, Mo, W and V, respectively. An amount larger than 1,000 mg/m$^2$ is unfavorable because it may deteriorate the phosphatability. The lower limit of the amount is not critical.

The aqueous solution used in forming the oxide film described above may contain, for example, from 1 g/l to the solubility limit of potassium permanganate, 1–60 g/l of phosphoric acid and 1–60 g/l of at least one compound selected, as described, from molybdic acid, tungstic acid, vanadic acid, and the salts thereof. The solution may further contain an etching aid agent, such as sulfuric acid etc.

The desired oxide film can be formed with certainty by dipping the above-mentioned zinc-base galvanized sheet steel in such an aqueous solution, by spraying the aqueous solution onto the galvanized sheet steel, or by an electrolytic treatment in the aqueous solution with the sheet steel used as the cathode or the anode.

Nextly, description will be given below of a case wherein an inorganic covering layer having both an adhesion preventing function and a rolling lubricating function is provided by incorporating an oxoacid or the like into the above-mentioned inorganic covering layer.

The film amount of the inorganic covering layer having both an adhesion preventing function and a rolling lubricating function is suitably 2–1,000 mg/m$^2$ when the above-mentioned inorganic compounds including metals are calculated in terms of the weight of metallic elements. When the amount is less than 2 mg/m$^2$ a distinct lubricating effect cannot be recognized, whereas when the amount exceeds 1,000 mg/m$^2$, it gives rise to a risk for the film to peel off in the form of lumps and further it may adversely affect the film formation in the phosphating treatment. In another embodiment for forming a covering layer having both an adhesion preventing function and a rolling lubricating function, wherein an amorphous structure film composed mainly of metal oxides and/or hydroxides and an oxoacid and/or metal oxide colloid film are formed, the film amounts of the two films are both suitably 1–500 mg/m$^2$ in terms of metallic elements, respectively. When the respective amounts are both less than 1 mg/m$^2$ no distinct lubricating effect is recognizable, whereas when the respective amounts are both larger than 500 mg/m$^2$ there appears a risk for the films to peel off in the form of lumps and further the film formation in the phosphating treatment may be adversely affected.

When the amorphous structure film composed mainly of metal oxides and/or hydroxides and the oxoacid and/or metal oxide colloid film are deposited by an interfacial chemical reaction as in the dipping method or the cathode electrolytic treatment mentioned above, the films are in general formed as a mixed film. However, it is also possible to form the film with gradient functions such that the adhesion preventing function is stronger at the interface with zinc plating and the rolling lubricating function is stronger at the surface of the film. In this manner, though no marked effect is observed in the lubricating property indicated by friction coefficient, an effect is obtained of increasing the critical face pressure, at which galling taken place when a high face pressure is applied to the local part of galvanized sheet steel as in press-forming a hardly processable part. Thus, the so-called press forming load range can be selected widely, which makes the die design easy and the press operation stable in practice. This is of great advantage.

Figure 5:
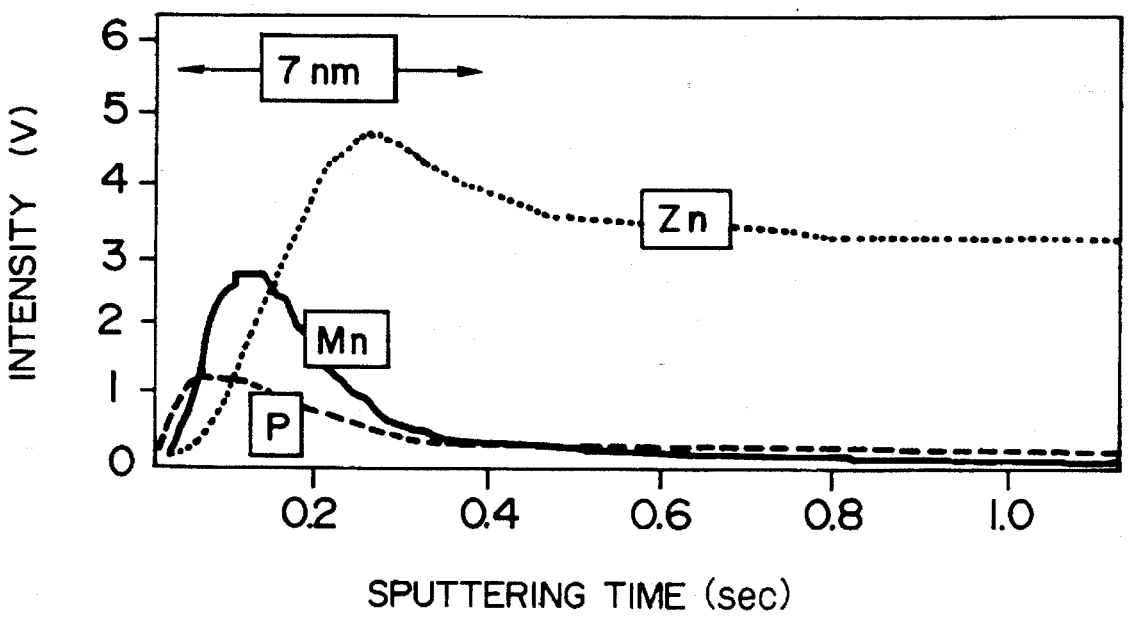
FIG. 5 is a diagram illustrating the result of glow discharge spectroscopic analysis, in the thickness direction, of an amorphous oxide-base film formed in a gradient function type on the surface of an electrogalvanized sheet steel.

The method for forming a gradient function type film comprises, by making use of the difference in solubility products of the metal oxides, etc., controlling the ion concentrations at the interface by regulating the ion concentrations of respective components, flow rate, solution temperature and, in the case of electrolytic treatment, the current density, etc. In the case of Mn- and P-containing films, for example, when the treating solution is incorporated with potassium permanganate, phosphoric acid, and sulfuric acid and then made to react with galvanized sheet steel, firstly, as Zn dissolves out, Mn oxide having the smallest solubility product will precipitate. The pH at the interface at this time does not rise rapidly owing to the presence of sulfuric acid, and nextly Mn phosphate and/or Zn phosphate will precipitate with delay. The film thus formed was analyzed in the thickness direction by glow discharge spectroscopy and the result is shown in FIG. 5. It can be seen that a gradient function type film was formed wherein the surface layer is rich in P and the lower layer is rich in Mn. The Figure shows a spectroscopic analysis chart in the thickness direction of an amorphous oxide-base film of total content of Mn of 8 mg/m$^2$ and P of 5 mg/m$^2$ formed with gradient functions on electrogalvanized sheet steel. The portion of the chart corresponding to a film thickness of 7 nm or more and a sputtering time of about 4 seconds or more represents the zinc plating layer.

The desired oxide-base film as described above can be formed, for example, by dipping the above-mentioned zinc-base galvanized sheet steel in an aqueous solution containing 50–800 g/l, respectively, of calcium nitrate, nickel nitrate, cobalt nitrate and ammonium molybdate, 5–60 g/l of phosphoric acid and further an etching auxiliary (such as sulfuric acid, etc.), by spraying the aqueous solution onto the galvanized sheet steel, or by an electrolytic treatment in the aqueous solution with the sheet steel used as the cathode.

The above-mentioned acidic aqueous solution may further contain at least one zinc dissolution promoting agent selected from the $NO_3^-$ion, $NO_2^-$ion, $ClO_3^-$ion, $F^-$ion and $H_2O_2$.

Said layer may be formed by contacting zinc-base galvanized sheet steel with an acidic aqueous solution of a pH of 5 or less which contains ions of at least one metal selected from Mn, Mo, Co, Ni, Ca, Cr, V, W, Ti, Al and Zn and further contains at least one oxide colloid of an element selected from Si, Al and Ti, or by subjecting the sheet steel to a cathode electrolysis in said solution.

According to the process of the present invention, a novel film which works through a working mechanism utterly different from those in the previous processes is formed on zinc-base galvanized sheet steel. That is, on the surface of zinc-base plating are formed a film composed mainly of 1–500 mg/m$^2$ (in terms of metallic elements) of inorganic oxide and/or inorganic hydroxides and having an adhesion preventing function and, if necessary and desired, a film composed mainly of 1–500 mg/m$^2$ (in terms of metallic elements) of oxoacid and/or metal oxide colloids and having a rolling lubricating function.

The film which has been imparted the two functions mentioned above has an amorphous structure composed mainly of metal-oxygen bonds, wherein the film structure having the adhesion preventing function and the film structure having the rolling lubricating function are present mingling with each other via oxygen bonds and cannot be separated as individual layer structures. They can only be discriminated as such functions at the time of press working.

The second aspect of the present invention, that is, a process for producing a galvanized sheet steel excellent in press-formability and phosphatability will be described below.

Thus, the second aspect of the present invention relates to a process for producing a zinc-base galvanized sheet steel excellent in press-formability and phosphatability which comprises forming on the plating layer surface 2–1,000 mg/m$^2$ (in terms of metallic elements) of an inorganic covering layer having an adhesion preventing function, through which the covering layer sticks fast to the plating layer surface and maintains covering in pursuance of its deformation at the time of press working, together with a rolling lubricating function that works between the die and the plating layer, by contacting the galvanized sheet steel with an acidic aqueous solution of a pH of 5 or less which contains ions of at least one metal selected from Mn, Mo, Co, Ni, Ca, Cr, V, W, Ti, Al and Zn and/or phosphate ions and, if necessary and desired, further contains one or two oxoacids of P and/or B, or by subjecting the sheet steel to a cathode electrolysis in said acidic aqueous solution.

In practicing the above-mentioned process, a more favorable result is obtained when the covering layer is formed with a function gradient such that the adhesion preventing function is stronger at the interface with the plating layer and the rolling lubricating function is stronger at the covering layer surface.

In press working, the amorphous metal-oxygen bond structure deforms in pursuance of the newly developed surface of the deforming zinc plating layer and sticks fast to zinc via oxygen bonds to prevent the adhesion of zinc to the die. On the other hand, part of the film is broken into the form of powders, which then exert the rolling lubricating function on the sliding face with the die. This is conceivably the reason why the film of the present invention exhibits a striking lubricity in spite of being an extremely thin inorganic film.

As described before, in the case of an electrogalvanized sheet steel having an amorphous oxide-base film comprising 8 mg/m$^2$ of Mn and 5 mg/m$^2$ of P formed thereon, only zinc plating crystals can be observed and the thin surface film cannot be seen at all, as is apparent from FIG. 1. When the surface is subjected to electron probe microanalysis, the presence of Mn and P can be confirmed as shown in FIG. 2. From FIG. 3, which shows the surface condition examined with an electron microscope after the surface has been subjected to a draw bead sliding test, it will be apparent that the zinc plating surface has been rubbed by the bead part of the die, leaving not a trace of original zinc crystals. Although the test conditions are such that the rupture of sheet would take place in an untreated electrogalvanized sheet steel, the galvanized sheet steel having the film of the present invention formed on the surface maintains a good lubricating condition, the friction coefficient being 0.17. From FIG. 4, which shows an electron probe microanalysis chart of the present sheet steel after subjected to a draw bead sliding test, it will be apparent that although the amounts of Mn and P present in the film are both lower than those before the sliding test, no rift is observed in the film and the film remains approximately uniformly. This conceivably shows that the film is reconstructed even when a new zinc surface develops as the result of sliding. With respect to the Mn/P ratio, it can be seen that P has decreased to a relatively larger extent as compared with the ratio before the sliding. It can be considered that P in the film was selectively broken into the form of powders and as such contributed to rolling lubrication.

It can be considered that in a film having an adhesion preventing function, the function comes mainly from an amorphous structure comprising mainly oxides and/or hydroxides of metals such as Mn, Mo, Co, Ni, Ca, Cr, V, W, Ti, Al, Zn, etc., while, in a film having a rolling lubricating function, the function comes mainly from a structure wherein colloids formed of oxoacids comprising P, B etc. and/or oxides comprising Si, Al, Ti etc. are bonded to the above-mentioned amorphous structure via oxygen bonds. However, in the film forming reaction, the constituents of the film are precipitated as a harmonious whole from an aqueous solution by making use of the pH increase at the interface, and hence the working function cannot be discriminated structly. Accordingly, it is more reasonable to consider that a part of the film carries the adhesion preventing function and another part carries the rolling lubricating function.

The constituents of the film mentioned above are all inorganic substances, so that no extra load is put on the degreasing liquid used after press working. Since the constituents dissolve with decrease in pH at the time of phosphating treatment, the phosphate film can be formed in a normal manner.

The film formation can be performed with certainty by dipping zinc-base galvanized sheet steel in an acidic aqueous solution of a pH of 5 or less that contains ions of at least one metal selected from Mn, Mo, Co, Ni, Ca, Cr, V, W, Ti, Al and Zn, which are to become the constituents of film having an adhesion preventing function, and contains oxoacids of P and/or B, which are to become the constituents of film having a rolling lubricating function, or by a cathode electrolytic treatment of the galvanized sheet steel in said aqueous solution. As to metallic ions, Mn is vatted to industrial advantage in the form of permanganate ($MnO_4^-$), which also offers the advantage of promoting the dissolution of zinc by making use of the oxidizing power of $MnO_4^-$ ions, MO, W and V may be vatted stably in the form of molybdate ($MoO_4^{-2}$), tungstate ($WO_4^{-2}$) and vanadate ($VO_4^{-3}$), respectively, or the poly salts thereof. Cr is preferably used as $Cr^{3+}$. Cr, Ti and Al can be dissolved in an acidic medium of a pH of 2 or less. These metal ions can be used in concentrations from 1 g/l to their solubility limits. The oxoacids of P and B are used respectively in the form of phosphoric acid and boric acid, or the salts thereof. The pH of the solution is preferably 5 or less. When it exceeds 5, the reaction does not proceed practically. Though the pH of the solution may be adjusted also with phosphoric acid or boric acid, it is advantageous as the means for controlling the film amount and the film constituent ratio independently from each other to regulate the pH by adding an acid which does not partipitate in film formation, for example, sulfuric acid, hydrochloric acid, nitric acid, acetic acid, perchloric acid, etc.

As another mode of film formation, it is also possible to dip zinc-base galvanized sheet steel in an acidic aqueous solution of a pH of 5 or less that contains ions of at least one metal selected from Mn, Mo, Co, Ni, Ca, Cr, V, W, Ti, Al and Zn, which are to become the constituents of film having an adhesion preventing function, and contains, as desired, colloids of the oxide of at least one element selected from Si, Al and Ti, which are to become the constituents of film having a rolling lubricating function, or to subject the sheet steel to cathode electrolytic treatment in the aqueous solution. As such oxide colloids, $SiO_2$, $Al_2O_3$ or $TiO_2$ colloids having a particle diameter of 0.1 μm or less are added to the acidic aqueous solution, whereby they are dispersed stably owing to the electrostatic force of the $OH^{31}$ group present on the surface. The total concentration of the oxide colloids is preferably 60 g/l or less. The pH of the solution may be adjusted, besides with phosphoric acid and boric acid, also with sulfuric acid, hydrochloric acid, nitric acid, acetic acid, perchloric acid, etc.

In the dipping, at the time of the dissolution of Zn, the pH at the interface increases and resultantly the metal ions change into hydroxides or oxides and precipitate. When the oxoacids of P and B are present, they are taken into the amorphous network of metal-oxygen bonds via oxygen bonds. The oxide colloids also precipitate as the pH increases and enter the network of oxygen bonds. The oxide colloids act as the rolling lubricating function type, one reason for which can be estimated that the colloids distribute themselves in the form of clusters in the film. Dissolved zinc and other plating layer components also get mixed in the film. An oxidation-reduction reaction may also be used. The dissolution of Zn is an oxidation and, in correspondence thereto, metal ions of oxidizied type precipitate as insoluble oxides of reduced type. Permanganate salts mentioned above represent one of such examples.

The film forming reaction is of a self passivation type; that is, when all the surface of zinc-base plating has been covered, the reaction reaches completion automatically. The treating time necessary to completion of the covering is as short as 0.1 second for fast reactions, and generally a time of 1 minute or less is sufficient. The treatment can be easily performed at a treating liquid temperature of room temperature to 80° C. The film amount can be controlled with the amount of undercoat zinc dissolved, because if the dissolution of zinc is regarded as an anodic reaction, the deposition of film is a corresponding cathodic. Therefore, increase in the free acid concentration, in other words decrease in pH, will increase the amount of film. It is also effective in controlling the film amount to regulate the thickness of water film furnished to the zinc-base galvanized sheet steel surface and thereby to promote the increase of pH by spraying treatment, coating treatment, etc.

Cathode electrolytic treatment has an effect of promoting the pH increase at the interface and increasing the film amount. An applied current density of 10 $A/dm^2$ or less is sufficient. A current density exceeding 10 $A/dm^2$ is unfavorable because it promotes the deposition of metals to deteriorate the lubricating property or gives a film amount exceeding 1,000 $mg/m^2$ even in a short time of treatment.

It is also effective in controlling the film amount to add to the above-mentioned treating liquid a dissolution promoting agent for zinc-base undercoat plating. As the dissolution promoting agent, there may be used one, or two or more, of the $NO_3^-$ ion, $NO_2^-$ ion, $ClO^-$ ion, $F^-$ ion and $H_2O_2$. The amount of these dissolution promoting agents to be added is 10 g/l or less.

The zinc base galvanized sheet steel is subjected to a contacting treatment with the treating liquid as dipping, spraying, coating, etc. or to a cathodically electrolytic treatment, then washed with water and dried; if necessary, it is coated with a rust preventive oil to prepare for subsequent working steps.

The amount of film having an adhesion preventing function together with a rolling lubricating function is suitably 2–1,000 $mg/m^2$ in terms of metals. When the amount is less than 2 $mg/m^2$ a distinct lubricating effect is not recognizable, whereas when it is larger than 1,000 $mg/m^2$ it gives rise to a risk for the film to peel off in the form of lumps and further it may adversely affect the film formation in the phosphating treatment. In one mode of forming a covering layer having an adhesion preventing function together with a rolling lubricating function wherein an amorphous structure film composed mainly of metal oxides and/or hydroxides and an oxoacid and/or metal oxide colloid film are formed, the amounts of two films are both suitably 1–500 $mg/m^2$ in terms of metals. At an amount less than 1 $mg/m^2$ no distinct lubricating effect is recognizable, whereas at an amount larger than 500 $mg/m^2$ there arises a risk for the film to peel off in the form of lumps and further the film formation in the phosphating treatment may be adversely affected.

When the amorphous structure film composed mainly of metal oxides and/or hydroxides and the oxoacid and/or metal oxide colloid film are deposited by an interfacial chemical reaction as in the dipping method or in the cathodically electrolytic treatment mentioned above, the films are in general formed as a mixed film. However, it is also possible to form the film with function gradient such that the adhesion preventing function is stronger at the interface with zinc plating and the rolling lubricating function is stronger at the surface of the film. In this manner, though no marked effect is observed in the lubricating property indicated by frictional coefficient, an effect is obtained of increasing the critical face pressure, at which galling takes place when a high face pressure is applied locally to galvanized sheet steel as in press forming a hardly processable part. Thus, the so-called press forming load range can be selected widely, which makes the die design easy and the press operation stable in practice. This is of great advantage.

The method for forming a gradient function-type film comprises, by making use of the difference in solubility products of the metal oxide, etc., controlling the ion concentrations at the interface by regulating the ion concentrations of respective components, flow rate, solution temperature and, in the case of electrolytic treatment, the current density, etc. A particularly effective method is to use a solution composition wherein the total molar concentration of oxoacids is higher than that of metal ions. Thus, in a film deposition reaction, the deposition takes place successively, in principle, with the precipitate having the smallest solubility product deposited preferentially as the pH at the interface increases; but, actually, since the reaction is generally rapid, the film tends to deposit as a mixed film. In the above-mentioned method, however, use is made, after the film formation, of a substitution precipitation reaction which takes place accompanying the redissolution reaction caused by acids. When the total molar concentration of oxoacids is higher than that of metal ions at the interface after the film formation, the metal oxides and/or hydroxides dissolve and are substituted with oxoacids of P, B, etc.

The third aspect and the fourth aspect of the present invention, that is, a zinc-base galvanized sheet steel excellent in weldability, press-formability and phosphatability and a process for producing such sheet steel are described below.

The zinc-base galvanized sheet steel excellent in weldability, press-formability, and phosphatability according to the present invention refers to a zinc-base galvanized sheet steel which comprises zinc-base plated sheet steel, a film composed of 30–3,000 $mg/m^2$ of Zn oxide formed on the surface of the plating layer of said sheet steel and further, as the upper layer, either an inorganic covering layer containing at least 1–500 $mg/m^2$ (in terms of the weight of metallic elements) of inorganic oxides as metal oxides, etc. or an inorganic covering layer containing 3–500 $mg/m^2$ of Zn oxide together with 5–500 $mg/m^2$ of Mn oxide (respectively in terms of the weight of metallic element) and, if necessary and desired, further containing 1,000 $mg/m^2$ or less (in terms of the weight of elements) of oxides of P, B etc., respectively formed on said film.

The process for producing said sheet steel comprises forming zinc oxide on the surface of zinc-base galvanized sheet steel, and then contacting the resulting surface with an acidic aqueous solution of a pH of 5 or less containing at least one member selected from the group consisting of ions of metals including Mn, Mo, Co, Ni, Ca, V, W, Ti and Al and oxoacids containing P and B, or subjecting it to a cathodic electrolysis in said aqueous solution, thereby forming a film containing said constituents on the zinc oxide layer.

The third and the fourth aspects are collectively described in detail below.

First, description is given of the case wherein Zn oxide and Mn oxide are used in combination.

As described above, the present inventors have found that a satisfactory result can be obtained by forming Mn oxide film or the zinc-base galvanized sheet steel surface. The Mn oxide film, simularly to chromate film, is of a glass-like structure and, at the time of press working, suppress the galling of the plating with the die and enhances sliding property. Further, since it dissolves in the phosphating liquid, it can form the phosphate film unlike the chromate film. Moreover, it exerts no adverse effect on phosphating treatment even when it dissolves out into the conversion treating liquid.

Although Zn oxide by itself can hardly give a press sliding property-improved film in a wet method, the present inventors have found that when Zn oxide is in the form of mixed crystal with Mn oxide, the press sliding property can be markedly improved and at the same time the weldability can be also improved. Of course, Zn oxide also permits the film formation in the phosphating treatment and exerts no adverse effect even when it dissolves out into the conversion treating liquid.

Though the structure of the oxides of Mn, Zn and the like is not definitely clear, it can be estimated that it is an amorphous macromolecular structure composed mainly of a network formed of Mn—O, Zn—O and, as occasion demands, P—O and B—O bonds, and partly bonded with such groups as —OH, $CO_3$, etc. and, further, substituted with metals supplied from the plating.

Since the film is an oxide film, it does not dissolve in the steps of washing with oil and degreasing, so that it neither undergoes lowering of the lubricating property due to such steps, nor adversely affects the other process steps.

The adhesive property and the film forming property of the present film can be effectively improved by addition of inorganic acids such as phosphoric acid, boric acid, sulfuric acid, nitric acid, hydrochloric acid, etc., and the salts thereof.

The present film may contain as impurities substances contained in the treating bath and the plating. Such impurities may be Zn, Al, Cr, Co, Mn, Pb, Sn, Cu, Ti, Si, B, N, S, P, Cl, K, Na, Mg, Ca, Ba, In, C, Fe, V, W, Ni, etc.

Hereunder, description is given of the range of film amount of the present invention.

The amount of the present film must be at least 5 mg/m$^2$ of Mn oxide (in terms of Mn), but when the film amount is larger than 500 mg/m$^2$ it may cause insufficient film formation in the phosphating treatment.

An appropriate film amount, therefore, is not less than 5 mg/m$^2$ and not more than 500 mg/m$^2$ in terms of Mn.

To improve the adhesive property, film forming property, etc. of such films, phosphoric acid and/or boric acid may also be incorporated in the film. In this way, it is recognized that the Mn-base oxide film structure becomes more uniform, the film forming property is improved, the lubricity is improved to enhance the press-formability, and the phosphatability is also improved.

Such oxide film can be prepared, for example, by dipping zinc-base galvanized sheet steel in an aqueous solution containing 1–70 g/l of potassium permanganate, 5–60 g/l of phosphoric acid or boric acid (when the two acids are used together, respectively 5–60 g/l) and 100–800 g/l of zinc nitrate, by subjecting the galvanized sheet steel to a cathode electrolytic treatment in said aqueous solution, or by spraying the aqueous solution onto the galvanized sheet steel, whereby Mn oxide, phosphoric acid and Zn oxide are formed simultaneously.

When the oxide film is formed on the plated sheet steel in the above-mentioned manner, the plating layer and the alloy metals, etc. in the plating layer get mixed into the oxide film as other oxides. The amount of phosphoric acid and/or boric acid in the oxide film is preferably not more than 1,000 mg/m$^2$ (in terms of P and/or B) An amount larger than 1,000 mg/m$^2$ is unpreferable because it may deteriorate the phosphatability. The lower limit is not critical so long as phosphoric acid is contained.

An etching agent, for example, at least one of sulfuric acid, nitric acid, perchloric acid, etc. is preferably added to the above-mentioned aqueous solution in an amount of 1–10 g/l to improve the adhesive property, etc. of the film.

In the present invention, as described above, Zn oxide is further incorporated in the film to improve the weldability. The amount of such oxide film to be formed is such that the Zn amount in the oxide film is 3–500 mg/m$^2$ per one side. When the amount is less than 3 mg/m$^2$no distinct effect is obtained, whereas when it is larger than 500 mg/m$^2$, the electric resistance increases and the electrode tip tends to soften and deform, resulting in a short tip life. Thus, in welding, etc., the plating metal fuses due to the heat of welding, and then alloying of the metal with sheet steel proceeds. If the plating metal in the fused state contacts directly with the electrode tip, copper of the tip constituent and zinc of the plating constituent react selectively to form a hard and brittle copper-zinc alloy layer, resulting in the wear of the tip and in a short life of electrode tip.

The plating metal in the fused state is prevented, by the oxide film formed on the galvanized sheet steel surface mentioned above, from contacting with the tip, whereby the melt damage, etc. due to the direct contact of the plating metal with the tip can be avoided; further, the plating metal in the fused state alloys itself with the iron of sheet steel mainly to form ironzinc alloy, which sticks to the head of the electrode tip through cracks etc. in the oxide film or together with the oxide film, and deposits there to form a protective metal film for the tip; though the reason is not yet clear, the protective film does not change its thickness, shape, etc. through continued welding, thus ensuring a good welding at all times and preventing the damage of the tip. The electrode protecting metal referred to herein comprises mainly an alloy of the plating metal with base iron and usually contains, as average concentration, about 20–60% of Fe and about 40–80% of Zn. Alloys of higher Fe concentration are preferable in general. In particular, the presence of local part of high Zn concentration is unpreferable. The electrode protecting metal may sometimes contain plating metal components, sheet steel components such as Mn and S, and electrode tip components such as Cu.

The electrode protecting metal film has an effect of keeping the tip head in a convex form, so that its presence permits welding to be performed at a lower electric current at the same degree of softening and damage of the tip. When the tip protecting film is attached to the tip head surface to occupy 50% or more of the surface area, the electrode tip life can be greatly extended. Thus, an oxide film comprising mainly ZnO, which acts to attach an electrode protecting metal, is formed on the zinc metal surface, and welding is performed while the alloy of the plating metal with the sheet steel formed by the heat of welding is being attached to the electrode tip through the above-mentioned oxide film or together with the oxide film, to form said electrode protecting metal.

The same weldability improving effect is observed also when the film is formed compositely with Mn oxide and Zn oxide, as that obtainable with Zn oxide mentioned above. This is presumably because Mn—Zn composite oxide has an electric resistance not so much increased.

Phosphoric acid does not adversely affect the weldability when the content is 1,000 mg/m$^2$ or less in terms of P.

Thus, the press-formability and the weldability of zinc-base galvanized sheet steel can both be improved and also the phosphating treatment can be performed with a satisfactory result when a film comprising mainly the oxides of Mn and Zn and, as desired, P and/or B is formed on the galvanized sheet steel.

Then, the formation of ZnO film at a rate of 30–3,000 mg/m$^2$ is described below.

Rust preventive sheet steel is generally in the form of both side plated, single side plated or differentially plated sheet steel, one and the other sides of the last one being coated with platings different from each other.

The present inventors have found that regardless of the kinds of galvanized sheet steel, so long as the plating comprises mainly Zn, an electrode protective metal layer comprising mainly Fe and Zn can be formed at the electrode tip head in spot welding and thereby the electrode tip life can be greatly improved, by forming a ZnO film on the plated sheet steel.

In the plated sheet steel of the prior art mentioned above, it has been difficult to form an oxide film comprising mainly ZnO in a ZnO amount of 30–3,000 mg/m$^2$ (per one side), which is the amount regarded to be effective in obtaining good weldability, in a stable manner. The oxide film comprising mainly Zn oxide referred to herein may contain in the oxides, besides ZnO, for example the constituent elements contained in the plating layer and such compounds as the oxides thereof. Also it may take in, in an electrochemical treatment such as anodization, the constituents contained in the treating liquid or the compounds thereof.

The present inventors have found that by contacting galvanized sheet steel with an acid-containing aqueous oxidizing agent solution as the first method for forming an oxide film comprising mainly ZnO, the oxide film comprising mainly ZnO can be easily formed in a Zn amount of 30–3,000 mg/m$^2$ (per one side) and a zinc-base galvanized sheet steel excellent in weldability can be provided thereby. The acid acts to dissolve the plating layer surface to some extent, to furnish ions of Zn etc. from the plating layer, and to elevate the pH of the solution contacting the plating layer. The oxidizing agent acts to oxidize Zn etc. in the bath at the plating layer surface to form an oxide film comprising mainly ZnO on the plating layer surface.

Incorporation of an oxidizing agent, for example 10–100 g/l of $HNO_3$, in the aqueous solution makes it possible to oxidize Zn etc. thereby to form an oxide film comprising mainly ZnO on the plating layer surface. The lower limit of $HNO_3$ was set at 10 g/l because at still lower concentrations oxidation hardly takes place, resulting in failure of oxide film formation. The upper limit of $HNO_3$ was set at 100 g/l because at concentrations exceeding the value the effect as an oxidizing agent reaches saturation, while the acid dissolves Zn and Fe, particularly Fe of the alloy layer surface, to increase the formation of Fe oxide and lowers the effect of improving the tip life in spot welding.

The formation of surface film is promoted by further adding, as an oxidizing agent, $KMnO_4$, $Ca(ClO)_2$, $K_2Cr_2O_7$, $NaClO_3$, $ClO_2$, $KNO_3$, $NaNO_3$, etc.

The contacting of sheet steel with the aqueous solution of $HNO_3$ may be performed by any desired methods including dipping and injection by spraying. After dipping or injection by spraying, for example dry heating gas may be blown against the sheet steel surface or the sheet steel may be heated at below about 100° C., whereby even a thinner solution is converted into a concentrated solution by water evaporation and further the reaction proceeds at elevated temperature, resulting in more effective treatment.

The oxide film etc. thus formed by the oxide film forming treatment comprises ZnO as the main component, oxides of Fe, and hydroxides of Zn and Fe, which may be present singly or mingled with one another. The film may also contain impurities such as Al, etc. With respect to characteristic properties as surface film, an oxide film of high ZnO content, which can cover the surface uniformly and has a low film resistance, is desirable.

To form an oxide film comprising mainly ZnO, 100–600 g/l of $Zn(NO_3)_2$ may be incorporated in the solution as a supply source of Zn ions, which, at a pH of the aqueous oxidizing agent solution of 4 or less, contributes to the activation of the plating layer surface and acts to furnish the Zn ions for forming ZnO.

The lower limit of $Zn(NO_3)_2$ was set at 100 g/l because at still lower concentrations the amount of Zn ions on the alloy layer surface is insufficient to be able to form oxide film. The upper limit was set at 600 g/l because when the concentration is higher than the value too much film is formed to increase the electric resistance, which results in heat generation due to the resistance between the sheet steel and the electrode tip, causing deterioration of weldability due to the enlargement of the electrode tip diameter.

Into the treating bath, there may sometimes dissolve out Fe and Zn in the plating and its impurities such as Mn, Al, P, Si etc. Among these, Zn ions are preferably added to the bath beforehand because then Zn ions need not be supplied by dissolving them out from the plating layer and hence ZnO can be deposited in a shorter time. The elution of other impurities is desirably suppressed to as low an extent as possible. In particular, Fe, when contained in a concentration higher than 1 g/l, forms Fe oxide and hydroxide on the surface to cause yellowing of the surface and deteriorate the product quality of the sheet steel surface; at the same time the oxide and hydroxide of Fe form an electrical resistance film and lower the tip life in spot welding. Accordingly, though the Fe ion concentration is not specified in the present invention, it is desirably as low as possible.

The oxide film comprising mainly ZnO may be formed by contacting galvanized sheet steel with an aqueous oxidizing agent solution containing 100–600 g/l of $Zn(NO_3)_2$ and 10–100 g/l of $HNO_3$ at a bath temperature of 30°–80° C. for 0.2–10 seconds.

The bath temperature of 30°–80° C. and its lower limit of 30° C. were selected to facilitate the oxidation of Zn ions at the plating surface. When the temperature is lower than the limit, the reaction velocity is low and the intended surface film is difficultly obtained. The upper limit was selected at 80° C., because at higher temperatures the reaction proceeds too far and the oxide film is formed excessively, to lower the weldability. Though temperatures higher than 80° C. are not absolutely excluded if the contact time is shortened correspondingly, the high temperature corresponding to a short time can be regulated with difficulty, so that the temperature is desirably 80° C. or less.

Accordingly, the contact treating time in dipping, spraying, etc. is selected in the range of 0.2–10 seconds though it may vary somewhat depending on the balance with the line velocity. This is because when the time is less than 0.2 second the oxide film is formed insufficiently and the weldability is not improved, whereas when the treating time is longer than 10 seconds the oxide film is formed too much, resulting in poor weldability.

As the second method, an oxide excellent in weldability can be formed, for example, by subjecting zinc-base galvanized sheet steel to an electrolytic treatment in an aqueous solution containing 400 g/l of $Zn(NO_3)_2 \cdot 6H_2O$ and 1 g/l of $HNO_3$ with the sheet steel used as the cathode at a current density of 1–20 A/dm$^2$ and for a treating time of 0.5–10 seconds.

As the third method, the oxide film comprising mainly ZnO can be formed with certainty by performing an alloying treatment and an oxide film forming treatment, after melt dipping, electroplating or vapor deposition plating. More specifically, the oxide film forming reaction can be effectively performed, for example, by adjusting an alloying furnace for producing alloyed fused zinc-plated sheet steel so as to give a sheet temperature of 300°–600° C., passing the sheet steel through the furnace at such a velocity that alloying is completed up to the surface, and then subjecting the sheet steel to an air-water treatment, wherein water and air are injected with an air-water nozzle to secure the dew point of the atmosphere. Further, the oxide film comprising mainly ZnO can be formed with certainty by performing, after melt dipping, electroplating or vapor deposition plating conducted off line, an alloying treatment and an oxide film forming treatment. These treatments may be performed in the same manner as described above. Thus, the oxide film comprising mainly ZnO can be formed effectively and with certainty.

The oxide film may be formed, besides by using the above-mentioned air-water treatment, for example, by injecting steam to the plating surface to form the oxide film comprising mainly ZnO or by performing, off line, a heat treatment in a heating furnace in which the dew point is adjusted to an oxidizing atmosphere, to form the oxide film comprising mainly ZnO.

In the above-described manner, is formed 30–3,000 $mg/m^2$ of an oxide film comprising mainly ZnO, as an oxide excellent in weldability, on the surface of zinc-base galvanized sheet steel, and further thereon can be formed, as described below, a film comprising oxides excellent in press-formability and phosphatability.

A good lubricity in press working may be imparted, in principle, by a method according to the second aspect of the present invention.

Thus, the lubricity may be imparted by forming on the surface an oxide-base film comprising the oxide of at least element one selected from Mn, Mo, Co, Ni, Ca, W, V, Ti, Al, P and B. The oxide film is of a glass-like structure similarly to chromate film and, at the time of press working, suppresses the galling of the plating with the die and enhances the sliding property. Further, since it dissolves in the phosphatizing liquid, it permits formation of the phosphate film unlike the chromate film. Moreover, since the oxide(s) is (are) among the components of the phosphating film, no adverse effect results even when the oxide(s) dissolve(s) out into the phosphating liquid. As a preferred embodiment wherein two or more oxides are used in combination, mention may be made of a case wherein a film comprising 1–500 $mg/m^2$ (in terms of P or Zn), respectively, of phosphorus oxide and zinc oxide is formed.

Though the structure of the oxide film is not definitely clear, it can be estimated that it is an amorphous macromolecular structure composed mainly of a network formed of Mn—O bonds, other metal—O bonds, P—O bonds, B—O bonds, Ti—O bonds, and Al—O bonds partly substituted with such groups as —OH, $CO_3$ etc. and further with metals supplied from the plating.

Since the film is an oxide film, it does not dissolve in the steps of washing with oil and degreasing, so that it neither undergoes lowering of the lubricating property nor adversely affects other process steps.

To improve the adhesive property and the film forming property of the oxide film, as desired, at least one colloid selected from colloidal $SiO_2$, colloidal $TiO_2$ and colloidal $Al_2O_3$ may be incorporated in the film in an amount of not more than 500 $mg/m^2$ (in terms of $SiO_2$, $TiO_2$ and/or $Al_2O_3$). In this manner, the structure of the oxide film becomes more uniform, and the film forming property, press-formability and phosphatability can be improved.

Such oxide film can be formed with certainty by dipping zinc-base galvanized sheet steel in an aqueous solution of a pH of 5 or less containing ions of at least one metal selected from Mn, Mo, Co, Ni, Ca, V, W, Ti, Al etc. and at least one oxoacid that contain P or B, by spraying the aqueous solution onto the galvanized sheet steel, or by subjecting the sheet steel to a cathodically electrolytic treatment in the aqueous solution. In these treatments, zinc of the plating metal or, in the case of zinc alloy plating, zinc and alloy elements (metals), and impurities in the aqueous solution get mixed in the film as other oxides.

Hereunder, description is given of the range of amount of the film of the present invention.

The amount of the oxide film must be at least 1 $mg/m^2$ in terms of metal to attain a good press-formability, but when the film amount exceeds 500 $mg/m^2$ it causes insufficient film formation in the phosphating conversion. An appropriate film amount, therefore, is 1–500 $mg/m^2$, preferably 1–200 $mg/m^2$, in terms of metal. When two or more metal oxides are used, the respective amounts may be selected in the above-mentioned range.

The total amount of the at least one colloid selected from colloidal $SiO_2$, colloidal $TiO_2$ and colloidal $Al_2O_3$is preferably not more than 500 $mg/m^2$ (in terms of $SiO_2$, $TiO_2$ and/or $Al_2O_3$), more preferably not more than 200 $mg/m^2$. When the amount exceeds 500 $mg/m^2$ the phosphatability may be deteriorated. The lower limit of the amount is 1 $mg/m^2$.

Then, description is given of a treating bath for forming the above-mentioned oxide film. As to metal ions, Mn is vatted to industrial advantage in the form of permanganate ($MnO_4^-$), which also offers the advantage of promoting the dissolution of zinc by making use of the oxidizing power of $MnO_4^-$ ions. Mo, W and V may be vatted stably in the form of molybdate ($MnO_4^{-2}$), tungstate ($WO_4^{-2}$) and vanadate ($VO_4^{-2}$), respectively, or the poly salts thereof. Ti and Al can be dissolved in an acidic medium of a pH of 2 or less. These metal ions can be used in concentrations from 1 g/l their solubility limits. The oxoacids of P and B are used respectively in the form of phosphoric acid and boric acid, or the salts thereof. The pH of the solution is preferably not more than 5. When it exceeds 5, the reaction does not proceed practically. Though the pH of the solution may be adjusted also with phosphoric acid or boric acid, it is advantageous as the means for controlling the film amount and the film constituent ratio independently from each other to regulate the pH by adding an acid which does not participate in film formation, for example, sulfuric acid, hydrochloric acid, nitric acid, acetic acid and perchloric acid.

$SiO_2$, $TiO_2$ and $Al_2O_3$ may be added in the form of aqueous solution containing fine particles of respective colloids, or as potassium silicofluoride, potassium titanium fluoride, etc. in an amount of 1–60 g/l in terms of solid.

The film forming reaction is of a self passivation type; that is, when all the surface of zinc-base plating layer has been covered, the reaction reaches completion automatically. The treating time necessary to completion of the covering is as short as 0.1 second for faster reactions, and generally a time of 1 minute or less is sufficient. The treatment can be easily performed at a treating liquid temperature of room temperature to 80° C. Though the film forming reaction begins with the dissolution of the zinc oxide layer, the reaction stops in a short time because the pH at the interface rises immediately to deposit and form a covering upper oxide layer or hydroxide layer. Resultantly, almost all of the lower zinc oxide layer is retained and thus a two-layer film is formed. An increase in free acid concentration, in other words decrease in pH, will increase the amount of film. It is also effective in controlling the film amount to regulate the thickness of water film furnished to the zinc-base galvanized sheet steel surface and thereby to promote the increase of pH, by spraying treatment, coating treatment, etc.

Cathodically electrolytic treatment has an effect of promoting the pH increase at the interface and increasing the film amount. An applied current density of 10 $A/dm^2$ or less is sufficient. A current density exceeding 10 $A/dm^2$ is unfavorable because it promotes the deposition of metals to deteriorate the lubricating property or yields a film amount exceeding 500 mg/m$^2$ even in a short time of treatment.

The present invention is described in detail below with reference to Examples and Comparative Examples, which, however, in no way limit the present invention.

First, the kinds of the plated sheet steel used and the methods of evaluating or determining the phosphatability, the press-formability, the oxides, the weldability and the ZnO film are described below.

(1) Kind of plated sheet steel

AS: Hot-dip galvannealed sheet steel (Fe: 10%, Al: 0.25%, balance: Zn),

EG: Electrogalvanized sheet steel,

GI: Hot-dip galvannealed sheet steel (Al: 0.3%, Fe: 0.8%, Pb 0.1%, balance: Zn), HA: Half-alloyed galvannealed sheet steel (Fe: 5%, Al: 0.3%, balance: Zn), The sheet steel used for all is a 0.8 mm thick conventional sheet steel.

Zn/Zn—Cr: Double-layer electroplated sheet steel with 2 g/m$^2$ of zinc on the 10% Cr zinc alloy layer.

(2) Phosphatability

The phosphating treatment was conducted by using a commercially available phosphatizing liquid, SD 5000 (mfd. by Nippon Paint CO., LTD.), and after performing degreasing and surface conditioning according to the manufacturer's instruction. The phosphate film was examined by means of SEM (secondary electron beam image) and judged as ○ when the film is uniformly formed, as Δ when it is partly formed and as X when the film is not formed.

(3) Press-formability (friction coefficient)

Tests were made at several points between normal loads of 100 and 600 kgf to measure pull-out loads under the following conditions: test piece size: 17 mm by 300 mm, drawing speed: 500 mm/min., radius of square bead shoulder: 1.0/3.3 mm, slide length: 200 mm, oil application: NOX rust® 530F (mfd. by Parker Industries, INC.) 40.1 g/m$^2$ The friction coefficient was determined from the inclination between the normal load and the drawing force.

(4) Determination of oxides

The oxides were determined by GDS (glow discharge spectroscopy) and ICAP (ion plasma emission spectroscopy)

(5) Weldability

Welding test was conducted under the following conditions:

1) Applied pressure: 250 kgf
2) Squeezed time: 40 hr.
3) Resistance welding time: 12 hr.
4) Retention time: 5 hr.
5) Welding current: 11 KA
6) Electrode Tip diameter: 5.0 ϕ (dome head type)
7) Electrode life end point judgement:
   Judged by the number of weld spots up to which a nugget diameter of 3.6 mm was secured at 85% of the welding current.
8) Electrode material: Cu—Cr (conventionally used)
   Welding was conducted by placing plated surfaces of two test specimens on the sides of both electrodes.

(6) Determination of ZnO film

The plating layer alone was dissolved with 5% iodine methyl alcohol solution, and the extraction residue was fused with a fusing mixture (boric acid: sodium carbonate= 1:3). The resulting product was made into a solution with hydrochloric acid and analyzed by ICP to determine the zinc amount, which was then calculated as ZnO.

Example 1 and Comparative Example 1 (the case of manganese oxide)

An Example of the present invention and a Comparative Example are as shown in Table 1. The treatment conditions for Run No. 1 of the present Example were as follows: electrolysis was performed with sheet steel to be treated used as the cathode and a Pt electrode used as the anode in a solution containing 50 g/l of potassium permanganate, 10 g/l of phosphoric acid, 3 g/l of sulfuric acid and 5 g/l of zinc carbonate at 30° C. and at 7 A/dm$^2$ for 1.5 seconds, and the sheet steel was then washed with water and dried. The other samples were prepared by regulating the concentrations of potassium permanganate, phosphoric acid, sulfuric acid and zinc carbonate, solution temperature, dipping time or electrolysis amount. It is apparent from Table 1 that the press-formability is markedly improved without deteriorating the phosphatability according to the process of the present invention as compared with those in the Comparative Example.

TABLE 1

| | Run No. | Plated sheet steel | Plating weight (Top face/ Bottom face) (g/m$^2$) | Film formed: Treatment | Film formed: Film amount*) (mg/m$^2$) | Phosphat-ability | Press-formability (Friction coefficient) |
|---|---|---|---|---|---|---|---|
| Example I | 1 | EG | 20/20 | Mn treatment | 23(Mn) | ○ | 0.265 |
| | 2 | EG | 40/40 | Mn treatment | 7(Mn) | ○ | 0.387 |
| | 3 | EG | 60/60 | Mn treatment | 9(Mn) | ○ | 0.390 |
| | 4 | EG | 60/60 | Mn treatment | 24(Mn) | ○ | 0.274 |
| | 5 | EG | 60/60 | Mn treatment | 40(Mn) | ○ | 0.286 |
| | 6 | EG | 60/60 | Mn treatment | 87(Mn) | ○ | 0.342 |
| | 7 | EG | 60/60 | Mn treatment | 130(Mn) | ○ | 0.351 |
| | 8 | AS | 60/60 | Mn treatment | 453(Mn) | ○ | 0.363 |
| | 9 | AS | 30/60 | Mn treatment | 130(Mn) | ○ | 0.305 |
| | 10 | AS | 45/45 | Mn treatment | 54(Mn) | ○ | 0.259 |
| | 11 | AS | 60/60 | Mn treatment | 28(Mn) | ○ | 0.261 |
| | 12 | GI | 90/90 | Mn treatment | 32(Mn) | ○ | 0.287 |
| | 13 | GI | 120/120 | Mn treatment | 34(Mn) | ○ | 0.287 |
| | 14 | HA | 60/60 | Mn treatment | 29(Mn) | ○ | 0.290 |
| | 15 | HA | 100/100 | Mn treatment | 34(Mn) | ○ | 0.278 |

TABLE 1-continued

| | Run No. | Plated sheet steel | Plating weight (Top face/ Bottom face) ($g/m^2$) | Film formed: Treatment | Film formed: Film amount*) ($mg/m^2$) | Phosphatability | Press-formability (Friction coefficient) |
|---|---|---|---|---|---|---|---|
| Comp. Example I | 1 | EG | 20/20 | No treatment | — | o | 1.895 |
| | 2 | EG | 60/60 | Mn treatment | 640(Mn) | Δ | 0.307 |
| | 3 | EG | 60/60 | Electrolytic chromate | 23(Cr) | x | 0.364 |
| | 4 | AS | 60/60 | No treatment | — | o | 0.764 |
| | 5 | AS | 45/45 | Mn treatment | 880(Mn) | Δ | 0.356 |
| | 6 | CR | 0/0 | No treatment | — | o | 0.536 |
| | 7 | HA | 60/60 | No treatment | — | o | 1.435 |
| | 8 | GI | 120/120 | No treatment | — | o | 1.510 |

Note:
*)Element determined is indicated in parentesis.

Example II and Comparative Example II (the case of Mo)

An example of the present invention and a Comparative Example are shown in Table 2. The treatment conditions for Run No. 1 of the present Example were as follows: electrolysis was performed in a solution containing 50 g/l of ammonium molybdate and 10 g/l of phosphoric acid at 30° C. with sheet steel to be treated used as the cathode and a Pt electrode used as the anode at 7 $A/dm^2$ for 1.5 seconds, and the sheet steel was then washed with water and dried. Other specimens were prepared by varying the concentrations of ammonium molybdate or phosphoric acid, in some specimens sulfuric acid and zinc carbonate being further added to the solution, and regulating the solution temperature, dipping time and coulombic. As is apparent from Table 2, according to the process of the present invention, the press-formability is markedly improved without deteriorating the phosphatability as compared with those in Comparative examples.

TABLE 2

| | Run No. | Plated sheet steel | Plating weight (Top face/ Bottom face) ($g/m^2$) | Film formed: Treatment | Film formed: Film amount*) ($mg/m^2$) | Phosphatability | Press-formability (Friction coefficient) |
|---|---|---|---|---|---|---|---|
| Example | 1 | EG | 20/20 | Mo treatment | 23(Mo) | o | 0.265 |
| | 2 | EG | 40/40 | Mo treatment | 7(Mo) | o | 0.387 |
| | 3 | EG | 60/60 | Mo treatment | 9(Mo) | o | 0.390 |
| | 4 | EG | 60/60 | Mo treatment | 24(Mo) | o | 0.274 |
| | 5 | EG | 60/60 | Mo treatment | 40(Mo) | o | 0.286 |
| | 6 | EG | 60/60 | Mo treatment | 87(Mo) | o | 0.342 |
| | 7 | EG | 60/60 | Mo treatment | 130(Mo) | o | 0.351 |
| | 8 | AS | 60/60 | Mo treatment | 453(Mo) | o | 0.363 |
| | 9 | AS | 30/60 | Mo treatment | 130(Mo) | o | 0.305 |
| | 10 | AS | 45/45 | Mo treatment | 54(Mo) | o | 0.259 |
| | 11 | AS | 60/60 | Mo treatment | 28(Mo) | o | 0.261 |
| | 12 | GI | 90/90 | Mo treatment | 32(Mo) | o | 0.287 |
| | 13 | GI | 120/120 | Mo treatment | 34(Mo) | o | 0.287 |
| | 14 | HA | 60/60 | Mo treatment | 29(Mo) | o | 0.290 |
| | 15 | HA | 100/100 | Mo treatment | 34(Mo) | o | 0.278 |
| Comp. Example | 1 | EG | 20/20 | No treatment | — | o | 1.895 |
| | 2 | EG | 60/60 | Mo treatment | 640(Mo) | Δ | 0.307 |
| | 3 | EG | 60/60 | Electrolytic chromate | 23(Cr) | x | 0.364 |
| | 4 | AS | 60/60 | No treatment | — | o | 0.764 |
| | 5 | AS | 45/45 | Mo treatment | 880(Mo) | Δ | 0.356 |
| | 6 | CR | 0/0 | No treatment | — | o | 0.536 |
| | 7 | HA | 60/60 | No treatment | — | o | 1.435 |
| | 8 | GI | 120/120 | No treatment | — | o | 1.510 |

Note:
*)Element determined is indicated in parentesis.

Example III and Comparative Example III (the case of Co)

An Example of the present invention and a Comparative Example are shown in Table 3. The treatment condition for Run No. 1 of the present Example were as follows: electrolysis was performed in a solution containing 200 g/l of cobalt nitrate, 150 g/l of zinc nitrate and 1 ml/l of concentrated nitric acid at 30° C. with sheet steel to be treated used as the cathode and a Pt electrode used as the anode at 7A/dm$^2$ for 1.5 seconds, and the sheet steel was then washed with water and dried. Other specimens were prepared by regulating the concentrations of cobalt nitrate, zinc nitrate and nitric acid, in some specimens phosphoric acid, suffuric acid and zinc carbonate being further added to the solution, and regulating the solution temperature and coulombic amount. As is apparent from Table 3, according to the process of the present invention, the press-formability is markedly improved without deteriorating the phosphatability, as compared with those in the Comparative Example.

TABLE 3

| | Run No. | Plated sheet steel | Plating weight (Top face/ Bottom face) (g/m$^2$) | Film formed: Treatment | Film formed: Film amount*) (mg/m$^2$) | Phosphatability | Press-formability (Friction coefficient) |
|---|---|---|---|---|---|---|---|
| Example | 1 | EG | 20/20 | Co treatment | 23(Co) | o | 0.265 |
| | 2 | EG | 40/40 | Co treatment | 7(Co) | o | 0.387 |
| | 3 | EG | 60/60 | Co treatment | 9(Co) | o | 0.390 |
| | 4 | EG | 60/60 | Co treatment | 24(Co) | o | 0.274 |
| | 5 | EG | 60/60 | Co treatment | 40(Co) | o | 0.286 |
| | 6 | EG | 60/60 | Co treatment | 87(Co) | o | 0.342 |
| | 7 | EG | 60/60 | Co treatment | 130(Co) | o | 0.351 |
| | 8 | AS | 60/60 | Co treatment | 453(Co) | o | 0.363 |
| | 9 | AS | 30/60 | Co treatment | 130(Co) | o | 0.305 |
| | 10 | AS | 45/45 | Co treatment | 54(Co) | o | 0.259 |
| | 11 | AS | 60/60 | Co treatment | 28(Co) | o | 0.261 |
| | 12 | GI | 90/90 | Co treatment | 32(Co) | o | 0.287 |
| | 13 | GI | 120/120 | Co treatment | 34(Co) | o | 0.287 |
| | 14 | HA | 60/60 | Co treatment | 29(Co) | o | 0.290 |
| | 15 | HA | 100/100 | Co treatment | 34(Co) | o | 0.278 |
| Comp. Example | 1 | EG | 20/20 | No treatment | — | o | 1.895 |
| | 2 | EG | 60/60 | Co treatment | 640(Co) | Δ | 0.307 |
| | 3 | EG | 60/60 | Electrolytic chromate | 23(Cr) | x | 0.364 |
| | 4 | AS | 60/60 | No treatment | — | o | 0.764 |
| | 5 | AS | 45/45 | Co treatment | 880(Co) | Δ | 0.356 |
| | 6 | CR | 0/0 | No treatment | — | o | 0.536 |
| | 7 | HA | 60/60 | No treatment | — | o | 1.435 |
| | 8 | GI | 120/120 | No treatment | — | o | 1.510 |

Note:
*)Element determined is indicated in parentesis.

Example IV and Comparative Example IV (the case of Ni)

An Example of the present invention and a Comparative Example are shown in Table 4. The treatment conditions for Run No. 1 of the present Example were as follows: electrolysis was performed in a solution containing 250 g/l of nickel nitrate, 150 g/l of zinc nitrate and 1 ml/l of concentrated nitric acid at 30° C. with sheet steel to be treated used as the cathode and a Pt electrode used as the anode at 7A/dm$^2$ for 1.5 seconds, and the sheet steel was then washed with water and dried. Other specimens were prepared by regulating the concentrations of nickel nitrate, zinc nitrate and nitric acid, in some specimens phosphoric acid, zinc nitrate and zinc carbonate being further added to the solution, and regulating the solution temperature and coulombic amount. As is apparent from Table 4, according to the process of the present invention, the press-formability is markedly improved without deteriorating the phosphatability as compared with those in the Comparative Example.

TABLE 4

| | Run No. | Plated sheet steel | Plating weight (Top face/ Bottom face) (g/m$^2$) | Film formed: Treatment | Film formed: Film amount*) (mg/m$^2$) | Phosphatability | Press-formability (Friction coefficient) |
|---|---|---|---|---|---|---|---|
| Example | 1 | EG | 20/20 | Ni treatment | 23(Ni) | o | 0.265 |
| | 2 | EG | 40/40 | Ni treatment | 7(Ni) | o | 0.387 |
| | 3 | EG | 60/60 | Ni treatment | 9(Ni) | o | 0.390 |

TABLE 4-continued

| | Run No. | Plated sheet steel | Plating weight (Top face/ Bottom face) (g/m²) | Film formed: Treatment | Film formed: Film amount*) (mg/m²) | Phosphat-ability | Press-formability (Friction coefficient) |
|---|---|---|---|---|---|---|---|
| | 4 | EG | 60/60 | Ni treatment | 24(Ni) | o | 0.274 |
| | 5 | EG | 60/60 | Ni treatment | 40(Ni) | o | 0.286 |
| | 6 | EG | 60/60 | Ni treatment | 87(Ni) | o | 0.342 |
| | 7 | EG | 60/60 | Ni treatment | 130(Ni) | o | 0.351 |
| | 8 | AS | 60/60 | Ni treatment | 453(Ni) | o | 0.363 |
| | 9 | AS | 30/60 | Ni treatment | 130(Ni) | o | 0.305 |
| | 10 | AS | 45/45 | Ni treatment | 54(Ni) | o | 0.259 |
| | 11 | AS | 60/60 | Ni treatment | 28(Ni) | o | 0.261 |
| | 12 | GI | 90/90 | Ni treatment | 32(Ni) | o | 0.287 |
| | 13 | GI | 120/120 | Ni treatment | 34(Ni) | o | 0.287 |
| | 14 | HA | 60/60 | Ni treatment | 29(Ni) | o | 0.290 |
| | 15 | HA | 100/100 | Ni treatment | 34(Ni) | o | 0.278 |
| Comp. Example | 1 | EG | 20/20 | No treatment | — | o | 1.895 |
| | 2 | EG | 60/60 | Ni treatment | 640(Ni) | Δ | 0.307 |
| | 3 | EG | 60/60 | Electrolytic chromate | 23(Cr) | x | 0.364 |
| | 4 | AS | 60/60 | No treatment | — | o | 0.764 |
| | 5 | AS | 45/45 | Ni treatment | 880(Ni) | Δ | 0.356 |
| | 6 | CR | 0/0 | No treatment | — | o | 0.536 |
| | 7 | HA | 60/60 | No treatment | — | o | 1.435 |
| | 8 | GI | 120/120 | No treatment | — | o | 1.510 |

Note:
*)Element determined is indicated in parentesis.

Example V and Comparative Example (the case of Ca)

An Example of the present invention and a Comparative Example are shown in Table 5. The treatment conditions for Run No. 1 of the present Example were as follows: electrolysis was performed in a solution containing 250 g/l of calcium nitrate, 150 g/l of zinc nitrate and 1 ml/l of concentrated nitric acid at 30° C. with sheet steel to be treated used as the cathode and a Pt electrode used as the anode at 7A/dm² for 1.5 seconds, and the sheet steel was then washed with water and dried. Other specimens were prepared by regulating the concentrations of calcium nitrate, zinc nitrate and nitric acid; in some specimens phosphoric acid, sulfuric acid and zinc carbonate being further added to the solution, and regulating the solution temperature and coulombic amount. As is apparent from Table 7, according to the process of the present invention, the press-formability is markedly improved without deteriorating the phosphatability as compared with those in the comparative Examples.

TABLE 5

| | Run No. | Plated sheet steel | Plating weight (Top face/ Bottom face) (g/m²) | Film formed: Treatment | Film formed: Film amount*) (mg/m²) | Phosphat-ability | Press-formability (Friction coefficient) |
|---|---|---|---|---|---|---|---|
| Example | 1 | EG | 20/20 | Ca treatment | 23(Ca) | o | 0.265 |
| | 2 | EG | 40/40 | Ca treatment | 7(Ca) | o | 0.387 |
| | 3 | EG | 60/60 | Ca treatment | 9(Ca) | o | 0.390 |
| | 4 | EG | 60/60 | Ca treatment | 24(Ca) | o | 0.274 |
| | 5 | EG | 60/60 | Ca treatment | 40(Ca) | o | 0.286 |
| | 6 | EG | 60/60 | Ca treatment | 87(Ca) | o | 0.342 |
| | 7 | EG | 60/60 | Ca treatment | 130(Ca) | o | 0.351 |
| | 8 | AS | 60/60 | Ca treatment | 453(Ca) | o | 0.363 |
| | 9 | AS | 30/60 | Ca treatment | 130(Ca) | o | 0.305 |
| | 10 | AS | 45/45 | Ca treatment | 54(Ca) | o | 0.259 |
| | 11 | AS | 60/60 | Ca treatment | 28(Ca) | o | 0.261 |
| | 12 | GI | 90/90 | Ca treatment | 32(Ca) | o | 0.287 |
| | 13 | GI | 120/120 | Ca treatment | 34(Ca) | o | 0.287 |
| | 14 | HA | 60/60 | Ca treatment | 29(Ca) | o | 0.290 |
| | 15 | HA | 100/100 | Ca treatment | 34(Ca) | o | 0.278 |
| Comp. Example | 1 | EG | 20/20 | No treatment | — | o | 1.895 |
| | 2 | EG | 60/60 | Ca treatment | 640(Ca) | Δ | 0.307 |
| | 3 | EG | 60/60 | Electrolytic chromate | 23(Cr) | x | 0.364 |
| | 4 | AS | 60/60 | No treatment | — | o | 0.764 |

TABLE 5-continued

| Run No. | Plated sheet steel | Plating weight (Top face/ Bottom face) ($g/m^2$) | Film formed Treatment | Film amount*) ($mg/m^2$) | Phosphat-ability | Press-formability (Friction coefficient) |
|---|---|---|---|---|---|---|
| 5 | AS | 45/45 | Ca treatment | 880(Ca) | Δ | 0.356 |
| 6 | CR | 0/0 | No treatment | — | o | 0.536 |
| 7 | HA | 60/60 | No treatment | — | o | 1.435 |
| 8 | GI | 120/120 | No treatment | — | o | 1.510 |

Note:
*)Element determined is indicated in parentesis.

Example VI and Comparative Example VI (the case of phosphorus oxide)

An Example of the present invention wherein phosphorus oxide, or phosphorus oxide and boric acid, were used respectively and a Comparative Example are shown in Table 6(a) and Table 6(b), respectively.

TABLE 6(a)

| | Run No. | Plated sheet steel | (Phosphorus oxide) Plating weight (Top face/ Bottom face) ($g/m^2$) | Film formed Phosphorus ($mg/m^2$) | Phosphat-ability | Press-formability (Friction coefficient) |
|---|---|---|---|---|---|---|
| Example | 1 | EG | 20/20 | 2 | o | 0.106 |
| | 2 | EG | 40/40 | 7 | o | 0.112 |
| | 3 | EG | 60/60 | 5 | o | 0.111 |
| | 4 | EG | 60/60 | 9 | o | 0.110 |
| | 5 | EG | 60/60 | 27 | o | 0.114 |
| | 6 | EG | 60/60 | 50 | o | 0.130 |
| | 7 | EG | 60/60 | 400 | o | 0.180 |
| | 8 | AS | 60/60 | 200 | o | 0.173 |
| | 9 | AS | 30/60 | 20 | o | 0.120 |
| | 10 | AS | 45/45 | 30 | o | 0.100 |
| | 11 | AS | 60/60 | 18 | o | 0.105 |
| | 12 | GI | 90/90 | 15 | o | 0.115 |
| | 13 | GI | 120/120 | 12 | o | 0.115 |
| | 14 | HA | 60/60 | 14 | o | 0.116 |
| | 15 | HA | 100/100 | 13 | o | 0.111 |
| | 16 | Zn/Zn—Cr | 20/20 | 20 | o | 0.115 |
| Comp. Example | 1 | EG | 20/20 | — | o | 0.948 |
| | 2 | EG | 60/60 | 800 | Δ | 0.523 |
| | 3 | EG | 60/60 | — | x | 0.182 |
| | 4 | AS | 60/60 | — | o | 0.764 |
| | 5 | AS | 45/45 | 700 | Δ | 0.400 |
| | 6 | AS | 45/45 | — | o | 0.412 |
| | 7 | HA | 60/60 | — | o | 0.718 |
| | 8 | GI | 120/120 | — | o | 0.600 |
| | 9 | Zn/Zn—Cr | 20/20 | No treat-ment | o | 0.750 |

TABLE 6(b)

| | Run No. | Plated sheet steel | Plating weight (Top face/ Bottom face) ($g/m^2$) | Oxide film amount ($mg/m^2$) (Phosphorus oxide and boric acid) P | B | Phosphatability | Press-formability (Friction coefficient) |
|---|---|---|---|---|---|---|---|
| Example | 1 | EG | 20/20 | 1 | 15 | o | 0.106 |
| | 2 | EG | 40/40 | 490 | 6 | o | 0.210 |
| | 3 | EG | 60/60 | 8 | 1 | o | 0.156 |
| | 4 | EG | 60/60 | 130 | 30 | o | 0.161 |
| | 5 | EG | 60/60 | 31 | 20 | o | 0.114 |
| | 6 | EG | 60/60 | 250 | 137 | o | 0.193 |
| | 7 | EG | 60/60 | 80 | 143 | o | 0.158 |
| | 8 | AS | 60/60 | 180 | 480 | o | 0.209 |
| | 9 | AS | 30/60 | 303 | 200 | o | 0.198 |
| | 10 | AS | 45/45 | 400 | 5 | o | 0.195 |
| | 11 | AS | 60/60 | 30 | 15 | o | 0.104 |
| | 12 | GI | 90/90 | 20 | 25 | o | 0.115 |
| | 13 | GI | 120/120 | 17 | 13 | o | 0.116 |
| | 14 | HA | 60/60 | 18 | 5 | o | 0.115 |
| | 15 | HA | 100/100 | 9 | 18 | o | 0.111 |
| | 16 | Zn/Zn—Cr | 20/20 | 10 | 15 | o | 0.115 |
| Comp. Example | 1 | EG | 20/20 | No treatment | | o | 0.948 |
| | 2 | EG | 60/60 | P amount: 640 $mg/m^2$ | | Δ | 0.523 |
| | 3 | EG | 60/60 | Electrolytic chromate (23 $mg/m^2$ as metallic Cr) | | x | 0.182 |
| | 4 | AS | 60/60 | No treatment | | o | 0.768 |
| | 5 | AS | 45/45 | B amount: 880 $mg/m^2$ | | Δ | 0.470 |
| | 6 | HA | 60/60 | No treatment | | o | 0.718 |
| | 7 | GI | 120/120 | " | | o | 0.755 |
| | 8 | Zn/Zn—Cr | 20/20 | " | | o | 0.750 |

Example VII (a case wherein Mn oxide and other oxides are used in combination)

An Example wherein a film of oxides of Mn and P was formed is shown in Table 7(a), an Example wherein Mn, boric acid and optionally phosphorus oxide were used is shown in Table 7(b), and an Example wherein a film of oxides of Mn and one or two selected from P, Mo, W and V is shown in Table 7(c).

The oxide film shown in Table 7(a) was formed by performing an electrolysis in a solution containing 50 g/l potassium permanganate, 10 g/l phosphoric acid, 3 g/l of sulfuric acid and 5 g/l of zinc carbonate at 30° C. with sheet steel to be treated used as the cathode and a Pt electrode used as the anode at 7 $A/dm^2$ for 1.5 seconds, followed by water washing and drying. Films in other Runs were formed in the same manner but by regulating the concentrations of potassium permanganate, phosphoric acid, sulfuric acid and zinc carbonate, solution temperature and dipping time. It is apparent from Table 7(a) that the sheet steels of the present invention have a markedly improved press-formability without deteriorating the phosphatability as compared with those of Comparative Example.

TABLE 7(a)

| | Run No. | Plated sheet steel | plating weight (Top/face/ Bottom face) ($gm/^2$) | Film amount Mn ($mg/m^2$) | P ($mg/m^2$) | Phosphatability | Press-formability (Friction coefficient) |
|---|---|---|---|---|---|---|---|
| Example 7(a) | 1 | EG | 20/20 | 23 | 18 | o | 0.106 |
| | 2 | EG | 40/40 | 7 | 10 | o | 0.155 |
| | 3 | EG | 60/60 | 9 | 4 | o | 0.156 |
| | 4 | EG | 60/60 | 24 | 30 | o | 0.110 |
| | 5 | EG | 60/60 | 40 | 33 | o | 0.114 |
| | 6 | EG | 60/60 | 87 | 147 | o | 0.137 |
| | 7 | EG | 60/60 | 130 | 80 | o | 0.140 |
| | 8 | AS | 60/60 | 453 | 792 | o | 0.145 |
| | 9 | AS | 30/60 | 130 | 430 | o | 0.122 |
| | 10 | AS | 45/45 | 54 | 32 | o | 0.104 |
| | 11 | AS | 60/60 | 28 | 10 | o | 0.104 |
| | 12 | GI | 90/90 | 32 | 70 | o | 0.115 |
| | 13 | GI | 120/120 | 34 | 45 | o | 0.115 |
| | 14 | HA | 60/60 | 29 | 30 | o | 0.116 |
| | 15 | HA | 100/100 | 34 | 5 | o | 0.111 |

TABLE 7(a)-continued

| | Run No. | Plated sheet steel | plating weight (Top/face/ Bottom face) (gm/$^2$) | Film amount Mn (mg/m$^2$) | Film amount P (mg/m$^2$) | Phos-phat-ability | Press-formability (Friction coefficient) |
|---|---|---|---|---|---|---|---|
| Comp. Example 7(a) | 1 | EG | 20/20 | — | 50 | o | 0.758 |
| | 2 | EG | 60/60 | No treatment | | Δ | 0.120 |
| | 3 | EG | 60/60 | Electrolytic chromate (23 mg/m$^2$ as metallic Cr) | | x | 0.182 |
| | 4 | AS | 60/60 | 47 | 1300 | Δ | 0.140 |
| | 5 | AS | 45/45 | 55 | — | Δ | 0.178 |
| | 6 | AS | 45/45 | 20 | — | o | 0.190 |
| | 7 | HA | 60/60 | — | 150 | o | 0.574 |

TABLE 7(b)

| | Run No. | Plated sheet steel | Plating weight (Top face/ Bottom face) (g/m$^2$) | Oxide film amount (mg/m$^2$) Mn | P | B | Phos-phat-ability | Press-formability (Friction coefficient) |
|---|---|---|---|---|---|---|---|---|
| Example 7(b) | 1 | EG | 20/20 | 23 | — | 15 | o | 0.106 |
| | 2 | EG | 40/40 | 7 | — | 6 | o | 0.155 |
| | 3 | EG | 60/60 | 9 | 8 | 3 | o | 0.156 |
| | 4 | EG | 60/60 | 24 | — | 30 | o | 0.110 |
| | 5 | EG | 60/60 | 40 | 31 | 20 | o | 0.114 |
| | 6 | EG | 60/60 | 87 | — | 137 | o | 0.137 |
| | 7 | EG | 60/60 | 130 | 80 | 143 | o | 0.140 |
| | 8 | AS | 60/60 | 453 | — | 870 | o | 0.145 |
| | 9 | AS | 30/60 | 154 | 303 | 200 | o | 0.122 |
| | 10 | AS | 45/45 | 28 | — | 5 | o | 0.104 |
| | 11 | AS | 60/60 | 32 | 30 | 15 | o | 0.104 |
| | 12 | GI | 90/90 | 34 | 20 | 25 | o | 0.115 |
| | 13 | GI | 120/120 | 29 | 17 | 13 | o | 0.116 |
| | 14 | HA | 60/60 | 40 | 18 | 5 | o | 0.115 |
| | 15 | HA | 100/100 | 34 | 9 | 18 | o | 0.111 |
| Comp. Example 7(b) | 1 | EG | 20/20 | No treatment | | | o | 0.948 |
| | 2 | EG | 60/60 | Mn: 640 mg/m$^2$ | | | Δ | 0.154 |
| | 3 | EG | 60/60 | Electrolytic chromate (23 mg/m$^2$ as metallic Cr) | | | x | 0.182 |
| | 4 | AS | 60/60 | No treatment | | | o | 0.382 |
| | 5 | AS | 45/45 | Mn: 880 mg/m$^2$ | | | Δ | 0.178 |
| | 6 | CR | 0/00 | No treatment | | | o | 0.268 |
| | 7 | HA | 60/60 | " | | | o | 0.718 |
| | 8 | GI | 120/120 | " | | | o | 0.755 |

TABLE 7(c)

| | Run No. | Plated sheet steel | Plating weight (Top face/ Bottom face) (g/m$^2$) | Oxide film amount*) (mg/m$^2$) Mn | P | Mo | W | V | Phos-phat-ability | Press-formability (Friction coefficient) |
|---|---|---|---|---|---|---|---|---|---|---|
| Example 7(c) | 1 | EG | 20/20 | 23 | 18 | 5 | | | o | 0.106 |
| | 2 | EG | 40/40 | 7 | 10 | | 12 | | o | 0.155 |
| | 3 | EG | 60/60 | 9 | 4 | | | 1 | o | 0.156 |
| | 4 | EG | 60/60 | 24 | 30 | 8 | | | o | 0.110 |
| | 5 | EG | 60/60 | 40 | 33 | | 4 | | o | 0.114 |
| | 6 | EG | 60/60 | 87 | 147 | | | 10 | o | 0.137 |
| | 7 | EG | 60/60 | 130 | 80 | 33 | | | o | 0.140 |
| | 8 | AS | 60/60 | 453 | 792 | 70 | | | o | 0.145 |
| | 9 | AS | 30/60 | 154 | 430 | | | 43 | o | 0.122 |

TABLE 7(c)-continued

| | Run No. | Plated sheet steel | Plating weight (Top face/ Bottom face) (g/m²) | Oxide film amount*) (mg/m²) Mn | P | Mo | W | V | Phosphatability | Press-formability (Friction coefficient) |
|---|---|---|---|---|---|---|---|---|---|---|
| | 10 | AS | 45/45 | 28 | 32 | | 7 | | o | 0.104 |
| | 11 | AS | 60/60 | 32 | 10 | | | 4 | o | 0.104 |
| | 12 | GI | 90/90 | 34 | 70 | 15 | | | o | 0.115 |
| | 13 | GI | 120/120 | 29 | 45 | 3 | | | o | 0.115 |
| | 14 | HA | 60/60 | 40 | 30 | 7 | | | o | 0.116 |
| | 15 | HA | 100/100 | 34 | 5 | 18 | | | o | 0.111 |
| Comp. Example (7(c) | 1 | EG | 20/20 | No treatment | | | | | o | 0.948 |
| | 2 | EG | 60/60 | Mn: 640 mg/m² | | | | | Δ | 0.154 |
| | 3 | EG | 60/60 | Electrolytic chromate (23 mg/m² as metallic Cr) | | | | | x | 0.182 |
| | 4 | AS | 60/60 | No treatment | | | | | o | 0.382 |
| | 5 | AS | 45/45 | Mn: 880 mg/m² | | | | | Δ | 0.178 |
| | 6 | CR | 0/0 | No treatment | | | | | o | 0.268 |
| | 7 | HA | 60/60 | " | | | | | o | 0.718 |
| | 8 | GI | 120/120 | " | | | | | o | 0.755 |

Note:
*)The oxide film amount is expressed in terms of Mn, P, Mo, W and V, respectively, for Mn oxide, phosphoric acid, Mo oxide, W oxide and V oxide.

Example VIII

An Example wherein an inorganic covering layer having both functions of adhesion prevention and rolling lubrication according to the present invention was provided is shown in Table 8 along with a Comparative Example.

The breaking critical load ratio was determined in the following way.

In the draw bead test described before, the normal load (i.e., pressing load) at which the drawing force increases sharply was taken as the breaking critical load, from which the breaking critical load ratio was calculated by the following equation.

$$\text{Breaking critical load ratio} = \frac{\text{Breaking critical load}}{\text{Tensile strength} \times \text{Sheet width} \times \text{Sheet thickness}}$$

The amounts of the film having an adhesion preventing function and the film having a rolling lubricating function were expressed in terms of metal amounts. The amounts of metals which had dissolved out from the undercoat plating and deposited could not be determined and hence not indicated in the Table.

TABLE 8(a)

| | Run No. | Plated sheet steel | Plating weight (Top face/ Bottom face) (g/m²) | Adhesion preventing function film (mg/m²) | Rolling lubricating function film (mg/m²) | Phosphatability | Press-formability: Friction coefficient | Press-formability: Breaking critical load ratio |
|---|---|---|---|---|---|---|---|---|
| Example 8(a) | 1 | EG | 20/20 | Mo 25, Co 1 | P 20 | o | 0.110 | |
| | 2 | EG | 40/40 | Cr 10, Ni 10 | P 13 | o | 0.156 | |
| | 3 | EG | 60/60 | Mn 8 | P 5 | o | 0.170 | 0.92 |
| | 4 | EG | 60/60 | Lower layer: Mn 7 Upper layer: Mn 1 | Lower layer: P 1 Upper layer P 4 | o | 0.149 | 1.05 |
| | 5 | EG | 60/60 | W 40 | P 30 | o | 0.133 | |
| | 6 | EG | 60/60 | Ca 8, Mn 10 | B 25 | o | 0.140 | |
| | 7 | EG | 60/60 | Mn 30 | P 10, Si 10 | o | 0.168 | |
| | 8 | AS | 60/60 | Mn 450 | P 420, Al 50 | o | 0.106 | |
| | 9 | AS | 60/60 | Lower layer Mo 150 Upper layer: Mn 50 | Lower layer: P 10, B 5 Upper layer: P 100, B 100 | o | 0.120 | 1.25 |
| | 10 | AS | 60/60 | Mo 200 | P 100, B 100 | o | 0.130 | 1.02 |
| | 11 | AS | 30/60 | Mn 45, Al 5 Ti 10 | P 30 | o | 0.170 | |
| | 12 | GI | 90/90 | Ni 10, V 3 | B 45, Ti 15 | o | 0.135 | |
| | 13 | GI | 120/120 | Mn 50, W 10 | Si 10, Ti 10 | o | 0.150 | |
| | 14 | Zn—Ni | 20/20 | Lower layer: | Lower layer: | o | 0.130 | 1.02 |

TABLE 8(a)-continued

| | Run No. | Plated sheet steel | Plating weight (Top face/ Bottom face) ($g/m^2$) | Adhesion preventing function film ($mg/m^2$) | Rolling lubricating function film ($mg/m^2$) | Phosphatability | Press-formability: Friction coefficient | Press-formability: Breaking critical load ratio |
|---|---|---|---|---|---|---|---|---|
| | | | | W 8, Co 4 Upper layer: W 2, Co 1 | trace Upper layer: Si 15 | | | |
| | 15 | Zn/Zn—Cr | 20/20 | Mn 10, Ca 4 | P 6, B 2 | o | 0.125 | |
| | 16 | Zn—Mn | 20/20 | Ni 3, Cr 1 | P 5 | o | 0.165 | |
| Comp. Example 8(a) | 1 | EG | 60/60 | No treatment | | o | 0.760 | 0.48 |
| | 2 | EG | 60/60 | Hot melt type solid lubricant 2 $g/m^2$ | | Δ | 0.180 | |
| | 3 | AS | 60/60 | No treatment | | o | 0.610 | 0.80 |
| | 4 | AS | 60/60 | Mo: 700 $mg/m^2$, P: 600 $mg/m^2$ | | Δ | 0.270 | |
| | 5 | Zn/Zn—Cr | 20/20 | No treatment | | o | 0.750 | |
| | 6 | Zn—Ni | 20/20 | " | | o | 0.500 | 0.82 |
| | 7 | Zn—Mn | 20/20 | " | | o | 0.650 | |

TABLE 8(b)

| | Run No. | Plated sheet steel | Plating weight (Top face/ Bottom face) ($g/m^2$) | Film forming method: Treatment conditions | Film forming method: Treatment liquid composition | Film formation and film amount ($g/m^2$) | Phosphatability | Press formability (Friction coefficient) |
|---|---|---|---|---|---|---|---|---|
| Example 8(b) | 1 | EG | 60/60 | Dipping 40° C. 3 sec | $KMnO_4$: 50 g/l $H_3PO_4$: 8 g/l $H_2SO_4$: 3 g/l $ZnCO_3$: 5 g/l pH = 1.5 | Mn: 12, P: 8 | o | 0.120 |
| | 2 | EG | 60/60 | Electrolysis 40° C. 2 $A/dm^2$ 1 sec | $KMnO_4$: 50 g/l $H_3PO_4$: 8 g/l $H_2SO_4$: 3 g/l $ZnCO_3$: 5 g/l pH = 1.5 | Mn: 48, P: 30 | o | 0.110 |
| | 3 | AS | 60/60 | Dipping 40° C. 5 sec | $KMnO_4$: 50 g/l $H_3PO_4$: 100 g/l Adjusted to pH 3 with NaOH | Lower layer: Mn: 10, P: 5 Upper layer: Mn: 4, P: 20 | o | 0.165 |
| | 4 | EG | 20/20 | Dipping 40° C. 5 sec | $(NH_4)_2MoO_4$: 50 g/l $H_3PO_4$: 10 g/l $H_2O_2$ = 3 g/l $H_2SO_4$: 5 g/l $CoSO_4$: 20 g/l pH = 1.2 | Mo: 25, Co: 1, P: 20 | o | 0.110 |
| | 5 | EG | 40/40 | Electrolysis 40° C. 5 $A/dm^2$ 1 sec | $Cr_2(SO_4)_3$: 50 g/l $Ni(NO_3)_2$: 50 g/l $H_3PO_4$: 15 g/l $Zn(NO_3)_2$: 50 g/l $HNO_3$: 1 g/l pH = 1.8 | Cr: 10, Ni: 10, P: 13 | o | 0.156 |
| | 6 | EG | 60/60 | Dipping 40° C. 3 sec | $K_2Wo_4$: 100 g/l $H_3PO_4$: 10 g/l $H_2SO_4$: 5 g/l $ZnCO_3$: 10 g/l pH = 1.2 | W: 40, P: 30 | o | 0.133 |
| | 7 | EG | 60/60 | Electrolysis | $Ca(NO_3)_2$: 250 g/l $KMnO_4$: 50 g/l | Ca: 8, Mn: 10, | o | 0.140 |

TABLE 8(b)-continued

| | Run No. | Plated sheet steel | Plating weight (Top face/ Bottom face) ($g/m^2$) | Film forming method: Treatment conditions | Film forming method: Treatment liquid composition | Film formation and film amount ($g/m^2$) | Phosphatability | Press formability (Friction coefficient) |
|---|---|---|---|---|---|---|---|---|
| | | | | 70° C.<br>8 $A/dm^2$<br>1 sec | $H_3BO_3$: 30 g/l<br>$Zn(NO_3)_2$: 50 g/l<br>$H_2SO_4$: 1 g/l<br>$HNO_3$: 1 g/l<br>pH = 2.5 | B: 25 | | |
| | 8 | AS | 30/60 | Dipping<br>40° C.<br>3 sec | $KMnO_4$: 50 g/l<br>$AlCl_3$: 10 g/l<br>$TiCl_3$: 15 g/l<br>$H_3PO_4$: 10 g/l<br>HCl: 10 g/l<br>pH = 1.0 | Mn: 45,<br>Al: 5,<br>Ti: 10,<br>P: 30 | o | 0.170 |
| | 9 | GI | 90/90 | Electrolysis<br>70° C.<br>8 $A/dm^2$<br>1 sec | $Na_3VO_4$: 30 g/l<br>$H_3BO_3$: 30 g/l<br>$TiO_2$ colloid: 10 g/l<br>$H_2SO_4$: 3 g/l<br>pH = 1.5 | V: 5,<br>B: 15,<br>Ti: 10 | o | 0.155 |
| | 10 | AS | 60/60 | Electrolysis<br>40° C.<br>5 $A/dm^2$<br>3 sec | $KMnO_4$: 60 g/l<br>$H_3PO_4$: 20 g/l<br>$H_2SO_4$: 3 g/l<br>$SiO_2$ colloid: 10 g/l<br>$Al_2O_3$ colloid: 10 g/l<br>pH = 1.5 | Mn: 400,<br>P: 360,<br>Al: 20,<br>Si: 20 | o | 0.133 |
| | 11 | AS | 60/60 | Dipping<br>40° C.<br>3 sec | $KMnO_4$: 60 g/l<br>$H_3PO_4$: 12 g/l<br>$H_2SO_4$: 3 g/l<br>$NaClO_3$: 10 g/l<br>pH = 1.2 | Mn: 250,<br>P 200 | o | 0.125 |
| | 12 | EG | 60/60 | Dipping<br>40° C.<br>5 sec | $(NH_4)_2MoO_4$: 50 g/l<br>$H_3PO_4$: 10 g/l<br>$H_2SO_4$: 5 g/l<br>$NiSO_4$: 20 g/l<br>$NaNO_2$: 20 g/l<br>pH = 1.2 | Mo: 400,<br>Ni: 20,<br>P: 110 | o | 0.150 |
| | 13 | EG | 60/60 | Dipping<br>40° C.<br>3 sec | $K_2WO_4$: 40 g/l<br>$H_3PO_4$: 100 g/l<br>$Ni(NO_3)_2$: 50 g/l<br>$Zn(NO_3)_2$: 20 g/l<br>pH = 1.8 | Lower layer:<br>W: 10,<br>Ni: 10,<br>P: 8<br>Upper layer:<br>W: 5,<br>Ni: 5,<br>P: 30 | o | 0.145 |
| | 14 | Zn/Zn—Cr | 20/20 | Dipping<br>40° C.<br>5 sec | $KMnO_4$: 50 g/l<br>$CaF_2$: 20 g/l<br>$H_3PO_4$: 10 g/l<br>$H_3BO_3$: 10 g/l<br>HCl: 1 g/l<br>pH = 2.0 | Mn: 10,<br>Ca: 4,<br>P: 6,<br>B: 6 | o | 0.125 |
| Comp. Example 8(b) | 1 | EG | 60/60 | | No treatment | | o | 0.760 |
| | 2 | EG | 60/60 | | Hot melt type solid lubricant 2 $g/m^2$ | | Δ | 0.180 |
| | 3 | AS | 60/60 | | No treatment | | o | 0.610 |
| | 4 | Zn/Zn—Cr | 20/20 | | " | | o | 0.750 |

Example IX (Weldability improvement by combined use of Zn oxide and Mn oxide)

An Example wherein a film was formed which comprised 3–500 $mg/m^2$ (as Zn) of Zn oxide, 5–500 $mg/m^2$ (as Mn) of Mn oxide and, as desired, 1,000 $mg/m^2$ or less (as boron or phosphorus) of boric acid or phosphoric acid and optionally other oxides and a comparative Example are shown in Table 9(a), Table 9(b) and Table 9(c).

The amounts of the oxides were determined by GDS (glow discharge spectroscopy) or ICAP (ion plasma emission analysis).

TABLE 9(a)

| | Run No. | Plated sheet steel | Plating weight Top face/ Bottom face) ($g/m^2$) | Film formed Zn film amount ($g/m^2$) | Film formed Mn film amount ($g/m^2$) | Weld-ability (Number of spots) | Phosphat-ability | Press form-ability coeffi-cient) |
|---|---|---|---|---|---|---|---|---|
| Example 9(a) | 1 | EG | 20/20 | 45 | 23 | 6000 | o | 0.138 |
| | 2 | EG | 40/40 | 10 | 7 | 6000 | o | 0.194 |
| | 3 | EG | 60/60 | 5 | 9 | 6000 | o | 0.195 |
| | 4 | EG | 60/60 | 15 | 24 | 6000 | o | 0.137 |
| | 5 | EG | 60/60 | 28 | 40 | 6000 | o | 0.143 |
| | 6 | EG | 60/60 | 181 | 87 | 6000 | o | 0.174 |
| | 7 | EG | 60/60 | 95 | 130 | 6000 | o | 0.182 |
| | 8 | AS | 60/60 | 460 | 453 | 6000 | o | 0.182 |
| | 9 | AS | 30/60 | 300 | 130 | 6000 | o | 0.153 |
| | 10 | AS | 45/45 | 47 | 154 | 6000 | o | 0.130 |
| | 11 | AS | 60/60 | 24 | 28 | 6000 | o | 0.131 |
| | 12 | GI | 90/90 | 30 | 32 | 6000 | o | 0.144 |
| | 13 | GI | 120/120 | 31 | 34 | 6000 | o | 0.144 |
| | 14 | HA | 60/60 | 28 | 29 | 6000 | o | 0.145 |
| | 15 | HA | 100/100 | 30 | 34 | 6000 | o | 0.139 |
| Comp. Example 9(a) | 1 | BG | 20/20 | 40 | — | 6000 | o | 0.948 |
| | 2 | EG | 60/60 | 550 | 640 | 2000 | Δ | 0.154 |
| | 3 | EG | 60/60 | — | 23(Cr) | 6000 | x | 0.182 |
| | 4 | AS | 60/60 | 105 | — | 6000 | o | 0.764 |
| | 5 | AS | 45/45 | — | 880 | 500 | Δ | 0.178 |
| | 6 | AS | 45/45 | 210 | — | 6000 | o | 0.870 |
| | 7 | HA | 60/60 | 110 | — | 6000 | o | 0.718 |
| | 8 | GI | 120/120 | 315 | — | 6000 | o | 0.755 |

TABLE 9(b)

| | Run No. | Plated sheet steel | Plating weight (Top face/ Bottom face) ($g/m^2$) | Film formed Zn film amount ($mg/m^2$) | Film formed Mn film amount ($mg/m^2$) | Film formed P Film amount ($mg/^2$) | Phosphat-ability | Press-formability (Friction coefficient) | Weldability (Number of spot) |
|---|---|---|---|---|---|---|---|---|---|
| Ex-ample 9(b) | 1 | EG | 20/20 | 45 | 23 | 14 | o | 0.106 | 6000 |
| | 2 | EG | 40/40 | 10 | 7 | 5 | o | 0.155 | 6000 |
| | 3 | EG | 60/60 | 5 | 9 | 2 | o | 0.155 | 6000 |
| | 4 | EG | 60/60 | 20 | 24 | 14 | o | 0.110 | 6000 |
| | 5 | EG | 60/60 | 30 | 40 | 35 | o | 0.114 | 6000 |
| | 6 | EG | 60/60 | 180 | 87 | 100 | o | 0.140 | 6000 |
| | 7 | EG | 60/60 | 95 | 130 | 550 | o | 0.146 | 6000 |
| | 8 | AS | 60/60 | 470 | 453 | 800 | o | 0.147 | 6000 |
| | 9 | AS | 30/60 | 300 | 130 | 70 | o | 0.120 | 6000 |
| | 10 | AS | 45/45 | 250 | 54 | 43 | o | 0.100 | 6000 |
| | 11 | AS | 60/60 | 50 | 28 | 32 | o | 0.105 | 6000 |
| | 12 | GI | 90/90 | 50 | 32 | 27 | o | 0.115 | 6000 |
| | 13 | GI | 120/120 | 50 | 34 | 28 | o | 0.115 | 6000 |
| | 14 | HA | 60/60 | 50 | 29 | 27 | o | 0.116 | 6000 |
| | 15 | HA | 100/100 | 50 | 34 | 27 | o | 0.111 | 6000 |
| Comp. Ex-ample 9(b) | 1 | EG | 20/20 | 50 | — | — | o | 0.948 | 6000 |
| | 2 | EG | 20/60 | <1 | 64 | 44 | o | 0.154 | 500 |
| | 3 | EG | 60/60 | Electro-lytic chromate | 23(Cr) | — | x | 0.182 | 6000 |
| | 4 | AS | 6060 | 800 | 700 | 1300 | Δ | 0.200 | 1000 |
| | 5 | AS | 45/45 | 50 | 880 | 300 | Δ | 0.178 | 4000 |
| | 6 | AS | 45/45 | 300 | — | 1500 | Δ | 0.382 | 1000 |
| | 7 | HA | 60/60 | 100 | — | — | o | 0.718 | 6000 |
| | 8 | GI | 120/120 | — | — | — | o | 0.755 | 500 |

TABLE 9(c)

| | Run No. | Plated sheet steel | Plating weight (Top face/ Bottom face) ($g/m^2$) | Film formed: Zn film amount ($mg/m^2$) | Mn film amount ($mg/m^2$) | Boric acid ($mg/^2$) | Phosphoric acid ($mg/m^2$) | Weldability (Number of spot) | Phosphatability | Pressformability (Friction coefficient) |
|---|---|---|---|---|---|---|---|---|---|---|
| Example 9(c) | 1 | EG | 20/20 | 45 | 23 | 10 | — | 6000 | o | 0.106 |
| | 2 | EG | 40/40 | 3 | 7 | 5 | — | 6000 | o | 0.155 |
| | 3 | EG | 60/60 | 5 | 9 | 2 | 5 | 6000 | o | 0.155 |
| | 4 | EG | 60/60 | 15 | 24 | 5 | 9 | 6000 | o | 0.110 |
| | 5 | EG | 60/60 | 28 | 40 | 10 | 27 | 6000 | o | 0.114 |
| | 6 | EG | 60/60 | 181 | 87 | 100 | — | 6000 | o | 0.140 |
| | 7 | EG | 60/60 | 95 | 130 | 150 | 400 | 6000 | o | 0.146 |
| | 8 | AS | 60/60 | 460 | 453 | 300 | 200 | 6000 | o | 0.147 |
| | 9 | AS | 30/60 | 300 | 130 | 70 | 20 | 6000 | o | 0.120 |
| | 10 | AS | 45/45 | 47 | 154 | 15 | — | 6000 | o | 0.100 |
| | 11 | AS | 60/60 | 24 | 28 | 10 | 18 | 6000 | o | 0.105 |
| | 12 | GI | 90/90 | 30 | 32 | 12 | 15 | 6000 | o | 0.115 |
| | 13 | GI | 120/120 | 31 | 34 | 8 | 12 | 6000 | o | 0.115 |
| | 14 | HA | 60/60 | 28 | 29 | 9 | 14 | 6000 | o | 0.116 |
| | 15 | HA | 100/100 | 30 | 34 | 10 | 13 | 6000 | o | 0.111 |
| Comp. Example 9(c) | 1 | EG | 20/20 | 40 | — | — | — | 6000 | o | 0.948 |
| | 2 | EG | 20/60 | — | 640 | 830 | — | 500 | Δ | 0.154 |
| | 3 | EG | 60/60 | Electrolytic chromate | 23(Cr) | — | — | 6000 | x | 0.182 |
| | 4 | AS | 60/60 | 105 | — | — | — | 6000 | o | 0.746 |
| | 5 | AS | 45/45 | — | 880 | 540 | 700 | 500 | Δ | 0.178 |
| | 6 | AS | 45/45 | 210 | — | — | — | 6000 | o | 0.412 |
| | 7 | HA | 60/60 | 110 | — | — | — | 6000 | o | 0.718 |
| | 8 | GI | 120/120 | — | 50 | 13 | 10 | 500 | o | 0.130 |

Example 10

An Example where on the surface of zinc-base galvanized sheet steel was coated 30–3,000 $mg/m^2$ (in terms of ZnO) of an oxide and further thereon, as the upper layer, was coated 1–500 $mg/m^2$ (in terms of the metal in the oxide) of at least one substance selected from Mn oxide, P oxide, Mo oxide, Co oxide, Ni oxide, Ca oxide, W oxide, and boric acid is shown in Table 10 along with a Comparative Example.

The ZnO film was formed by one of the following three methods.

Dipping: The galvanized sheet steel was dipped in an aqueous solution containing 400 g/l of $Zn(NO_3)_2 \cdot 6H_2O$ and 70 g/l of $HNO_3$ at 50° C. for 1–10 seconds to form the ZnO film.

Electrolysis: Electrolysis was conducted in an aqueous solution containing 400 g/l of $Zn(NO_3)_2 \cdot 6H_2O$ and 1 g/l of $HNO_3$ with the galvanized sheet steel used as the cathode at a current density of 7 $A/dm^2$ for 1–7 seconds to form the ZnO film.

Air-water spraying: Atomized water was injected at a rate of 80–125 l/min. to the surface of the galvanized sheet steel (at 500° C.) which had been subjected to alloying treatment, to form the ZnO film.

The upper layer oxide films were formed as follows.

The Mn oxide was formed by dipping the sheet steel to be treated in a solution at 30° C. containing 50 g/l of potassium permanganate, 10 g/l of phosphoric acid, 3 g/l of sulfuric acid and 5 g/l of zinc carbonate or conducting electrolysis in the solution with the sheet steel to be treated used as the cathode and a Pt electrode used as the anode at 7 $A/dm^2$ for 1.5 seconds, followed by water washing and drying.

The P oxide was formed by dipping the galvanized sheet steel in an aqueous solution containing 50 g/l of potassium phosphate and 10 g/l phosphoric acid or by an electrolytic treatment (5–10 $A/dm^2$, 1–1.5 seconds) in the solution with the sheet steel used as the cathode or the anode.

The Mo oxide was formed by dipping the sheet steel to be treated in a solution (at 30° C.) containing 50 g/l of ammonium molybdate and 10 g/l phosphoric acid or conducting electrolysis in the solution with the sheet steel used as the cathode and a Pt electrode used as the anode at 7 $A/dm^2$ for 1.5 seconds, followed by water washing and drying. In other Runs the oxide was formed by regulating the concentrations of ammonium molybdate and phosphoric acid, in some runs further adding sulfuric acid and zinc carbonate, and regulating the solution temperature, dipping time and coulombic amount.

The Co oxide was formed by conducting electrolysis in a solution containing 200 g/l of cobalt nitrate, 150 g/l zinc nitrate and 1 ml/l of concentrated nitric acid at 30° C. with the sheet steel to be treated used as the cathode and a Pt electrode used as the anode at 7 $A/dm^2$ for 1.5 seconds, followed by water washing and drying. In other Runs, the oxide was formed by regulating the concentrations of cobalt nitrate, zinc nitrate and nitric acid, further adding phosphoric acid, sulfuric acid and zinc carbonate in some Runs, and regulating the solution temperature and coulombic amount.

The Ni oxide was formed by conducting electrolysis in a solution containing 250 g/l of nickel nitrate, 150 g/l of zinc nitrate and 1 ml/l of concentrated nitric acid at 30° C. with the sheet steel to be treated used as the cathode and a Pt electrode used as the anode at 7 $A/dm^2$ for 1.5 seconds, followed by water washing and drying. In other Runs the oxide was formed by regulating the concentrations of nickel nitrate, zinc nitrate and nitric acid, adding further phosphoric acid, sulfuric acid and zinc carbonate in some Runs, and regulating the solution temperature and coulombic amount.

The Ca oxide was formed by conducting electrolysis in a solution containing 250 g/l of calcium nitrate and 1 ml/l of concentrated nitric acid at 30° C. with the sheet steel to be treated used as the cathode and a Pt electrode used as the anode at 7 A/dm$^2$ for 1.5 seconds, followed by water washing and drying; and further, regulating the concentrations of calcium nitrate and nitric acid, adding further phosphoric acid, sulfuric acid and zinc carbonate in some Runs, and regulating the solution temperature and coulombic amount.

The W oxide was formed by dipping the sheet steel to be treated in a solution at 30° C. containing 20 g/l of ammonium tungstate and 10 g/l of phosphoric acid or conducting electrolysis in the solution with the sheet steel used as the cathode and a Pt electrode as the anode at 7 A/dm$^2$ for 1.5 seconds, followed by water washing and drying; and further, regulating the concentrations of ammonium tungstate and phosphoric acid, adding further sulfuric acid and zinc carbonate in some Runs, and regulating the solution temperature, dipping time and coulombic amount.

The V oxide was formed by conducting electrolysis in an aqueous solution containing 30 g/l of ammonium vanadate and 10 g/l of phosphoric acid at 30° C. with the sheet steel to be treated used as the cathode and a Pt electrode used as the anode at 7 a/dm$^2$ for 1.5 seconds, followed by water washing and drying; and further, regulating the concentrations of ammonium vanadate and phosphoric acid, adding further sulfuric acid and zinc carbonate in some Runs, and regulating the solution temperature, electrolysis time and coulombic amount.

The boron oxide was formed by conducting electrolysis in an aqueous solution containing 50 g/l of boric acid with the zinc-base galvanized sheet steel used as the cathode under electrolytic conditions of 7 A/dm$^2$ and 1.5–7 seconds.

The Zn oxide was formed by an electrolytic treatment (5–10 A/dm$^2$, 1.0–1.5 seconds) in an aqueous solution containing 100–800 g/l of zinc nitrate and 5–60 g/l of phosphoric acid with the galvanized sheet steel used as the cathode or the anode or a dipping treatment in the solution, to form the oxide film.

The mixed oxide film was formed by preparing a treating bath incorporated with respective appropriate metal salts or acid described above.

TABLE 10(a)

| | | | | (Upper layer: Mn oxide) | | | | | |
|---|---|---|---|---|---|---|---|---|---|
| | | | | ZnO film formation | | | | | |
| | Run No. | Plated sheet steel | Plating weight (Top face/ Bottom face) (g/m$^2$) | Treating method | Film amount (mg/m$^2$) | Mn film amount*) (mg/m$^2$) | Phosphatability | Press formability (Friction coefficient) | Weldability |
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 6060 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental Mn.

TABLE 10(b)

(Upper layer: P oxide)

| | Run No. | Plated sheet steel | Plating weight (Top face/ Bottom face) (g/m²) | ZnO film formation: Treating method | ZnO film formation: Film amount (mg/m²) | P film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental P.

TABLE 10(c)

(Upper layer: Mo oxide)

| | Run No. | Plated sheet steel | Plating weight (Top face/ Bottom face) (g/m²) | ZnO film formation: Treating method | ZnO film formation: Film amount (mg/m²) | Mo film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |

TABLE 10(c)-continued

| | | | (Upper layer: Mo oxide) | | | | | |
|---|---|---|---|---|---|---|---|---|
| | | Plating weight (Top face/ | ZnO film formation | | | | Press form-ability (Fric- | |
| Run No. | Plated sheet steel | Bottom face) ($g/m^2$) | Treating method | Film amount ($mg/m^2$) | Mo film amount*) ($mg/m^2$) | Phos-phat-ability | tion coeffi-cient) | Weld-ability |
| 4 | AS | 60/60 | Air-water spray | 1000 | — | o | 0.382 | 6000< |
| 5 | AS | 45/45 | " | 700 | 880 | Δ | 0.178 | 6000< |
| 6 | AS | 30/30 | — | — | — | o | 0.268 | 500 |
| 7 | HA | 60/60 | Air-water spray | 1200 | — | o | 0.717 | 6000< |
| 8 | GI | 120/120 | Dipping | 350 | — | o | 0.755 | 6000< |
| 9 | Zn/Zn—Cr | 20/20 | — | — | — | o | 0.770 | 500 |

Note:
*)Expressed in terms of elemental Mo.

TABLE 10(d)

| | | | (Upper layer: Co oxide) | | | | | |
|---|---|---|---|---|---|---|---|---|
| | | Plating weight (Top face/ | ZnO film formation | | | | Press form-ability (Fric- | |
| | Run No. | Plated sheet steel | Bottom face) ($g/m^2$) | Treating method | Film amount ($mg/m^2$) | Co film amount*) ($mg/m^2$) | Phos-phat-ability | tion coeffi-cient) | Weld-ability |
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.70 | 500 |

Note:
*)Expressed in terms of elemental Co.

TABLE 10(e)

(Upper layer: Ni oxide)

| | Run No. | Plated sheet steel | Plating weight (Top face/ Bottom face) (g/m²) | ZnO film formation: Treating method | ZnO film formation: Film amount (mg/m²) | Ni film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.145 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental Ni.

TABLE 10(f)

(Upper layer: Ca oxide)

| | Run No. | Plated sheet steel | Plating weight (Top face/ Bottom face) (g/m²) | ZnO film formation: Treating method | ZnO film formation: Film amount (mg/m²) | Ca film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example 10 | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |

TABLE 10(f)-continued

| | | | (Upper layer: Ca oxide) | | | | | | |
|---|---|---|---|---|---|---|---|---|---|
| | | | | ZnO film formation | | | | | |
| | Run No. | Plated sheet steel | Plating weight (Top face/ Bottom face) ($g/m^2$) | Treating method | Film amount ($mg/m^2$) | Ca film amount*) ($mg/m^2$) | Phosphatability | Press formability (Friction coefficient) | Weldability |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental Ca.

TABLE 10(g)

| | | | (Upper layer: W oxide) | | | | | | |
|---|---|---|---|---|---|---|---|---|---|
| | | | | ZnO film formation | | | | | |
| | Run No. | Plated sheet steel | Plating weight (Top face/ Bottom face) ($g/m^2$) | Treating method | Film amount ($mg/m^2$) | W film amount*) ($mg/m^2$) | Phosphatability | Press formability (Friction coefficient) | Weldability |
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental W.

TABLE 10(h)

| | Run No. | Plated sheet steel | Plating weight (Top face/ Bottom face) (g/m²) | (Upper layer: V oxide) ZnO film formation: Treating method | ZnO film formation: Film amount (mg/m²) | V film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.145 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note:
*)Expressed in terms of elemental V.

TABLE 10(i)

| | Run No. | Plated sheet steel | Plating weight (Top face/ Bottom face) (g/m²) | (Upper layer: Boron oxide) ZnO film formation: Treating method | ZnO film formation: Film amount (mg/m²) | Boric oxide film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.145 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |

TABLE 10(i)-continued (Upper layer: Boron oxide)

| Run No. | Plated sheet steel | Plating weight (Top face/ Bottom face) ($g/m^2$) | ZnO film formation: Treating method | ZnO film formation: Film amount ($mg/m^2$) | Boric oxide film amount*) ($mg/m^2$) | Phosphatability | Press formability (Friction coefficient) | Weldability |
|---|---|---|---|---|---|---|---|---|
| 4 | AS | 60/60 | Air-water spray | 1000 | — | o | 0.382 | 6000< |
| 5 | AS | 45/45 | " | 700 | 880 | Δ | 0.178 | 6000< |
| 6 | AS | 30/30 | — | — | — | o | 0.268 | 500 |
| 7 | HA | 60/60 | Air-water spray | 1200 | — | o | 0.717 | 6000< |
| 8 | GI | 120/120 | Dipping | 350 | — | o | 0.755 | 6000< |
| 9 | Zn/Zn—Cr | 20/20 | — | — | — | o | 0.770 | 500 |

Note:
*)Expressed in terms of elemental B.

TABLE 10(j)

(Upper layer: Zn oxide- P oxide)

| | Run No. | Plated sheet steel | Plating weight (top face/ Bottom face) ($g/m^2$) | ZnO film formation: Treating method | ZnO film formation: Fiml amount ($mg/m^2$) | Oxide film amount*) ($mg/m^2$): Zn | Oxide film amount*) ($mg/m^2$): P | Phosphatability | Press formability (Friction coefficient) | Weldability |
|---|---|---|---|---|---|---|---|---|---|---|
| Example | 1 | EG | 20/20 | Dipping | 30 | 23 | 1 | o | 0.106 | 6000< |
| | 2 | EG | 40/40 | Electrolysis | 100 | 1 | 5 | o | 0.125 | 6000< |
| | 3 | EG | 60/60 | " | 300 | 7 | 8 | o | 0.120 | 6000< |
| | 4 | EG | 60/60 | " | 500 | 24 | 70 | o | 0.150 | 6000< |
| | 5 | EG | 60/60 | Dipping | 700 | 40 | 131 | o | 0.160 | 6000< |
| | 6 | EG | 60/60 | " | 1000 | 87 | 90 | o | 0.137 | 6000< |
| | 7 | EG | 60/60 | " | 1100 | 130 | 480 | o | 0.180 | 6000< |
| | 8 | AS | 60/60 | Air-water spray | 1800 | 483 | 200 | o | 0.193 | 6000< |
| | 9 | AS | 30/60 | " | 3000 | 154 | 303 | o | 0.172 | 6000< |
| | 10 | AS | 45/45 | " | 2000 | 328 | 500 | o | 0.210 | 6000< |
| | 11 | AS | 60/60 | " | 2200 | 432 | 30 | o | 0.201 | 6000< |
| | 12 | GI | 90/90 | Electrolysis | 1200 | 34 | 220 | o | 0.172 | 6000< |
| | 13 | GI | 120/120 | " | 1500 | 29 | 17 | o | 0.116 | 6000< |
| | 14 | HA | 60/60 | Air-water spray | 2800 | 40 | 18 | o | 0.115 | 6000< |
| | 15 | HA | 100/100 | " | 700 | 34 | 9 | o | 0.111 | 6000< |
| | 16 | Zn/Zn—Cr | 20/20 | Electrolysis | 200 | 60 | 40 | o | 0.115 | 6000< |
| Comp. Example | 1 | EG | 20/20 | Electrolysis | 300 | No treatment | | o | 0.948 | 500 |
| | 2 | EG | 60/60 | — | — | ZnO: 640 $mg/m^2$ | | Δ | 0.560 | 6000< |
| | 3 | EG | 60/60 | — | — | Electrolytic chromate (23 $mg/m^2$ as metallic Cr) | | x | 0.182 | 6000< |
| | 4 | AS | 60/60 | Air-water spray | 1000 | No treatment | | o | 0.768 | 1000 |
| | 5 | AS | 45/45 | " | 700 | ZnO: 880 $mg/m^2$ | | Δ | 0.600 | 6000< |
| | 6 | HA | 60/60 | " | 1200 | " | | o | 0.718 | 6000< |
| | 7 | GI | 120/120 | Dipping | 350 | " | | o | 0.755 | 6000< |
| | 8 | Zn/Zn—Cr | 20/20 | — | — | " | | o | 0.750 | 500 |

Note:
*)Expressed in terms of elemental Zn or P.

TABLE 10(k)

(Upper layer: Mn oxide- P oxide)

| | Run No. | Plated steel | Plating weight (top face/ Bottom face) (g/m²) | ZnO film formation: Treating method | ZnO film formation: Fiml amount (mg/m²) | Oxide film amount*) (mg/m²): Mn | Oxide film amount*) (mg/m²): P | Phosphatability | Press formability (Friction coefficient) | Weldability |
|---|---|---|---|---|---|---|---|---|---|---|
| Example | 1 | EG | 20/20 | Dipping | 30 | 23 | 1 | o | 0.106 | 6000< |
| | 2 | EG | 40/40 | Electrolysis | 100 | 1 | 5 | o | 0.155 | 6000< |
| | 3 | EG | 60/60 | " | 300 | 7 | 8 | o | 0.156 | 6000< |
| | 4 | EG | 60/60 | " | 500 | 24 | 70 | o | 0.110 | 6000< |
| | 5 | EG | 60/60 | Dipping | 700 | 40 | 131 | o | 0.114 | 6000< |
| | 6 | EG | 60/60 | " | 1000 | 87 | 90 | o | 0.137 | 6000< |
| | 7 | EG | 60/60 | " | 1100 | 130 | 280 | o | 0.140 | 6000< |
| | 8 | AS | 60/60 | Air-water spray | 1800 | 483 | 10 | o | 0.145 | 6000< |
| | 9 | AS | 30/60 | " | 3000 | 154 | 303 | o | 0.122 | 6000< |
| | 10 | AS | 45/45 | " | 2000 | 328 | 3 | o | 0.104 | 6000< |
| | 11 | AS | 60/60 | " | 2200 | 432 | 30 | o | 0.104 | 6000< |
| | 12 | GI | 90/90 | Electrolysis | 1200 | 34 | 220 | o | 0.115 | 6000< |
| | 13 | GI | 120/120 | " | 1500 | 29 | 17 | o | 0.116 | 6000< |
| | 14 | HA | 60/60 | Air-water spray | 2800 | 240 | 18 | o | 0.115 | 6000< |
| | 15 | HA | 100/100 | " | 700 | 34 | 9 | o | 0.111 | 6000< |
| | 16 | Zn/Zn—Cr | 20/20 | Electrolysis | 200 | 21 | 10 | o | 0.130 | 6000< |
| Comp. Example | 1 | EG | 20/20 | Electrolysis | 300 | No treatment | | o | 0.948 | 6000< |
| | 2 | EG | 60/60 | — | — | Mn: 640 mg/m² | | Δ | 0.154 | 500 |
| | 3 | EG | 60/60 | — | — | Electrolytic chromate (23 mg/m² as metallic Cr) | | x | 0.182 | 6000< |
| | 4 | AS | 60/60 | Air-water spray | 1000 | No treatment | | o | 0.382 | 6000< |
| | 5 | AS | 45/45 | " | 700 | Mn: 880 mg/m² | | Δ | 0.178 | 6000< |
| | 6 | AS | 30/30 | — | — | No treatment | | o | 0.268 | 500 |
| | 7 | HA | 60/60 | Air-water spray | 1200 | " | | o | 0.718 | 6000< |
| | 8 | GI | 120/120 | Dipping | 350 | " | | o | 0.755 | 6000< |
| | 9 | Zn/Zn—Cr | 20/20 | — | — | — | | o | 0.770 | 500 |

Note:
*)Expressed in terms of elemental Mn or P.

TABLE 10(l)

(Upper layer: Mn oxide- boric oxide)

| | Run No. | Plated steel | Plating weight (top face/ Bottom face) (g/m²) | ZnO film formation: Treating method | ZnO film formation: Fiml amount (mg/m²) | Oxide film amount*) (mg/m²): Mn | Oxide film amount*) (mg/m²): B | Phosphatability | Press formability (Friction coefficient) | Weldability |
|---|---|---|---|---|---|---|---|---|---|---|
| Example | 1 | EG | 20/20 | Dipping | 30 | 23 | 15 | o | 0.106 | 6000< |
| | 2 | EG | 40/40 | Electrolysis | 100 | 1 | 6 | o | 0.155 | 6000< |
| | 3 | EG | 60/60 | " | 300 | 7 | 1 | o | 0.156 | 6000< |
| | 4 | EG | 60/60 | " | 500 | 24 | 230 | o | 0.110 | 6000< |
| | 5 | EG | 60/60 | Dipping | 700 | 40 | 20 | o | 0.114 | 6000< |
| | 6 | EG | 60/60 | " | 1000 | 87 | 137 | o | 0.137 | 6000< |
| | 7 | EG | 60/60 | " | 1100 | 130 | 143 | o | 0.140 | 6000< |
| | 8 | AS | 60/60 | Air-water spray | 1800 | 483 | 3 | o | 0.145 | 6000< |
| | 9 | AS | 30/60 | " | 3000 | 154 | 200 | o | 0.122 | 6000< |
| | 10 | AS | 45/45 | " | 2000 | 328 | 5 | o | 0.104 | 6000< |
| | 11 | AS | 60/60 | " | 2200 | 432 | 15 | o | 0.104 | 6000< |
| | 12 | GI | 90/90 | Electrolysis | 1200 | 34 | 325 | o | 0.115 | 6000< |
| | 13 | GI | 120/120 | " | 1500 | 29 | 13 | o | 0.116 | 6000< |
| | 14 | HA | 60/60 | Air-water spray | 2800 | 240 | 5 | o | 0.115 | 6000< |
| | 15 | HA | 100/100 | " | 700 | 34 | 18 | o | 0.111 | 6000< |

TABLE 10(l)-continued

| | Run No. | Plated sheet steel | Plating weight (top face/ Bottom face) (g/m²) | ZnO film formation (Upper layer: Mn oxide- boric oxide) Treating method | Fiml amount (mg/m²) | Oxide film amount*) (mg/m²) Mn | B | Phosphatability | Press formability (Friction coefficient) | Weldability |
|---|---|---|---|---|---|---|---|---|---|---|
| | 16 | Zn/Zn—Cr | 20/20 | Electrolysis | 200 | 21 | 10 | o | 0.130 | 6000< |
| Comp. Example | 1 | EG | 20/20 | Electrolysis | 300 | No treatment | | o | 0.948 | 6000< |
| | 2 | EG | 60/60 | — | — | Mn: 640 mg/m² | | Δ | 0.154 | 500 |
| | 3 | EG | 60/60 | — | — | Electrolytic chromate (23 mg/m² as metallic Cr) | | x | 0.182 | 6000< |
| | 4 | AS | 60/60 | Air-water spray | 1000 | No treatment | | o | 0.382 | 6000< |
| | 5 | AS | 45/45 | " | 700 | Mn: 880 mg/m² | | Δ | 0.178 | 6000< |
| | 6 | AS | 30/30 | — | — | No treatment | | o | 0.268 | 500 |
| | 7 | HA | 60/60 | Air-water spray | 1200 | " | | o | 0.718 | 6000< |
| | 8 | GI | 120/120 | Dipping | 350 | " | | o | 0.755 | 6000< |
| | 9 | Zn/Zn—Cr | 20/20 | — | — | — | | o | 0.770 | 500 |

Note:
*)Expressed in terms of elemental Mn or B.

TABLE 10(m)

| | Run No. | Plated sheet steel | Plating weight (Top face/ Bottom face (g/m²) | ZnO film Formation (Upper layer: Mn oxide- P oxide- Mo oxide) Treating method | Film amount (mg/m²) | Oxide film amount*) (mg/m²) Mn | P | Mo | Phosphatability | Press-formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 5 | o | 0.155 | 6000< |
| | 3 | EG | 60/60 | " | 300 | 7 | 1 | 80 | o | 0.156 | 6000< |
| | 4 | EG | 60/60 | " | 500 | 24 | 230 | 8 | o | 0.110 | 6000< |
| | 5 | EG | 60/60 | Dipping | 700 | 40 | 33 | 35 | o | 0.114 | 6000< |
| | 6 | EG | 60/60 | " | 1000 | 87 | 137 | 200 | o | 0.137 | 6000< |
| | 7 | EG | 60/60 | " | 1100 | 130 | 80 | 333 | o | 0.140 | 6000< |
| | 8 | AS | 60/60 | Air-water spray | 1800 | 483 | 2 | 3 | o | 0.145 | 6000< |
| | 9 | AS | 30/60 | " | 3000 | 14 | 5 | 380 | o | 0.122 | 6000< |
| | 10 | AS | 45/45 | " | 2000 | 28 | 32 | 270 | o | 0.104 | 6000< |
| | 11 | AS | 60/60 | " | 2200 | 132 | 310 | 50 | o | 0.104 | 6000< |
| | 12 | GI | 90/90 | Electrolysis | 1200 | 34 | 170 | 215 | o | 0.115 | 6000< |
| | 13 | GI | 120/120 | " | 1500 | 29 | 45 | 3 | o | 0.115 | 6000< |
| | 14 | HA | 60/60 | Air-water spray | 2800 | 240 | 30 | 7 | o | 0.116 | 6000< |
| | 15 | HA | 100/100 | " | 700 | 34 | 5 | 118 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

TABLE 10(m)-continued (Upper layer: Mn oxide- P oxide- Mo oxide)

| Run No. | Plated sheet steel | Plating weight (Top face/ Bottom face (g/m²) | ZnO film Formation Treating method | Film amount (mg/m²) | Oxide film amount*) (mg/m²) Mn | P | Mo | Phosphatability | Press-formability (Friction coefficient) | Weldability |
|---|---|---|---|---|---|---|---|---|---|---|

Note:
*)Expressed in terms of elemental Mn, P or Mo.

TABLE 10(n)

(Upper layer: Mn oxide- P oxide- W oxide)

| | Run No. | Plated sheet steel | Plating weight (Top face/ Bottom face (g/m²) | ZnO film Formation Treating method | Film amount (mg/m²) | Oxide film amount*) (mg/m²) Mn | P | W | Phosphatability | Press-formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 12 | o | 0.155 | 6000< |
| | 3 | EG | 60/60 | " | 300 | 7 | 1 | 260 | o | 0.156 | 6000< |
| | 4 | EG | 60/60 | " | 500 | 24 | 230 | 120 | o | 0.110 | 6000< |
| | 5 | EG | 60/60 | Dipping | 700 | 40 | 33 | 4 | o | 0.114 | 6000< |
| | 6 | EG | 60/60 | " | 1000 | 87 | 147 | 200 | o | 0.137 | 6000< |
| | 7 | EG | 60/60 | " | 1100 | 3 | 8 | 480 | o | 0.140 | 6000< |
| | 8 | AS | 60/60 | Air-water spray | 1800 | 483 | 2 | 5 | o | 0.145 | 6000< |
| | 9 | AS | 30/60 | " | 3000 | 154 | 10 | 330 | o | 0.122 | 6000< |
| | 10 | AS | 45/45 | " | 2000 | 28 | 32 | 7 | o | 0.104 | 6000< |
| | 11 | AS | 60/60 | " | 2200 | 32 | 310 | 80 | o | 0.105 | 6000< |
| | 12 | GI | 90/90 | Electrolysis | 1200 | 34 | 270 | 20 | o | 0.115 | 6000< |
| | 13 | GI | 120/120 | " | 1500 | 29 | 45 | 180 | o | 0.115 | 6000< |
| | 14 | HA | 60/60 | Air-water spray | 2800 | 240 | 30 | 50 | o | 0.16 | 6000< |
| | 15 | HA | 100/100 | " | 700 | 34 | 5 | 370 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note:
*)Expressed in terms of elemental Mn, P or W.

TABLE 10(o)

(Upper layer: Mn oxide- P oxide- V oxide)

| | Run No. | Plated sheet steel | Plating weight (Top face/ Bottom face (g/m²) | ZnO film Formation Treating method | Film amount (mg/m²) | Oxide film amount*) (mg/m²) Mn | P | V | Phosphatability | Press-formability (Friction coefficient) | Weldability |
|---|---|---|---|---|---|---|---|---|---|---|---|
| Example | 1 | EG | 20/20 | Dipping | 30 | 23 | 18 | 70 | o | 0.106 | 6000< |

TABLE 10(o)-continued

| | Run No. | Plated steel | Plating weight (Top face/ Bottom face (g/m²) | (Upper layer: Mn oxide- P oxide- V oxide) ZnO film Formation: Treating method | Film amount (mg/m²) | Oxide film amount*) (mg/m²): Mn | P | V | Phosphatability | Press-formability (Friction coefficient) | Weldability |
|---|---|---|---|---|---|---|---|---|---|---|---|
| | 2 | EG | 40/40 | Electrolysis | 100 | 1 | 10 | 120 | o | 0.155 | 6000< |
| | 3 | EG | 60/60 | " | 300 | 7 | 1 | 1 | o | 0.156 | 6000< |
| | 4 | EG | 60/60 | " | 500 | 24 | 230 | 180 | o | 0.110 | 6000< |
| | 5 | EG | 60/60 | Dipping | 700 | 40 | 33 | 210 | o | 0.114 | 6000< |
| | 6 | EG | 60/60 | " | 1000 | 87 | 147 | 43 | o | 0.137 | 6000< |
| | 7 | EG | 60/60 | " | 1100 | 130 | 80 | 280 | o | 0.140 | 6000< |
| | 8 | AS | 60/60 | Air-water spray | 1800 | 483 | 2 | 10 | o | 0.145 | 6000< |
| | 9 | AS | 30/60 | " | 3000 | 154 | 200 | 5 | o | 0.122 | 6000< |
| | 10 | AS | 45/45 | " | 2000 | 28 | 32 | 380 | o | 0.104 | 6000< |
| | 11 | AS | 60/60 | " | 2200 | 32 | 310 | 4 | o | 0.104 | 6000< |
| | 12 | GI | 90/90 | Electrolysis | 1200 | 1 | 70 | 420 | o | 0.115 | 6000< |
| | 13 | GI | 120/120 | " | 1500 | 29 | 45 | 90 | o | 0.115 | 6000< |
| | 14 | HA | 60/60 | Air-water spray | 2800 | 240 | 30 | 100 | o | 0.116 | 6000< |
| | 15 | HA | 100/100 | " | 700 | 34 | 5 | 200 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note:
*)Expressed in terms of elemental Mn, P or W.

TABLE 10(p)

| | Run No. | Plated steel | Plating weight (Top face/ Bottom face) (g/m²) | (Upper layer: Mn oxide- P oxide- Ca oxide) ZnO film Formation: Treating method | Film amount (mg/m²) | Oxide film amount*) (mg/m²): Mn | P | Ca | Phosphat-ability | Press formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 120 | o | 0.155 | 6000< |
| | 3 | EG | 60/60 | " | 300 | 7 | 1 | 30 | o | 0.156 | 6000< |
| | 4 | EG | 60/60 | " | 500 | 24 | 230 | 160 | o | 0.110 | 6000< |
| | 5 | EG | 60/60 | Dipping | 700 | 40 | 33 | 80 | o | 0.114 | 6000< |
| | 6 | EG | 60/60 | " | 1000 | 87 | 147 | 12 | o | 0.137 | 6000< |
| | 7 | EG | 60/60 | " | 1100 | 130 | 80 | 210 | o | 0.140 | 6000< |
| | 8 | AS | 60/60 | Air-water spray | 1800 | 483 | 2 | 12 | o | 0.145 | 6000< |
| | 9 | AS | 30/60 | " | 3000 | 1 | 3 | 490 | o | 0.122 | 6000< |
| | 10 | AS | 45/45 | " | 2000 | 28 | 32 | 400 | o | 0.104 | 6000< |
| | 11 | AS | 60/60 | " | 2200 | 32 | 310 | 80 | o | 0.104 | 6000< |
| | 12 | GI | 90/90 | Electrolysis | 1200 | 34 | 70 | 280 | o | 0.115 | 6000< |
| | 13 | GI | 120/120 | " | 1500 | 29 | 45 | 300 | o | 0.115 | 6000< |
| | 14 | HA | 60/60 | Air-water spray | 2800 | 240 | 30 | 60 | o | 0.116 | 6000< |
| | 15 | HA | 100/100 | " | 700 | 34 | 5 | 50 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic | | | x | 0.182 | 6000< |

TABLE 10(p)-continued (Upper layer: Mn oxide- P oxide- Ca oxide)

| Run No. | Plated steel | Plating weight (Top face/ Bottom face) (g/m²) | ZnO film Formation: Treating method | Film amount (mg/m²) | Oxide film amount*) (mg/m²): Mn | P | Ca | Phosphat-ability | Press formability (Friction coefficient) | Weldability |
|---|---|---|---|---|---|---|---|---|---|---|
| | | | | | chromate (23 mg/m² as metallic Cr) | | | | | |
| 4 | AS | 60/60 | Air-water spray | 1000 | No treatment | | | o | 0.382 | 6000< |
| 5 | AS | 45/45 | " | 700 | Mn: 880 mg/m² | | | Δ | 0.178 | 6000< |
| 6 | AS | 30/30 | — | — | No treatment | | | o | 0.268 | 500 |
| 7 | HA | 60/60 | Air-water spray | 1200 | " | | | o | 0.718 | 6000< |
| 8 | GI | 120/120 | Dipping | 350 | " | | | o | 0.755 | 6000< |
| 9 | Zn/Zn—Cr | 20/20 | — | — | — | | | o | 0.770 | 500 |

Note:
*)Expressed in terms of elemental Mn, P or Ca.

TABLE 10(q)

(Upper layer: Mn oxide- P oxide- Co oxide)

| | Run No. | Plated steel | Plating weight (Top face/ Bottom face) (g/m²) | ZnO film Formation: Treating method | Film amount (mg/m²) | Oxide film amount*) (mg/m²): Mn | P | Co | Phosphat-ability | Press formability (Friction coefficient) | Weldability |
|---|---|---|---|---|---|---|---|---|---|---|---|
| Example | 1 | EG | 20/20 | Dipping | 30 | 23 | 18 | 5 | o | 0.106 | 6000< |
| | 2 | EG | 40/40 | Electrolysis | 100 | 1 | 10 | 200 | o | 0.155 | 6000< |
| | 3 | EG | 60/60 | " | 300 | 7 | 1 | 100 | o | 0.156 | 6000< |
| | 4 | EG | 60/60 | " | 500 | 24 | 230 | 1 | o | 0.110 | 6000< |
| | 5 | EG | 60/60 | Dipping | 700 | 40 | 33 | 30 | o | 0.114 | 6000< |
| | 6 | EG | 60/60 | " | 1000 | 87 | 147 | 80 | o | 0.137 | 6000< |
| | 7 | EG | 60/60 | " | 1100 | 130 | 80 | 180 | o | 0.140 | 6000< |
| | 8 | AS | 60/60 | Air-water spray | 1800 | 483 | 470 | 12 | o | 0.145 | 6000< |
| | 9 | AS | 30/60 | " | 3000 | 154 | 200 | 270 | o | 0.122 | 6000< |
| | 10 | AS | 45/45 | " | 2000 | 28 | 32 | 420 | o | 0.104 | 6000< |
| | 11 | AS | 60/60 | " | 2200 | 432 | 310 | 200 | o | 0.104 | 6000< |
| | 12 | GI | 90/90 | Electrolysis | 1200 | 34 | 270 | 310 | o | 0.115 | 6000< |
| | 13 | GI | 120/120 | " | 1500 | 29 | 45 | 490 | o | 0.115 | 6000< |
| | 14 | HA | 60/60 | Air-water spray | 2800 | 240 | 30 | 290 | o | 0.116 | 6000< |
| | 15 | HA | 100/100 | " | 700 | 34 | 5 | 10 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note:
*)Expressed in terms of elemental Mn, P or Co.

TABLE 10(r)

(Upper layer: Mn oxide- P oxide- Ni oxide)

| | Run No. | Plated steel | Plating weight (Top face/ Bottom face) ($g/m^2$) | ZnO film Formation: Treating method | Film amount ($mg/m^2$) | Oxide film amount*) ($mg/m^2$): Mn | P | Ni | Phosphat-ability | Press formability (Friction coefficient) | Weldability |
|---|---|---|---|---|---|---|---|---|---|---|---|
| Example | 1 | EG | 20/20 | Dipping | 30 | 23 | 18 | 10 | o | 0.106 | 6000< |
| | 2 | EG | 40/40 | Electrolysis | 100 | 1 | 10 | 50 | o | 0.155 | 6000< |
| | 3 | EG | 60/60 | " | 300 | 7 | 1 | 490 | o | 0.156 | 6000< |
| | 4 | EG | 60/60 | " | 500 | 24 | 230 | 30 | o | 0.156 | 6000< |
| | 5 | EG | 60/60 | Dipping | 700 | 40 | 33 | 1 | o | 0.114 | 6000< |
| | 6 | EG | 60/60 | " | 1000 | 87 | 147 | 5 | o | 0.137 | 6000< |
| | 7 | EG | 60/60 | " | 1100 | 130 | 80 | 60 | o | 0.140 | 6000< |
| | 8 | AS | 60/60 | Air-water spray | 1800 | 483 | 2 | 5 | o | 0.145 | 6000< |
| | 9 | AS | 30/60 | " | 3000 | 154 | 200 | 80 | o | 0.122 | 6000< |
| | 10 | AS | 45/45 | " | 2000 | 28 | 32 | 100 | o | 0.104 | 6000< |
| | 11 | AS | 60/60 | " | 2200 | 32 | 310 | 30 | o | 0.104 | 6000< |
| | 12 | GI | 90/90 | Electrolysis | 1200 | 34 | 270 | 10 | o | 0.115 | 6000< |
| | 13 | GI | 120/120 | " | 1500 | 29 | 45 | 5 | o | 0.115 | 6000< |
| | 14 | HA | 60/60 | Air-water spray | 2800 | 40 | 30 | 26 | o | 0.116 | 6000< |
| | 15 | HA | 100/100 | " | 700 | 34 | 5 | 50 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 $mg/m^2$ | | | Δ | 0.154 | 500 |
| | 3 | EG | 60/60 | — | — | Electrolytic chromate (23 $mg/m^2$ as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 $mg/m^2$ | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note:
*)Expressed in terms of elemental Mn, P or Ni.

TABLE 10(s)

(Upper layer: Mn oxide- P oxide- at least one of $SiO_2$, $TiO_2$ and $Al_2O_3$)

| | Run No. | Plated steel | Plating weight (Top face Bottom face) ($gm^2$) | ZnO film Formation: Treating method | Film amount ($mg/m^2$) | Oxide film amount*) ($mg/m^2$): Mn | P | $SiO_2$ | $TiO_2$ | $Al_2O_3$ | Phos-phat-ability | Press formability (Friction coefficient) | Weld-ability |
|---|---|---|---|---|---|---|---|---|---|---|---|---|---|
| Ex-ample | 1 | EG | 20/20 | Dipping | 30 | 23 | 18 | 5 | | | o | 0.106 | 6000< |
| | 2 | EG | 40/40 | Electrolysis | 100 | 1 | 10 | | 12 | | o | 0.155 | 6000< |
| | 3 | EG | 60/60 | " | 300 | 5 | 4 | | | 1 | o | 0.156 | 6000< |
| | 4 | EG | 60/60 | " | 500 | 24 | 30 | 8 | | | o | 0.110 | 6000< |
| | 5 | EG | 60/60 | Dipping | 700 | 240 | 33 | | 4 | | o | 0.114 | 6000< |
| | 6 | EG | 60/60 | " | 1000 | 87 | 147 | | | 10 | o | 0.137 | 6000< |
| | 7 | EG | 60/60 | " | 1100 | 130 | 80 | 33 | | | o | 0.140 | 6000< |
| | 8 | AS | 60/60 | Air-water spray | 1800 | 453 | 2 | 3 | | | o | 0.145 | 6000< |
| | 9 | AS | 30/60 | " | 3000 | 10 | 430 | | 5 | 43 | o | 0.122 | 6000< |
| | 10 | AS | 45/45 | " | 2000 | 28 | 32 | 10 | 7 | | o | 0.104 | 6000< |
| | 11 | AS | 60/60 | " | 2200 | 32 | 10 | 23 | 1 | 4 | o | 0.104 | 6000< |
| | 12 | GI | 90/90 | Electrolysis | 1200 | 329 | 70 | 15 | | | o | 0.115 | 6000< |
| | 13 | GI | 120/120 | " | 1500 | 40 | 45 | 3 | | | o | 0.115 | 6000< |
| | 14 | HA | 60/60 | Air-water spray | 2800 | 32 | 30 | 7 | 2 | 1 | o | 0.116 | 6000< |
| | 15 | HA | 100/100 | " | 700 | 34 | 5 | 18 | | | o | 0.111 | 6000< |
| | 16 | Zn/Zn—Cr | 20/20 | Electrolysis | 200 | 30 | 10 | 20 | 3 | 2 | o | 0.130 | 6000< |
| Comp. Ex- | 1 | EG | 20/20 | Electrolysis | 300 | No treatment | | | | | o | 0.948 | 6000< |
| | 2 | EG | 60/60 | — | — | Mn: 640 $mg/m^2$ | | | | | Δ | 0.154 | 500 |

TABLE 10(s)-continued (Upper layer: Mn oxide- P oxide- at least one of $SiO_2$, $TiO_2$ and $Al_2O_3$)

| | Run No. | Plated sheet steel | Plating weight (Top face Bottom face) ($gm^2$) | ZnO film Formation Treating method | Film amount ($mg/m^2$) | Oxide film amount*) ($mg/m^2$) Mn | P | $SiO_2$ | $TiO_2$ | $Al_2O_3$ | Phosphatability | Press formability (Friction coefficient) | Weldability |
|---|---|---|---|---|---|---|---|---|---|---|---|---|---|
| ample | 3 | EG | 60/60 | — | — | Electrolytic chromate (23 $mg/m^2$ as metallic Cr) | | | | | x | 0.182 | 6000< |
| | 4 | AS | 60/60 | Air-water spray | 1000 | No treatment | | | | | o | 0.382 | 6000< |
| | 5 | AS | 45/45 | " | 700 | Mn: 880 $mg/m^2$ | | | | | Δ | 0.178 | 6000< |
| | 6 | AS | 30/30 | — | — | No treatment | | | | | o | 0.268 | 500 |
| | 7 | HA | 60/60 | Air-water spray | 1200 | " | | | | | o | 0.718 | 6000< |
| | 8 | GI | 120/120 | Dipping | 350 | " | | | | | o | 0.755 | 6000< |
| | 9 | Zn/Zn—Cr | 20/20 | — | — | — | | | | | o | 0.770 | 500 |

Note:
*)Expressed in terms of weight of element for Mn and P, and in terms of weight of oxide for $SiO_2$, $TiO_2$ and $Al_2O_3$.

TABLE 10(t)

(Upper layer: mixed oxide)

| | Run No. | Plated sheet steel | Plating weight (Top face Bottom face) ($gm^2$) | ZnO film Formation Treating method | Film amount ($mg/m^2$) | Oxide film amount*) ($mg/m^2$) Mn | Mo | W | V | Ni | Ca |
|---|---|---|---|---|---|---|---|---|---|---|---|
| Example | 1 | EG | 20/20 | Dipping | 30 | | | | | | |
| | 2 | EG | 40/40 | Electrolysis | 100 | | 80 | | | | |
| | 3 | EG | 60/60 | " | 300 | 10 | | | | | |
| | 4 | EG | 60/60 | " | 500 | | 5 | 5 | 5 | | |
| | 5 | EG | 60/60 | Dipping | 700 | | | 40 | | | |
| | 6 | EG | 60/60 | " | 1000 | | | | | 50 | |
| | 7 | EG | 60/60 | " | 1100 | 300 | | | | 50 | |
| | 8 | AS | 60/60 | Air-water spray | 1800 | | | | | 20 | |
| | 9 | AS | 30/60 | " | 3000 | | 20 | | | 10 | |
| | 10 | AS | 45/45 | " | 2000 | | | | | | |
| | 11 | AS | 60/60 | " | 2200 | 100 | | | | | |
| | 12 | GI | 90/90 | Electrolysis | 1200 | | | | | 50 | 5 |
| | 13 | GI | 120/120 | " | 1500 | 100 | | 20 | | | |
| | 14 | HA | 60/60 | Air-water spray | 2800 | | 100 | | | | |
| | 15 | HA | 100/100 | " | 700 | | | | 50 | | |
| | 16 | Zn/Zn—Cr | 20/20 | Electrolysis | 200 | | 20 | 10 | | | |
| Comp. Example | 1 | EG | 20/20 | Electrolysis | 300 | | | | | | |
| | 2 | EG | 60/60 | — | — | | | | | | |
| | 3 | EG | 60/60 | — | — | | | | | | |
| | 4 | AS | 60/60 | Air-water spray | 1000 | | | | | | |
| | 5 | AS | 45/45 | " | 700 | | | | | | |
| | 6 | AS | 30/30 | — | — | | | | | | |
| | 7 | HA | 60/60 | Air-water spray | 1200 | | | | | | |
| | 8 | GI | 120/120 | Dipping | 350 | | | | | | |
| | 9 | Zn/Zn—Cr | 20/20 | — | — | | | | | | |

| | Run No. | Oxide film amount*) ($mg/m^2$) Co | P | B | $Al_2O_3$ | $TiO_2$ | $SiO_2$ | Phosphatability | Press formability (Friction coefficient) | Weldability |
|---|---|---|---|---|---|---|---|---|---|---|
| Example | 1 | | 100 | 20 | | | | o | 0.106 | 6000< |
| | 2 | | 50 | | | | | o | 0.155 | 6000< |
| | 3 | | 20 | 5 | | | | o | 0.156 | 6000< |
| | 4 | | 20 | | | | | o | 0.110 | 6000< |
| | 5 | | 200 | | | | | o | 0.114 | 6000< |

TABLE 10(t)-continued

| | | | | | | | | | | |
|---|---|---|---|---|---|---|---|---|---|---|
| | | | | | (Upper layer: mixed oxide) | | | | | |
| | 6 | | 300 | | | | | ○ | 0.137 | 6000< |
| | 7 | | | | | | | ○ | 0.140 | 6000< |
| | 8 | | 150 | 50 | | | | ○ | 0.145 | 6000< |
| | 9 | | | | | | | ○ | 0.122 | 6000< |
| | 10 | | 50 | 100 | | | | ○ | 0.104 | 6000< |
| | 11 | | 50 | 30 | | | | ○ | 0.104 | 6000< |
| | 12 | | | 10 | 30 | | | ○ | 0.115 | 6000< |
| | 13 | | | | | 20 | | ○ | 0.115 | 6000< |
| | 14 | 20 | | | | | 5 | ○ | 0.116 | 6000< |
| | 15 | | 150 | | | | | ○ | 0.111 | 6000< |
| | 16 | | 100 | | | | | ○ | 0.130 | 6000< |
| Comp. | 1 | | | | | | | ○ | 0.948 | 6000< |
| Example | 2 | | | | | | | Δ | 0.154 | 500 |
| | 3 | | | | | | | x | 0.182 | 6000< |
| | 4 | | | | | | | ○ | 0.382 | 6000< |
| | 5 | | | | | | | Δ | 0.178 | 6000< |
| | 6 | | | | | | | ○ | 0.268 | 500 |
| | 7 | | | | | | | ○ | 0.718 | 6000< |
| | 8 | | | | | | | ○ | 0.755 | 6000< |
| | 9 | | | | | | | ○ | 0.770 | 500 |

Note:
*)Expressed in terms of weight of element for Co, P and B, and in terms of weight of oxide for $Al_2O_3$ $TiO_2$ and $SiO_2$.

Example 11

An Example of the present invention wherein zinc oxide was formed on the surface of zinc-base galvanized sheet steel and further thereon, as the upper layer, was formed a film comprising oxides by using an acidic aqueous solution of a pH of 5 or less which contains at least one member selected from ions of metals including Mn, Mo, Co, Ni, Ca, V, W, Ti, and Al and oxoacids containing P or B is shown in Tables 11 along with a Comparative Example.

The ZnO film was formed by one of the following three methods.

Dipping: The galvanized sheet steel was dipped in an aqueous solution containing 400 g/l $Zn(NO_3)_2 \cdot 6H_2O$ and 70 g/l of $HNO_3$ at 50° C. for 1–10 seconds to form the ZnO film.

Electrolysis: Electrolysis was conducted in an aqueous solution containing 400 g/l of $Zn(NO_3)_2 \cdot 6H_2O$ and 1 g/l of $HNO_3$ with the galvanized sheet steel used as the cathode at a current density of 7 A/dm$^2$ for 1–7 seconds to form the ZnO film.

Air-water spraying: Atomized water was injected at a rate of 80–125 l/min. to the surface of the galvanized sheet steel (at 500° C.) which had been subjected to alloying treatment, to form the ZnO film.

The upper layer oxide films were formed as follows.

The Mn oxide was formed by dipping the sheet steel to be treated in a solution at 30° C. containing 50 g/l of potassium permanganate, 10 g/l of phosphoric acid, 3 g/l sulfuric acid and 5 g/l of zinc carbonate or conducting electrolysis in the solution with the sheet steel used as the cathode and a Pt electrode used as the anode at 7 A/dm$^2$ for 1.5 seconds, followed by water washing and drying.

The P oxide was formed by dipping the zinc-base galvanized sheet steel in an aqueous solution containing 50 g/l of potassium phosphate and 10 g/l of phosphoric acid or by an electrolytic treatment (5–10 A/dm$^2$, 1–1.5 seconds) in the solution with the sheet steel used as the cathode or the anode.

The Mo oxide was formed by dipping the sheet steel to be treated in a solution (at 30° C.) containing 50 g/l of ammonium molybdate and 10 g/l of phosphoric acid or conducting electrolysis in the solution with the sheet steel used as the cathode and a Pt electrode used as the anode at 7A/dm$^2$ for 1.5 seconds, followed by water washing and drying. In other Runs the oxide was formed by regulating the concentrations of ammonium molybdate and phosphoric acid, in some runs further adding sulfuric acid and zinc carbonate, and regulating the solution temperature, dipping time and coulombic amount.

The Co oxide was formed by conducting electrolysis in a solution containing 200 g/l of cobalt nitrate, 150 g/l of zinc nitrate and 1 ml/l of concentrated nitric acid at 30° C. with the sheet steel to be treated used as the cathode and a Pt electrode used as the anode at 7A/dm$^2$ for 1.5 seconds, followed by water washing and drying. In other Runs, the oxide was formed by regulating the concentrations of cobalt nitrate, zinc nitrate and nitric acid, further adding phosphoric acid, sulfuric acid and zinc carbonate in some Runs, and regulating the solution temperature and coulombic amount.

The Ni oxide was formed by conducting electrolysis in a solution containing 250 g/l of nickel nitrate, 150 g/l of zinc nitrate and 1 ml/l of concentrated nitric acid at 30° C. with the sheet steel to be treated used as the cathode and a Pt electrode used as the anode at 7A/dm$^2$ for 1.5 seconds, followed by water washing and drying. In other Runs the oxide was formed by regulating the concentrations of nickel nitrate, zinc nitrate and nitric acid, adding further phosphoric acid, sulfuric acid and zinc carbonate in some Runs, and regulating the solution temperature and coulombic amount.

The Ca oxide was formed by conducting electrolysis in a solution containing 250 g/l of calcium nitrate and 1 ml of concentrated nitric acid at 30° C. with the sheet steel to be treated used as the cathode and a Pt electrode used as the anode at 7 A/dm$^2$ for 1.5 seconds, followed by water washing and drying; and further, regulating the concentrations of calcium nitrate and nitric acid, adding further phosphoric acid, sulfuric acid and zinc carbonate in some Runs, and regulating the solution temperature and coulombic amount.

The W oxide was formed by dipping the sheet steel to be treated in a solution (at 30° C.) containing 20 g/l of ammonium tungstate and 10 g/l of phosphoric acid or conducting electrolysis in the solution with the sheet steel used as the cathode and a Pt electrode used as the anode at 7 A/dm$^2$ for 1.5 seconds, followed by water washing and drying; and further, regulating the concentrations of ammonium tungstate and phosphoric acid, adding further sulfuric acid and zinc carbonate in some Runs, and regulating the solution concentration, dipping time and coulombic amount.

The V oxide was formed by conducting electrolysis in an aqueous solution containing 30 g/l of ammonium vanadate and 10 g/l of phosphoric acid at 30° C. with the sheet steel to be treated used as the cathode and a Pt electrode used as the anode at 7 A/dm$^2$ for 1.5 seconds, followed by water washing and drying; and further, regulating the concentrations of ammonium vanadate and phosphoric acid, adding further sulfuric acid and zinc carbonate in some Runs, and regulating the solution temperature, electrolysis time and coulombic amount.

The boron oxide was formed by conducting electrolysis in an aqueous solution containing 50 g/l of boric acid with the zinc-base galvanized sheet steel used as the cathode under the electrolytic conditions of 7 A/dm$^2$ and 1.5–7 seconds.

The mixed oxide film was formed by preparing a treating bath incorporated with respective appropriate metal salts or acids mentioned above.

TABLE 11

(Upper layer: Mn oxide)

| | Run No. | Plated sheet steel | Plating weight (Top face/ Bottom face) (g/m$^2$) | ZnO film formation: Treating method | ZnO film formation: Film amount (mg/m$^2$) | Mn film amount*) (mg/m$^2$) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental Mn.

(Upper layer: P oxide)

| | Run No. | Plated sheet steel | Plating weight (Top face/ Bottom face) (g/m$^2$) | ZnO film formation: Treating method | ZnO film formation: Film amount (mg/m$^2$) | P film amount*) (mg/m$^2$) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |

TABLE 11-continued

| | | | | | | | | | |
|---|---|---|---|---|---|---|---|---|---|
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental P.

(Upper layer: Mo oxide)

| | Run No. | Plated sheet steel | Plating weight (Top face/ Bottom face) (g/m²) | ZnO film formation: Treating method | ZnO film formation: Film amount (mg/m²) | Mo film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | " | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental Mo.

(Upper layer: Co oxide)

| | Run No. | Plated sheet steel | Plating weight (Top face/ Bottom face) (g/m²) | ZnO film formation: Treating method | ZnO film formation: Film amount (mg/m²) | Co film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |

TABLE 11-continued

| | | | | | | | | | |
|---|---|---|---|---|---|---|---|---|---|
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental Co.

(Upper layer: Ni oxide)

| | Run No. | Plated sheet steel | Plating weight (Top face/ Bottom face) (g/m²) | ZnO film formation: Treating method | ZnO film formation: Film amount (mg/m²) | Ni film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.145 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental Ni.

(Upper layer: Ca oxide)

| | Run No. | Plated sheet steel | Plating weight (Top face/ Bottom face) (g/m²) | ZnO film formation: Treating method | ZnO film formation: Film amount (mg/m²) | Ca film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example 10(b) | 1 | EG | 20/20 | Electrolysis | 300 | — | o | 0.948 | 6000< |
| | 2 | EG | 60/60 | " | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental Ca.

TABLE 11-continued (Upper layer: W oxide)

| | Run No. | Plated sheet steel | Plating weight (Top face/ Bottom face) (g/m²) | ZnO film formation: Treating method | ZnO film formation: Film amount (mg/m²) | W film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | " | — | 640 | Δ | 0.154 | 500 |
| | 3 | EG | 60/60 | " | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental W.

(Upper layer: V oxide)

| | Run No. | Plated sheet steel | Plating weight (Top face/ Bottom face) (g/m²) | ZnO film formation: Treating method | ZnO film formation: Film amount (mg/m²) | V film amount*) (mg/m²) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental V.

TABLE 11-continued (Upper layer: boron oxide)

| | Run No. | Plated sheet steel | Plating weight (Top face/ Bottom face) ($g/m^2$) | ZnO film formation: Treating method | ZnO film formation: Film amount ($mg/m^2$) | Boric acid film amount*) ($mg/m^2$) | Phosphatability | Press formability (Friction coefficient) | Weldability |
|---|---|---|---|---|---|---|---|---|---|
| Example | 1 | EG | 20/20 | Dipping | 30 | 23 | o | 0.133 | 6000< |
| | 2 | EG | 40/40 | Electrolysis | 100 | 1 | o | 0.194 | 6000< |
| | 3 | EG | 60/60 | " | 300 | 7 | o | 0.195 | 6000< |
| | 4 | EG | 60/60 | " | 500 | 24 | o | 0.137 | 6000< |
| | 5 | EG | 60/60 | Dipping | 700 | 40 | o | 0.143 | 6000< |
| | 6 | EG | 60/60 | " | 1000 | 87 | o | 0.171 | 6000< |
| | 7 | EG | 60/60 | " | 1100 | 130 | o | 0.176 | 6000< |
| | 8 | AS | 60/60 | Air-water spray | 1800 | 453 | o | 0.182 | 6000< |
| | 9 | AS | 30/60 | " | 3000 | 230 | o | 0.153 | 6000< |
| | 10 | AS | 45/45 | " | 2000 | 54 | o | 0.130 | 6000< |
| | 11 | AS | 60/60 | " | 2200 | 28 | o | 0.131 | 6000< |
| | 12 | GI | 90/90 | Electrolysis | 1200 | 32 | o | 0.144 | 6000< |
| | 13 | GI | 120/120 | " | 1500 | 34 | o | 0.144 | 6000< |
| | 14 | HA | 60/60 | Air-water spray | 2800 | 29 | o | 0.145 | 6000< |
| | 15 | HA | 100/100 | " | 700 | 34 | o | 0.139 | 6000< |
| | 16 | Zn/Zn—Cr | 20/20 | Electrolysis | 200 | 60 | o | 0.130 | 6000< |
| Comp. Example | 1 | EG | 20/20 | Electrolysis | 300 | — | o | 0.948 | 6000< |
| | 2 | EG | 60/60 | — | — | 640 | Δ | 0.154 | 500 |
| | 3 | EG | 60/60 | — | — | 23(Cr) | x | 0.182 | 6000< |
| | 4 | AS | 60/60 | Air-water spray | 1000 | — | o | 0.382 | 6000< |
| | 5 | AS | 45/45 | " | 700 | 880 | Δ | 0.178 | 6000< |
| | 6 | AS | 30/30 | — | — | — | o | 0.268 | 500 |
| | 7 | HA | 60/60 | Air-water spray | 1200 | — | o | 0.717 | 6000< |
| | 8 | GI | 120/120 | Dipping | 350 | — | o | 0.755 | 6000< |
| | 9 | Zn/Zn—Cr | 20/20 | — | — | — | o | 0.770 | 500 |

Note: *)Expressed in terms of elemental B.

(Upper layer: Mn oxide- P oxide)

| | Run No. | Plated sheet steel | Plating weight (Top face/ Bottom face) ($g/m^2$) | ZnO film formation: Treating method | ZnO film formation: Fiml amount ($mg/m^2$) | Oxide film amount*) ($mg/m^2$): Mn | Oxide film amount*) ($mg/m^2$): P | Phosphatability | Press formability (Friction coefficient) | Weldability |
|---|---|---|---|---|---|---|---|---|---|---|
| Example | 1 | EG | 20/20 | Dipping | 30 | 23 | 1 | o | 0.106 | 6000< |
| | 2 | EG | 40/40 | Electrolysis | 100 | 1 | 5 | o | 0.155 | 6000< |
| | 3 | EG | 60/60 | " | 300 | 7 | 8 | o | 0.156 | 6000< |
| | 4 | EG | 60/60 | " | 500 | 24 | 70 | o | 0.110 | 6000< |
| | 5 | EG | 60/60 | Dipping | 700 | 40 | 131 | o | 0.114 | 6000< |
| | 6 | EG | 60/60 | " | 1000 | 87 | 90 | o | 0.137 | 6000< |
| | 7 | EG | 60/60 | " | 1100 | 130 | 280 | o | 0.140 | 6000< |
| | 8 | AS | 60/60 | Air-water spray | 1800 | 453 | 10 | o | 0.145 | 6000< |
| | 9 | AS | 30/60 | " | 3000 | 230 | 303 | o | 0.122 | 6000< |
| | 10 | AS | 45/45 | " | 2000 | 54 | 3 | o | 0.104 | 6000< |
| | 11 | AS | 60/60 | " | 2200 | 28 | 30 | o | 0.104 | 6000< |
| | 12 | GI | 90/90 | Electrolysis | 1200 | 32 | 220 | o | 0.115 | 6000< |
| | 13 | GI | 120/120 | " | 1500 | 34 | 17 | o | 0.116 | 6000< |
| | 14 | HA | 60/60 | Air-water spray | 2800 | 29 | 18 | o | 0.115 | 6000< |
| | 15 | HA | 100/100 | " | 700 | 34 | 9 | o | 0.111 | 6000< |
| | 16 | Zn/Zn—Cr | 20/20 | Electrolysis | 200 | 60 | 10 | o | 0.130 | 6000< |
| Comp. Example | 1 | EG | 20/20 | Electrolysis | 300 | No treatment | | o | 0.948 | 6000< |
| | 2 | EG | 60/60 | — | — | Mn: 640 $mg/m^2$ | | Δ | 0.154 | 500 |
| | 3 | EG | 60/60 | — | — | Electrolytic chromate (23 $mg/m^2$ as metallic Cr) | | x | 0.182 | 6000< |
| | 4 | AS | 60/60 | Air-water spray | 1000 | No treatment | | o | 0.382 | 6000< |
| | 5 | AS | 45/45 | " | 700 | Mn: 880 $mg/m^2$ | | Δ | 0.178 | 6000< |
| | 6 | AS | 30/30 | — | — | No treatment | | o | 0.268 | 500 |
| | 7 | HA | 60/60 | Air-water spray | 1200 | " | | o | 0.718 | 6000< |
| | 8 | GI | 120/120 | Dipping | 350 | " | | o | 0.755 | 6000< |
| | 9 | Zn/Zn—Cr | 20/20 | — | — | — | | o | 0.770 | 500 |

Note: *)Expressed in terms of elemental Mn or P.

TABLE 11-continued (Upper layer: Mn oxide- boric oxide)

| | Run No. | Plated sheet steel | Plating weight (Top face/ Bottom face) (g/m²) | ZnO film formation: Treating method | ZnO film formation: Fiml amount (mg/m²) | Oxide film amount*) (mg/m²): Mn | Oxide film amount*) (mg/m²): B | Phosphatability | Press formability (Friction coefficient) | Weldability |
|---|---|---|---|---|---|---|---|---|---|---|
| Example | 1 | EG | 20/20 | Dipping | 30 | 23 | 15 | o | 0.106 | 6000< |
| | 2 | EG | 40/40 | Electrolysis | 100 | 1 | 6 | o | 0.155 | 6000< |
| | 3 | EG | 60/60 | " | 300 | 7 | 1 | o | 0.156 | 6000< |
| | 4 | EG | 60/60 | " | 500 | 24 | 230 | o | 0.110 | 6000< |
| | 5 | EG | 60/60 | Dipping | 700 | 40 | 20 | o | 0.114 | 6000< |
| | 6 | EG | 60/60 | " | 1000 | 87 | 137 | o | 0.137 | 6000< |
| | 7 | EG | 60/60 | " | 1100 | 130 | 143 | o | 0.140 | 6000< |
| | 8 | AS | 60/60 | Air-water spray | 1800 | 453 | 3 | o | 0.145 | 6000< |
| | 9 | AS | 30/60 | " | 3000 | 230 | 200 | o | 0.122 | 6000< |
| | 10 | AS | 45/45 | " | 2000 | 54 | 5 | o | 0.104 | 6000< |
| | 11 | AS | 60/60 | " | 2200 | 28 | 15 | o | 0.104 | 6000< |
| | 12 | GI | 90/90 | Electrolysis | 1200 | 32 | 325 | o | 0.115 | 6000< |
| | 13 | GI | 120/120 | " | 1500 | 34 | 13 | o | 0.116 | 6000< |
| | 14 | HA | 60/60 | Air-water spray | 2800 | 29 | 5 | o | 0.115 | 6000< |
| | 15 | HA | 100/100 | " | 700 | 34 | 18 | o | 0.111 | 6000< |
| | 16 | Zn/Zn—Cr | 20/20 | Electrolysis | 200 | 60 | 10 | o | 0.130 | 6000< |
| Comp. Example | 1 | EG | 20/20 | Electrolysis | 300 | No treatment | | o | 0.948 | 6000< |
| | 2 | EG | 60/60 | — | — | Mn: 640 mg/m² | | Δ | 0.154 | 500 |
| | 3 | EG | 60/60 | — | — | Electrolytic chromate 2 (23 mg/m² as metallic Cr) | | x | 0.182 | 6000< |
| | 4 | AS | 60/60 | Air-water spray | 1000 | No treatment | | o | 0.382 | 6000< |
| | 5 | AS | 45/45 | " | 700 | Mn: 880 mg/m² | | Δ | 0.178 | 6000< |
| | 6 | AS | 30/30 | — | — | No treatment | | o | 0.268 | 500 |
| | 7 | HA | 60/60 | Air-water spray | 1200 | " | | o | 0.718 | 6000< |
| | 8 | GI | 120/120 | Dipping | 350 | " | | o | 0.755 | 6000< |
| | 9 | Zn/Zn—Cr | 20/20 | — | — | — | | o | 0.770 | 500 |

Note: *)Expressed in terms of elemental Mn or B.

(Upper layer: Mn oxide- P oxide- Mo oxide)

| | Run No. | Plated sheet steel | Plating weight (Top face/ Bottom face) (g/m²) | ZnO film formation: Treating method | ZnO film formation: Fiml amount (mg/m²) | Oxide film amount*) (mg/m²): Mn | Oxide film amount*) (mg/m²): P | Oxide film amount*) (mg/m²): Mo | Phosphatability | Press formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 5 | o | 0.155 | 6000< |
| | 3 | EG | 60/60 | " | 300 | 7 | 1 | 80 | o | 0.156 | 6000< |
| | 4 | EG | 60/60 | " | 500 | 24 | 230 | 8 | o | 0.110 | 6000< |
| | 5 | EG | 60/60 | Dipping | 700 | 40 | 33 | 35 | o | 0.114 | 6000< |
| | 6 | EG | 60/60 | " | 1000 | 87 | 147 | 200 | o | 0.137 | 6000< |
| | 7 | EG | 60/60 | " | 1100 | 130 | 80 | 333 | o | 0.140 | 6000< |
| | 8 | AS | 60/60 | Air-water spray | 1800 | 483 | 2 | 3 | o | 0.145 | 6000< |
| | 9 | AS | 30/60 | " | 3000 | 14 | 5 | 380 | o | 0.122 | 6000< |
| | 10 | AS | 45/45 | " | 2000 | 28 | 32 | 270 | o | 0.104 | 6000< |
| | 11 | AS | 60/60 | " | 2200 | 132 | 310 | 50 | o | 0.104 | 6000< |
| | 12 | GI | 90/90 | Electrolysis | 1200 | 34 | 170 | 215 | o | 0.115 | 6000< |
| | 13 | GI | 120/120 | " | 1500 | 29 | 45 | 3 | o | 0.115 | 6000< |
| | 14 | HA | 60/60 | Air-water spray | 2800 | 240 | 30 | 7 | o | 0.116 | 6000< |
| | 15 | HA | 100/100 | " | 700 | 34 | 5 | 118 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |

TABLE 11-continued

| | | | | | | | | | | |
|---|---|---|---|---|---|---|---|---|---|---|
| | 8 | GI | 120/120 | Dipping | 350 | " | | o | 0.755 | 6000< |
| | 9 | Zn/Zn—Cr | 20/20 | — | — | — | | o | 0.770 | 500 |

Note: *)Expressed in terms of elemental Mn, P or Mo.

(Upper layer: Mn oxide- P oxide- W oxide)

| | Run No. | Plated sheet steel | Plating weight (Top face/Bottom face) (g/m²) | ZnO film formation: Treating method | Film amount (mg/m²) | Oxide film amount*) (mg/m²): Mn | P | W | Phosphatability | Press formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 12 | o | 0.155 | 6000< |
| | 3 | EG | 60/60 | " | 300 | 7 | 1 | 260 | o | 0.156 | 6000< |
| | 4 | EG | 60/60 | " | 500 | 24 | 230 | 120 | o | 0.110 | 6000< |
| | 5 | EG | 60/60 | Dipping | 700 | 40 | 33 | 4 | o | 0.114 | 6000< |
| | 6 | EG | 60/60 | " | 1000 | 87 | 147 | 200 | o | 0.137 | 6000< |
| | 7 | EG | 60/60 | " | 1100 | 3 | 8 | 480 | o | 0.140 | 6000< |
| | 8 | AS | 60/60 | Air-water spray | 1800 | 483 | 2 | 5 | o | 0.145 | 6000< |
| | 9 | AS | 30/60 | " | 3000 | 154 | 10 | 330 | o | 0.122 | 6000< |
| | 10 | AS | 45/45 | " | 2000 | 28 | 32 | 7 | o | 0.104 | 6000< |
| | 11 | AS | 60/60 | " | 2200 | 32 | 310 | 80 | o | 0.104 | 6000< |
| | 12 | GI | 90/90 | Electrolysis | 1200 | 34 | 270 | 20 | o | 0.115 | 6000< |
| | 13 | GI | 120/120 | " | 1500 | 29 | 45 | 180 | o | 0.115 | 6000< |
| | 14 | RA | 60/60 | Air-water spray | 2800 | 240 | 30 | 50 | o | 0.116 | 6000< |
| | 15 | HA | 100/100 | " | 700 | 34 | 5 | 370 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m² | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note: *)Expressed in terms of elemental Mn, P or W.

(Upper layer: Mn oxide- P oxide- V oxide)

| | Run No. | Plated sheet steel | Plating weight (Top face/Bottom face) (g/m²) | ZnO film formation: Treating method | Film amount (mg/m²) | Oxide film amount*) (mg/m²): Mn | P | V | Phosphatability | Press formability (Friction coefficient) | Weldability |
|---|---|---|---|---|---|---|---|---|---|---|---|
| Example | 1 | EG | 20/20 | Dipping | 30 | 23 | 18 | 70 | o | 0.106 | 6000< |
| | 2 | EG | 40/40 | Electrolysis | 100 | 1 | 10 | 120 | o | 0.155 | 6000< |
| | 3 | EG | 60/60 | " | 300 | 7 | 1 | 1 | o | 0.156 | 6000< |
| | 4 | EG | 60/60 | " | 500 | 24 | 230 | 180 | o | 0.110 | 6000< |
| | 5 | EG | 60/60 | Dipping | 700 | 40 | 33 | 210 | o | 0.114 | 6000< |
| | 6 | EG | 60/60 | " | 1000 | 87 | 147 | 43 | o | 0.137 | 6000< |
| | 7 | EG | 60/60 | " | 1100 | 130 | 80 | 280 | o | 0.140 | 6000< |
| | 8 | AS | 60/60 | Air-water spray | 1800 | 483 | 2 | 10 | o | 0.145 | 6000< |
| | 9 | AS | 30/60 | " | 3000 | 154 | 200 | 5 | o | 0.122 | 6000< |
| | 10 | AS | 45/45 | " | 2000 | 28 | 32 | 380 | o | 0.104 | 6000< |
| | 11 | AS | 60/60 | " | 2200 | 32 | 310 | 4 | o | 0.104 | 6000< |
| | 12 | GI | 90/90 | Electrolysis | 1200 | 1 | 70 | 420 | o | 0.115 | 6000< |
| | 13 | GI | 120/120 | " | 1500 | 29 | 45 | 90 | o | 0.115 | 6000< |
| | 14 | HA | 60/60 | Air-water spray | 2800 | 240 | 30 | 100 | o | 0.116 | 6000< |
| | 15 | HA | 100/100 | " | 700 | 34 | 5 | 200 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m² | | | Δ | 0.154 | 500 |
| | 3 | EG | 60/60 | — | — | Electrolytic chromate (23 mg/m² as metallic Cr) | | | x | 0.182 | 6000< |
| | 4 | AS | 60/60 | Air-water spray | 1000 | No treatment | | | o | 0.382 | 6000< |

TABLE 11-continued

| | | | | | | | | | | |
|---|---|---|---|---|---|---|---|---|---|---|
| | 5 | AS | 45/45 | " | 700 | Mn: 880 mg/m$^2$ | | Δ | 0.178 | 6000< |
| | 6 | AS | 30/30 | — | — | No treatment | | o | 0.268 | 500 |
| | 7 | HA | 60/60 | Air-water spray | 1200 | " | | o | 0.718 | 6000< |
| | 8 | GI | 120/120 | Dipping | 350 | " | | o | 0.755 | 6000< |
| | 9 | Zn/Zn—Cr | 20/20 | — | — | — | | o | 0.770 | 500 |

Note: Expressed in terms of elemental Mn, P or V.

(Upper layer: Mn oxide- P oxide- Ca oxide)

| | Run No. | Plated sheet steel | Plating weight (Top face/Bottom face (g/m$^2$) | ZnO film formation: Treating method | ZnO film formation: Film amount (mg/m$^2$) | Oxide film amount*) (mg/m$^2$): Mn | P | Ca | Phosphatability | Press formability (Friction coefficient) | Weldability |
|---|---|---|---|---|---|---|---|---|---|---|---|
| Example | 1 | EG | 20/20 | Dipping | 30 | 23 | 18 | 1 | o | 0.106 | 6000< |
| | 2 | EG | 40/40 | Electrolysis | 100 | 1 | 10 | 120 | o | 0.155 | 6000< |
| | 3 | EG | 60/60 | " | 300 | 7 | 1 | 30 | o | 0.156 | 6000< |
| | 4 | EG | 60/60 | " | 500 | 24 | 230 | 160 | o | 0.110 | 6000< |
| | 5 | EG | 60/60 | Dipping | 700 | 40 | 33 | 80 | o | 0.114 | 6000< |
| | 6 | EG | 60/60 | " | 1000 | 87 | 147 | 12 | o | 0.137 | 6000< |
| | 7 | EG | 60/60 | " | 1100 | 130 | 80 | 210 | o | 0.140 | 6000< |
| | 8 | AS | 60/60 | Air-water spray | 1800 | 483 | 2 | 12 | o | 0.145 | 6000< |
| | 9 | AS | 30/60 | " | 3000 | 1 | 3 | 490 | o | 0.122 | 6000< |
| | 10 | AS | 45/45 | " | 2000 | 28 | 32 | 400 | o | 0.104 | 6000< |
| | 11 | AS | 60/60 | " | 2200 | 32 | 310 | 80 | o | 0.104 | 6000< |
| | 12 | GI | 90/90 | Electrolysis | 1200 | 34 | 70 | 280 | o | 0.115 | 6000< |
| | 13 | GI | 120/120 | " | 1500 | 29 | 45 | 300 | o | 0.115 | 6000< |
| | 14 | HA | 60/60 | Air-water spray | 2800 | 240 | 30 | 60 | o | 0.116 | 6000< |
| | 15 | HA | 100/100 | " | 700 | 34 | 5 | 50 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m$^2$ | | | Δ | 0.154 | 500 |
| | 3 | EG | 60/60 | — | — | Electrolytic chromate (23 mg/m$^2$ as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m$^2$ | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note: Expressed in terms of elemental Mn, P or Ca.

(Upper layer: Mn oxide- P oxide- Co oxide)

| | Run No. | Plated sheet steel | Plating weight (Top face/Bottom face (g/m$^2$) | ZnO film formation: Treating method | ZnO film formation: Film amount (mg/m$^2$) | Oxide film amount*) (mg/m$^2$): Mn | P | Co | Phosphatability | Press formability (Friction coefficient) | Weldability |
|---|---|---|---|---|---|---|---|---|---|---|---|
| Example | 1 | EG | 20/20 | Dipping | 30 | 23 | 18 | 5 | o | 0.106 | 6000< |
| | 2 | EG | 40/40 | Electrolysis | 100 | 1 | 10 | 200 | o | 0.155 | 6000< |
| | 3 | EG | 60/60 | " | 300 | 7 | 1 | 100 | o | 0.156 | 6000< |
| | 4 | EG | 60/60 | " | 500 | 24 | 230 | 1 | o | 0.110 | 6000< |
| | 5 | EG | 60/60 | Dipping | 700 | 40 | 33 | 30 | o | 0.114 | 6000< |
| | 6 | EG | 60/60 | " | 1000 | 87 | 147 | 80 | o | 0.137 | 6000< |
| | 7 | EG | 60/60 | " | 1100 | 130 | 80 | 180 | o | 0.140 | 6000< |
| | 8 | AS | 60/60 | Air-water spray | 1800 | 483 | 470 | 12 | o | 0.145 | 6000< |
| | 9 | AS | 30/60 | " | 3000 | 154 | 200 | 270 | o | 0.122 | 6000< |
| | 10 | AS | 45/45 | " | 2000 | 28 | 32 | 420 | o | 0.104 | 6000< |
| | 11 | AS | 60/60 | " | 2200 | 432 | 310 | 200 | o | 0.104 | 6000< |
| | 12 | GI | 90/90 | Electrolysis | 1200 | 34 | 270 | 310 | o | 0.115 | 6000< |
| | 13 | GI | 120/120 | " | 1500 | 29 | 45 | 490 | o | 0.115 | 6000< |
| | 14 | HA | 60/60 | Air-water spray | 2800 | 240 | 30 | 290 | o | 0.116 | 6000< |
| | 15 | HA | 100/100 | " | 700 | 34 | 5 | 10 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m$^2$ | | | Δ | 0.154 | 500 |
| | 3 | EG | 60/60 | — | — | Electrolytic | | | x | 0.182 | 6000< |

TABLE 11-continued

| | | | | | | | | |
|---|---|---|---|---|---|---|---|---|
| | | | | | chromate (23 mg/m$^2$ as metallic Cr) | | | |
| 4 | AS | 60/60 | Air-water spray | 1000 | No treatment | o | 0.382 | 6000< |
| 5 | AS | 45/45 | " | 700 | Mn: 880 mg/m$^2$ | Δ | 0.178 | 6000< |
| 6 | AS | 30/30 | — | — | No treatment | o | 0.268 | 500 |
| 7 | HA | 60/60 | Air-water spray | 1200 | " | o | 0.718 | 6000< |
| 8 | GI | 120/120 | Dipping | 350 | " | o | 0.755 | 6000< |
| 9 | Zn/Zn—Cr | 20/20 | — | — | — | o | 0.770 | 500 |

Note: Expressed in terms of elemental Mn, P or Co.

(Upper layer: Mn oxide- P oxide- Ni oxide)

| | Run No. | Plated sheet steel | Plating weight (Top face/ Bottom face (g/m$^2$) | ZnO film formation: Treating method | Film amount (mg/m$^2$) | Oxide film amount*) (mg/m$^2$): Mn | P | Ni | Phosphatability | Press formability (Friction coefficient) | Weldability |
|---|---|---|---|---|---|---|---|---|---|---|---|
| Example | 1 | EG | 20/20 | Dipping | 30 | 23 | 18 | 10 | o | 0.106 | 6000< |
| | 2 | EG | 40/40 | Electrolysis | 100 | 1 | 10 | 50 | o | 0.155 | 6000< |
| | 3 | EG | 60/60 | " | 300 | 7 | 1 | 490 | o | 0.156 | 6000< |
| | 4 | EG | 60/60 | " | 500 | 24 | 230 | 30 | o | 0.110 | 6000< |
| | 5 | EG | 60/60 | Dipping | 700 | 40 | 33 | 1 | o | 0.114 | 6000< |
| | 6 | EG | 60/60 | " | 1000 | 87 | 147 | 5 | o | 0.137 | 6000< |
| | 7 | EG | 60/60 | " | 1100 | 130 | 80 | 60 | o | 0.140 | 6000< |
| | 8 | AS | 60/60 | Air-water spray | 1800 | 483 | 2 | 5 | o | 0.145 | 6000< |
| | 9 | AS | 30/60 | " | 3000 | 154 | 200 | 80 | o | 0.122 | 6000< |
| | 10 | AS | 45/45 | " | 2000 | 28 | 32 | 100 | o | 0.104 | 6000< |
| | 11 | AS | 60/60 | " | 2200 | 32 | 310 | 30 | o | 0.104 | 6000< |
| | 12 | GI | 90/90 | Electrolysis | 1200 | 34 | 270 | 10 | o | 0.115 | 6000< |
| | 13 | GI | 120/120 | " | 1500 | 29 | 45 | 5 | o | 0.115 | 6000< |
| | 14 | HA | 60/60 | Air-water spray | 2800 | 40 | 30 | 26 | o | 0.116 | 6000< |
| | 15 | HA | 100/100 | " | 700 | 34 | 5 | 50 | o | 0.111 | 6000< |
| | 16 | Zn/Zn—Cr | 20/20 | Electrolysis | 200 | 30 | 10 | 5 | o | 0.130 | 6000< |
| Comp. Example | 1 | EG | 20/20 | Electrolysis | 300 | No treatment | | | o | 0.948 | 6000< |
| | 2 | EG | 60/60 | — | — | Mn: 640 mg/m$^2$ | | | Δ | 0.154 | 500 |
| | 3 | EG | 60/60 | — | — | Electrolytic chromate (23 mg/m$^2$ as metallic Cr) | | | x | 0.182 | 6000< |
| | 4 | AS | 60/60 | Air-water spray | 1000 | No treatment | | | o | 0.382 | 6000< |
| | 5 | AS | 45/45 | " | 700 | Mn: 880 mg/m$^2$ | | | Δ | 0.178 | 6000< |
| | 6 | AS | 30/30 | — | — | No treatment | | | o | 0.268 | 500 |
| | 7 | HA | 60/60 | Air-water spray | 1200 | " | | | o | 0.718 | 6000< |
| | 8 | GI | 120/120 | Dipping | 350 | " | | | o | 0.755 | 6000< |
| | 9 | Zn/Zn—Cr | 20/20 | — | — | — | | | o | 0.770 | 500 |

Note: Expressed in terms of elemental Mn, P or Ni.

(Upper layer: Mn oxide- P oxide- at least one of $SiO_2$, $TiO_2$ and $Al_2O_3$)

| | Run No. | Plated sheet steel | Plating weight (Top face/ Bottom face) (g/m$^2$) | ZnO film Formation: Treating method | Film amount (mg/m$^2$) | Oxide Film amount*) (mg/m$^2$): Mn | P | $SiO_2$ | $TiO_2$ | $Al_2O_3$ | phat-bility | Press formability (Friction coefficient) | Weld-ability |
|---|---|---|---|---|---|---|---|---|---|---|---|---|---|
| Ex-ample | 1 | EG | 20/20 | Dipping | 30 | 23 | 18 | 5 | | | o | 0.106 | 6000< |
| | 2 | EG | 40/40 | Electrolysis | 100 | 1 | 10 | | 12 | | o | 0.155 | 6000< |
| | 3 | EG | 60/60 | " | 300 | 5 | 4 | | | 1 | o | 0.156 | 6000< |
| | 4 | EG | 60/60 | " | 500 | 24 | 30 | 8 | | | o | 0.110 | 6000< |
| | 5 | EG | 60/60 | Dipping | 700 | 240 | 33 | | 4 | | o | 0.114 | 6000< |
| | 6 | EG | 60/60 | " | 1000 | 87 | 147 | | | 10 | o | 0.137 | 6000< |
| | 7 | EG | 60/60 | " | 1100 | 130 | 80 | 33 | | | o | 0.140 | 6000< |
| | 8 | AS | 60/60 | Air-water spray | 1800 | 453 | 2 | 3 | | | o | 0.145 | 6000< |
| | 9 | AS | 30/60 | " | 3000 | 10 | 430 | | 5 | 43 | o | 0.122 | 6000< |
| | 10 | AS | 45/45 | " | 2000 | 28 | 32 | 10 | 7 | | o | 0.104 | 6000< |
| | 11 | AS | 60/60 | " | 2200 | 34 | 10 | 23 | 1 | 4 | o | 0.104 | 6000< |
| | 12 | GI | 90/90 | Electrolysis | 1200 | 329 | 70 | 15 | | | o | 0.115 | 6000< |
| | 13 | GI | 120/120 | " | 1500 | 40 | 45 | 3 | | | o | 0.115 | 6000< |
| | 14 | HA | 60/60 | Air-water spray | 2800 | 32 | 30 | 7 | 2 | 1 | o | 0.116 | 6000< |
| | 15 | HA | 100/100 | | 700 | 34 | 5 | 18 | | | o | 0.111 | 6000< |
| | 16 | Zn/Zn— | 20/20 | Electrolysis | 200 | 30 | 10 | 20 | 3 | 2 | o | 0.130 | 6000< |

TABLE 11-continued

| | | | | | | | | | |
|---|---|---|---|---|---|---|---|---|---|
| | | Cr | | | | | | | |
| Comp. | 1 | EG | 20/20 | Electrolysis | 300 | No treatment | o | 0.948 | 6000< |
| Ex- | 2 | EG | 60/60 | — | — | Mn: 640 mg/m$^2$ | Δ | 0.154 | 500 |
| ample | 3 | EG | 60/60 | — | — | Electrolytic chromate (23 mg/m$^2$ as metallic Cr) | x | 0.182 | 6000< |
| | 4 | AS | 60/60 | Air-water spray | 1000 | No treatment | o | 0.382 | 6000< |
| | 5 | AS | 45/45 | " | 700 | Mn: 880 mg/m$^2$ | Δ | 0.178 | 6000< |
| | 6 | AS | 30/30 | — | — | No treatment | o | 0.268 | 500 |
| | 7 | HA | 60/60 | Air-water spray | 1200 | " | o | 0.718 | 6000< |
| | 8 | GI | 120/120 | Dipping | 350 | " | o | 0.755 | 6000< |
| | 9 | Zn/Zn—Cr | 20/20 | — | — | — | o | 0.770 | 500 |

Note: *)Expressed in terms of weight of element for Mn and P, and in terms of weight of oxide for $SiO_2$, $TiO_2$ and $Al_2O_3$.

What is claimed is:

1. A zinc-based galvanized sheet steel excellent in press-formability and phosphatability which comprises a zinc-base plated sheet steel and an amorphous oxide-base film formed on a zinc-plating layer surface of said sheet steel; said amorphous oxide-base film containing at least one inorganic oxide selected from the group consisting of the oxides of Mn, Mo, Co, Ni and P in amount of 1–500 mg/m$^2$ in terms of the weight of P or metallic elements, and wherein said amorphous oxide-base film is dissolvable in phosphating treatment solutions.

2. A zinc-base galvanized sheet steel according to claim 1, wherein said amorphous oxide-base film contains oxide of Mn as said at least one inorganic oxide in an amount of 5–500 mg/m$^2$.

3. A zinc-base galvanized sheet steel according to claim 2 wherein said amorphous oxide-base film contains further at least one inorganic oxide selected from the group consisting of phosphoric acid, boric acid, and the oxides of Mo, W and V in an amount of 2–1,000 mg/m$^2$ in terms of the weight of P, B or metallic elements, provided that the total amount of the inorganic oxides does not exceed said amount of 2–1000 mg//m$^2$ when two or more inorganic oxides are further contained.

4. A zinc-base galvanized sheet steel according to claim 1 wherein said amorphous oxide-base film contains oxide of P as said at least one inorganic oxide.

5. A zinc-base galvanized sheet steel excellent in press-formability and phosphatability and having both functions of adhesion prevention and rolling lubrication which comprises a zinc-base plated sheet steel and an amorphous inorganic covering layer formed on a zinc-plating layer surface of said sheet steel; said amorphous inorganic covering layer containing at least one inorganic compound selected from the group consisting of the oxides and hydroxides of Mn, Mo, Co, Ni, Ca, V, W, Ti and Al in an amount of 1–500 mg/m$^2$ in terms of metallic element; and at least one member selected from the group consisting of oxides of P and B, and inorganic oxide colloids of Si, Al and Ti in amount of 1–500 mg/m$^2$ in terms of P, B, Si or metallic element, provided that the total amount of said inorganic compound and said at least one member is 2–1,000 mg/m$^2$, and wherein said amorphous inorganic covering layer is dissolvable in phosphating treatment solutions.

6. A zinc-based galvanized sheet steel according to claim 5 wherein the covering layer is formed in such a manner that its upper surface is rich in a material selected from the group consisting of oxides of P and B, and inorganic oxide colloids of Si, Al and Ti, its interface with the zinc plating layer is rich in a material selected from the group consisting of inorganic compound selected from the group consisting of oxides and hydroxides of Mn, Mo, Co, Ni, Ca, Cr, V, W, Ti and Al, and the amounts of said materials are changed gradiently so as to give a strong rolling lubricating function on the covering layer surface and a strong adhesion preventing function on the interface with the plating layer.

7. A zinc-base galvanized sheet steel according to claim 1 wherein said amorphous film further comprises Zn oxide layer being provided directly on the zinc plating layer surface.

8. A process for producing a zinc-base galvanized sheet steel excellent in press-formability and phosphatability having 2–1000 mg/m$^2$, in terms of P, B or metals, of an amorphous inorganic covering layer which is formed on a zinc plating layer surface of said sheet steel and is dissolvable in phosphating treatment solutions, has an adhesion preventing function through which the covering layer sticks via oxygen bonds to the plating layer surface at the time of press working and maintains covering in pursuance of its deformation together with a rolling lubricating function between a die and the plating layer, the process comprises contacting zinc-phase galvanized sheet steel with an acidic aqueous solution of a pH of 5 of less containing the ion(s) of at least one metal selected from the group consisting of Mn, Mo, Co, Ni, Ca, Cr, V, W, Ti, Al and containing the oxoacid(s) of at least one member selected from the group consisting of P or B, or subjecting the galvanized sheet steel to a cathodically electrolytic treatment in said solution, provided that the amount for each of said at least one metal and said oxoacid in the film is 1–500 mg/m$^2$.

9. A process for producing a zinc-base galvanized sheet steel excellent in press-formability and phosphatability which comprises forming zinc oxide on the surface of zinc-base galvanized sheet steel by any one of the following methods of (a) contacting the galvanized sheet steel with an acidic aqueous oxidizing agent solution, (b) subjecting the galvanized sheet steel to a cathodically electrolytic treatment in an aqueous solution containing zinc ions and an oxidizing agent, and (c) spraying an air-water mixture to the galvanized sheet steel surface at 300°–600° C., and then contacting the resulting upper layer with an acidic aqueous solution of a pH of 5 or less which contains at least one member selected from the group consisting of ions of metals consisting of Mn, Mo, Co, Ni, Ca, V, W, Ti and Al and oxoacids containing P or B, or subjecting the upper layer to a cathodically electrolytic treatment in the aqueous solution, to thereby provide an amorphous inorganic covering film that is dissolvable in phosphating treatment solutions.

10. A zinc-base galvanized sheet steel, which comprises a film made of 30–3,000 mg/m$^2$ of ZnO formed directly on a zinc plating layer surface of said sheet steel, and an amorphous film of an oxide formed on the ZnO film; said oxide being at least one member selected from the group consisting of oxides of Mn, Mo, Co, Ni, Ca, W, V, Ti, Al, P and B.

11. A zinc-base galvanized sheet steel according to claim 10 wherein said amorphous film contains further at least one inorganic oxide colloid selected from the group consisting of $SiO_2$, $TiO_2$ and $Al_2O_3$ in an amount of 1–500 mg/m$^2$ in terms of the weight of metallic elements or Si.

12. A zinc base galvanized sheet steel, which comprises a zinc-base plated sheet steel and an amorphous inorganic covering containing 3–500 mg/m$^2$ of Zn oxide and 5–500 mg/m$^2$ of Mn oxide in terms of metallic element and up to 1,000 mg/m$^2$ of at least one member selected from the group consisting of oxides of P and B in terms of the element, and wherein said amorphous inorganic covering is dissolvable in phosphating treatment solutions.

13. A zinc-base galvanized sheet steel according to claim 4, wherein said oxide of P is contained in amount of 1–500 mg/m$^2$.

14. A zinc-base galvanized sheet steel according to claim 13 wherein said amorphous oxide-base film contains further at least one inorganic oxide selected from the group consisting of the oxides of Mo, W and V, provided that the total amount of said inorganic oxides does not exceed 1,000 mg/m$^2$.

15. The zinc-based galvanized sheet steel of claim 10 wherein said amorphous oxide-base film is dissolvable in phosphating treatment solutions.

16. A zinc-base galvanized sheet steel according to claim 13 said amorphous oxide-base film contains further at least boric acid in an amount of 1,000 mg/m$^2$ or less in terms of boron, provided that the total amount of boric acid and phosphoric acid, if present does not exceed 1,000 mg/m$^2$.

* * * * *

UNITED STATES PATENT AND TRADEMARK OFFICE

CERTIFICATE OF CORRECTION

PATENT NO. : 5,525,431
DATED : June 11, 1996
INVENTOR(S) : Kanamaru et al.

It is certified that error appears in the above-indentified patent and that said Letters Patent is hereby corrected as shown below:

On The Title Page:

Item [30] Foreign Application Priority Data, please add the following:

---Nov. 10, 1990 [JP] .....02-305581
Nov. 10, 1990 [JP] .....02-305582
Nov. 10, 1990 [JP] .....02-305583---.

Signed and Sealed this

Eighth Day of October, 1996

Bruce Lehman

*Attest:*

BRUCE LEHMAN

*Attesting Officer*

*Commissioner of Patents and Trademarks*